US008220398B1

(12) United States Patent
Brandenberg

(10) Patent No.: US 8,220,398 B1
(45) Date of Patent: Jul. 17, 2012

(54) MODULAR FURNITURE SYSTEM

(75) Inventor: Carl Brock Brandenberg, Fort Worth, TX (US)

(73) Assignee: Legare, LP, Fort Worth, TX (US)

( * ) Notice: Subject to any disclaimer, the term of this patent is extended or adjusted under 35 U.S.C. 154(b) by 754 days.

(21) Appl. No.: 10/823,289

(22) Filed: Apr. 12, 2004

Related U.S. Application Data

(63) Continuation-in-part of application No. 09/753,799, filed on Jan. 2, 2001, now Pat. No. 6,769,369.

(60) Provisional application No. 60/173,960, filed on Dec. 30, 1999.

(51) Int. Cl.
*A47B 91/00* (2006.01)

(52) U.S. Cl. ..... 108/158.12; 312/111

(58) Field of Classification Search ..... 312/108–111, 312/195, 257.1, 263; 108/158.12, 159.11; 403/353

See application file for complete search history.

(56) References Cited

U.S. PATENT DOCUMENTS

| | | | | | |
|---|---|---|---|---|---|
| 3,744,437 | A * | 7/1973 | Tesar et al. | 108/158.12 |
| 4,098,480 | A * | 7/1978 | Neumann | 248/243 |
| 4,765,253 | A * | 8/1988 | Schappach | 108/158.12 |
| 5,613,746 | A * | 3/1997 | Green et al. | 312/195 |
| 5,641,217 | A * | 6/1997 | Caruso et al. | 312/404 |
| 5,716,154 | A * | 2/1998 | Miller et al. | 403/22 |
| 5,983,805 | A * | 11/1999 | Waluda | 108/158.12 |
| 6,004,065 | A * | 12/1999 | Higdon et al. | 403/384 |
| 6,402,108 | B1 * | 6/2002 | Remmers | 248/243 |
| 6,612,078 | B2 * | 9/2003 | Hawang | 52/36.5 |

FOREIGN PATENT DOCUMENTS

| | | | | |
|---|---|---|---|---|
| CH | 603117 | * | 8/1978 | 312/263 |

* cited by examiner

*Primary Examiner* — Hanh V Tran
(74) *Attorney, Agent, or Firm* — James E. Walton

(57) ABSTRACT

A modular furniture system having planar vertical components having slots and/or tabs, and planar horizontal components having slots and/or tabs, wherein the vertical components and the horizontal components releasably and interlockingly mate with each other to form a plurality of different pieces of furniture.

1 Claim, 59 Drawing Sheets

MODULAR FURNITURE SYSTEM

CLAIM OF PRIORITY

This continuation-in-part application claims the benefit of U.S. patent application Ser. No. 09/753,799, filed 2 Jan. 2001 now U.S. Pat. No. 6,769,369, entitled "Modular Furniture System," which claims the benefit of U.S. Provisional Patent Application Ser. No. 60/173,960, filed 30 Dec. 1999, entitled "Modular Desk System." This continuation-in-part application is incorporated herein as if fully set forth.

BACKGROUND OF THE INVENTION

1. Field of the Invention

The present invention relates to interlocking modular furniture. More particularly, the present invention relates to an assembly method for ready-to-assemble furniture made from planar material.

2. Background of the Invention

The internet has caused an incredible growth in the number of new businesses established to take advantage of products and services that can be sold and distributed over the internet. These businesses typically begin as small, private businesses that require but cannot afford the overhead that an already established, profitable company can. Nevertheless, these new businesses still have many of the same office needs as established companies, including suitable office furniture for employees.

The internet has also allowed many established businesses to change their working environments and allow employees to work from home in what is generally known as telecommuting. In telecommuting, employees work from home using the internet to access all the information and services required to complete their work. Telecommuting has helped companies reduce the size of their offices, but it has only transferred the responsibility of outfitting the employee's home office with suitable furniture to the employee.

In both the small company and the home office environment, there is a desire for cost-effective office furniture that is both functional and stylish. In the small, start-up company, the emphasis is on unique style and functionality. In the home office environment, the emphasis is on comfort and matching an existing décor. In the small company, there is usually no one responsible for facility management, and the burden lies on a subset of the employees to choose, purchase, configure, assemble, and maintain the office furniture. In the home, it is the responsibility of the employee to perform these tasks. As a result, the furniture selected must be easy to configure, assemble, and maintain, in addition to being stylish, functional, and affordable.

Office furniture can be categorized into two basic categories—case goods and modular systems.

CASEGOODS: Casegoods are freestanding furniture components typically found in offices that have individual rooms for employees, and they usually include complete desks, filing systems, and shelf units. Casegoods lack modularity and are simply separate furniture components that are set beside one another. For this reason, casegoods typically lack the style that small companies desire. Casegoods usually come pre-assembled because of their complex design, and are typically too large for the home environment since casegoods are rarely designed to fit through narrower doorways and into the smaller spaces typically found in the home. Although some small, inexpensive components are available through local office supplies from manufacturers such as O'Sullivan and Rubbermaid, their styling is typically very dull, and their quality is low, being manufactured from laminated particle board, sheet metal, and blow-molded plastic. Furthermore, although some stylish and more attractive components are available from manufacturers, such as the Beirise Collection, the TJ Collection from Herman Miller, Docker and Roadworks from Steelcase, and Tripoli and Varia from Haworth, these components are extremely expensive, and are typically purchased only by very profitable companies or individuals.

MODULAR SYSTEMS: In contrast, modular systems consist of components that can be configured and assembled for a particular office environment, then disassembled, reconfigured and reassembled to satisfy changing needs. Components of modular systems include vertical support panels, work surfaces, shelving, and storage systems that can be assembled in many different configurations. Modular systems are designed for large office spaces that will be broken up by the furniture itself which is typically configured to form individual cubicles for employees. Thus, modular systems are not well suited for small office spaces or a home environment where they do not integrate well with existing decor. Such modular systems also require a certain level of expertise to configure and assemble them. Modular systems are engineered to have a very long service life and are very expensive, out of the reach of all but the most profitable companies. Although modular systems can be purchased as used or reconditioned, this market is small, and there are few retail outlets where a buyer can go and shop to find used furniture in good condition. These modular systems include such systems as Action Office and Ethospace from Herman Miller, Context and Series 9000 from Steelcase, and Causeway and Unigroup from Haworth. There are less expensive lines of furniture available, but the quality of the furniture is typically low, because the manufacturers strive to provide all the features of the more expensive systems at a much lower cost, but cannot do so without reducing the quality of manufacture. As a result, existing modular systems are neither cost effective nor appropriate for small office or home use.

As a result neither existing casegoods nor existing modular furniture systems provide cost-effective, functional, and stylish furniture that can be configured and assembled by persons without a certain level of expertise in facility management or in assembling such furniture.

BRIEF SUMMARY OF THE INVENTION

There is a need for a modular furniture system that may be manufactured entirely from planar material of uniform thickness, that may be assembled without tools or fasteners, that may be reversible, that may be re-configured into different pieces of furniture, and that requires no level of expertise to assemble.

Therefore, it is an objective of the present invention to provide a modular furniture system that may be manufactured entirely from planar material of uniform thickness, that may be assembled without tools or fasteners, that may be reversible, and that may be re-configured into different pieces of furniture.

Under ideal manufacturing conditions, raw material specifications are exact and manufacturing processes are precise, resulting in furniture that assembles easily and yields a secure, solid product once assembled. In real life, however, raw material specifications cannot be relied upon to be exact or uniform, and manufacturing processes can be imprecise and introduce dimensional variations in manufactured product because of such factors as cutter sharpness, machine repeatability, sanding, routing and finishing variations, to name a few. These variations in raw material specifications and manufacturing precision can result in manufactured product that does not meet exact specifications. In these cases, assembly of the product can be difficult, or the assembled product can be less secure and solid than desired.

To accommodate these variations in material specifications and manufacturing precision, fit tolerances are engineered into the design. Fit tolerances specify dimensions, as ranges of acceptable values that will still yield a manufactured product that will assemble properly without excessive force or modification. Loose fit tolerances are typically specified to improve manufacturing yield by rejecting fewer raw materials due to out of specification thicknesses, and by rejecting fewer manufactured parts due to variations in the precision of the manufacturing processes. This is because loose fit tolerances specify product dimensions that will accommodate raw material at its greatest acceptable thickness, and accommodate the greatest acceptable variations in manufacturing precision. However, under conditions other than these extreme conditions, loose fit tolerances typically result in joints that are loose and an assembled product that is less than secure.

While an obvious solution would be to engineer close fit tolerances into the design, thereby limiting the acceptable range of dimensional variations, it is not practical to do so because this will tend to result in higher costs due to lower raw material yield and higher part rejection due to more manufactured parts being beyond the acceptable dimensional limits. It is nearly always beneficial to engineer the greatest possible loose fit tolerances into the design to maximize yield and minimize costs.

For these reasons that loose fit tolerances are beneficial, it is an objective of the present invention to utilize joint designs that are tolerant of wide variations in raw material specifications and manufacturing precision, yet still yield securely assembled finished product.

The above objects are achieved by providing a modular furniture system in which the components of the furniture may be made from planar material that may be of uniform thickness. Each component is finished on both sides so that each component is reversible. The components have interlocking tabs, slots, and grooves, which allow the components to be interchanged to form different types of furniture, such as tables, desks, desk returns, desk extensions, desk bridges, hutches, bookshelves, end tables, entertainment centers, beds, chairs and others. Because the components are connected together by interlocking tabs, slots, and grooves, no fasteners, glue, or adhesive is required to assemble, disassemble, or re-configure the furniture.

The present invention has significant advantages, including the following:

1. All component pieces may be planar in design.
2. Each individual component may be fabricated entirely from planar material of uniform thickness.
3. All components, including work surfaces and vertical supports, may be reversible.
4. Both symmetrical and asymmetrical furniture designs are possible.
5. Each type of furniture may be assembled without tools.
6. Improved joint designs for connecting components are tolerant of wide variations in material thickness, yet still yield securely assembled product.
7. Improved joint designs are tolerant of wide variations in manufacturing precision, yet still yield securely assembled product.
8. Improved joint designs provide low-effort, ease of assembly, yet still yield securely assembled product.

DETAILED DESCRIPTION OF THE PREFERRED EMBODIMENT

Figure 1:
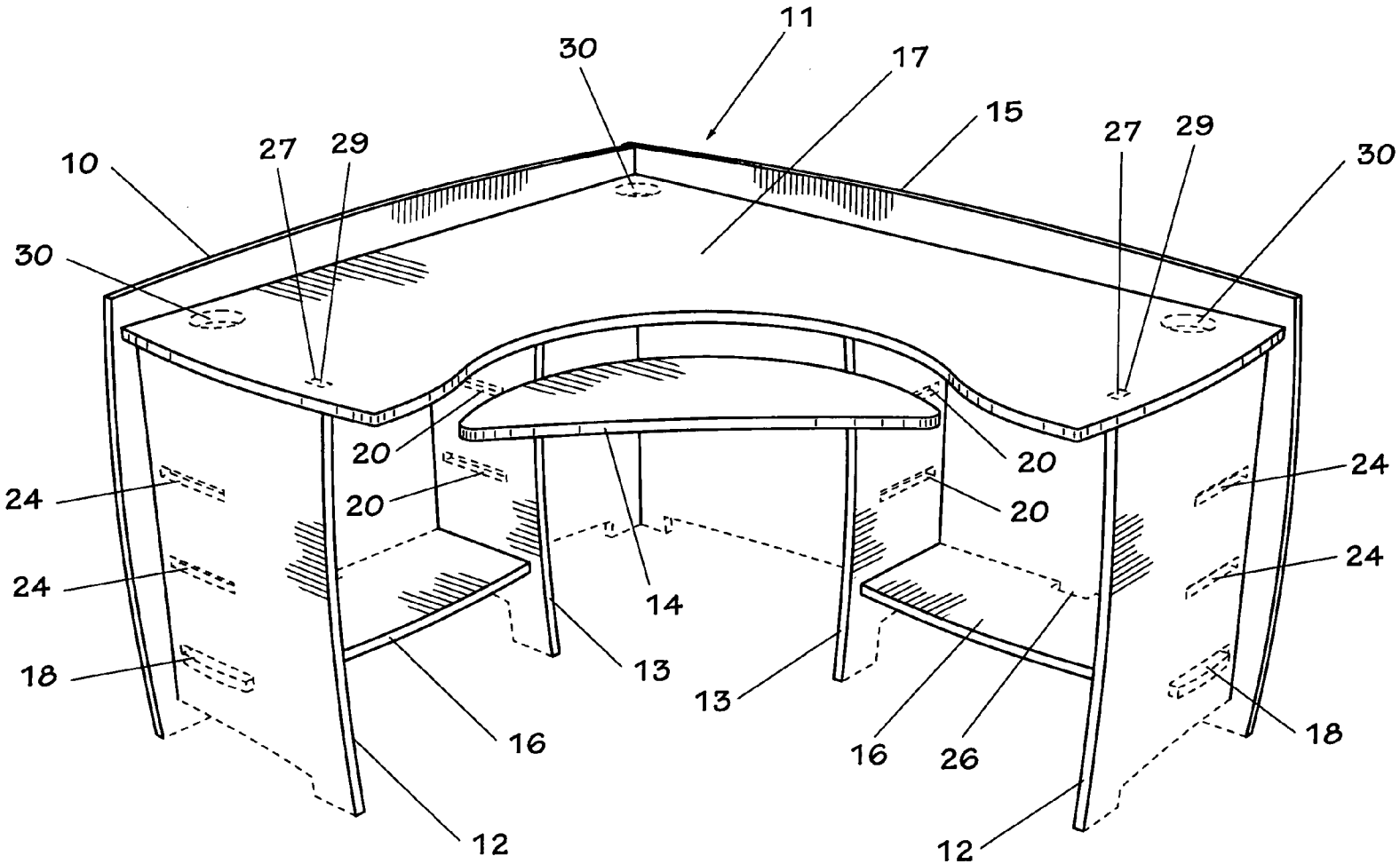
FIG. 1 is a front perspective view of a corner desk according to the present invention.
Figure 2:
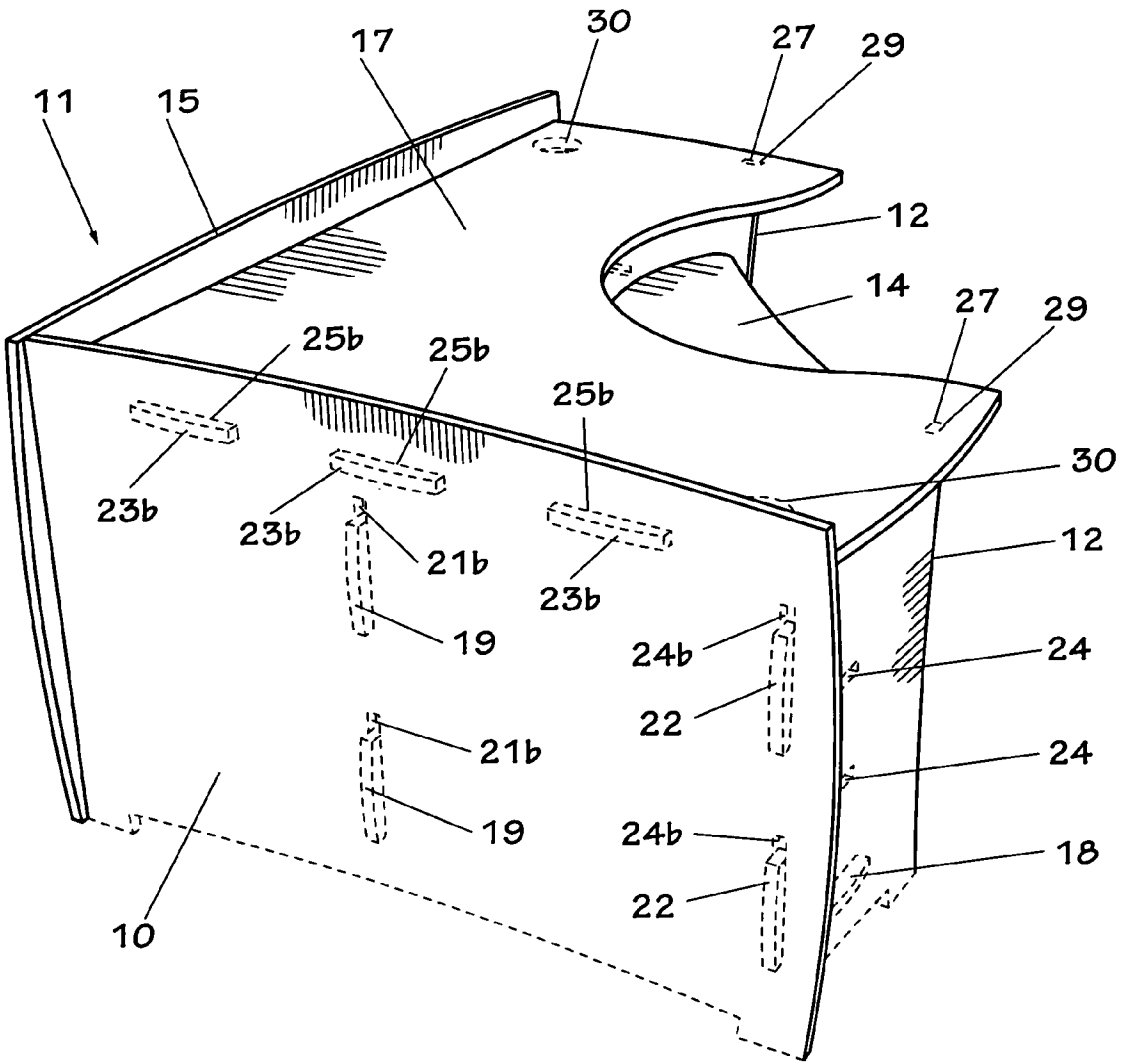
FIG. 2 is a left-side rear perspective view of the desk of FIG. 1.
Figure 3:
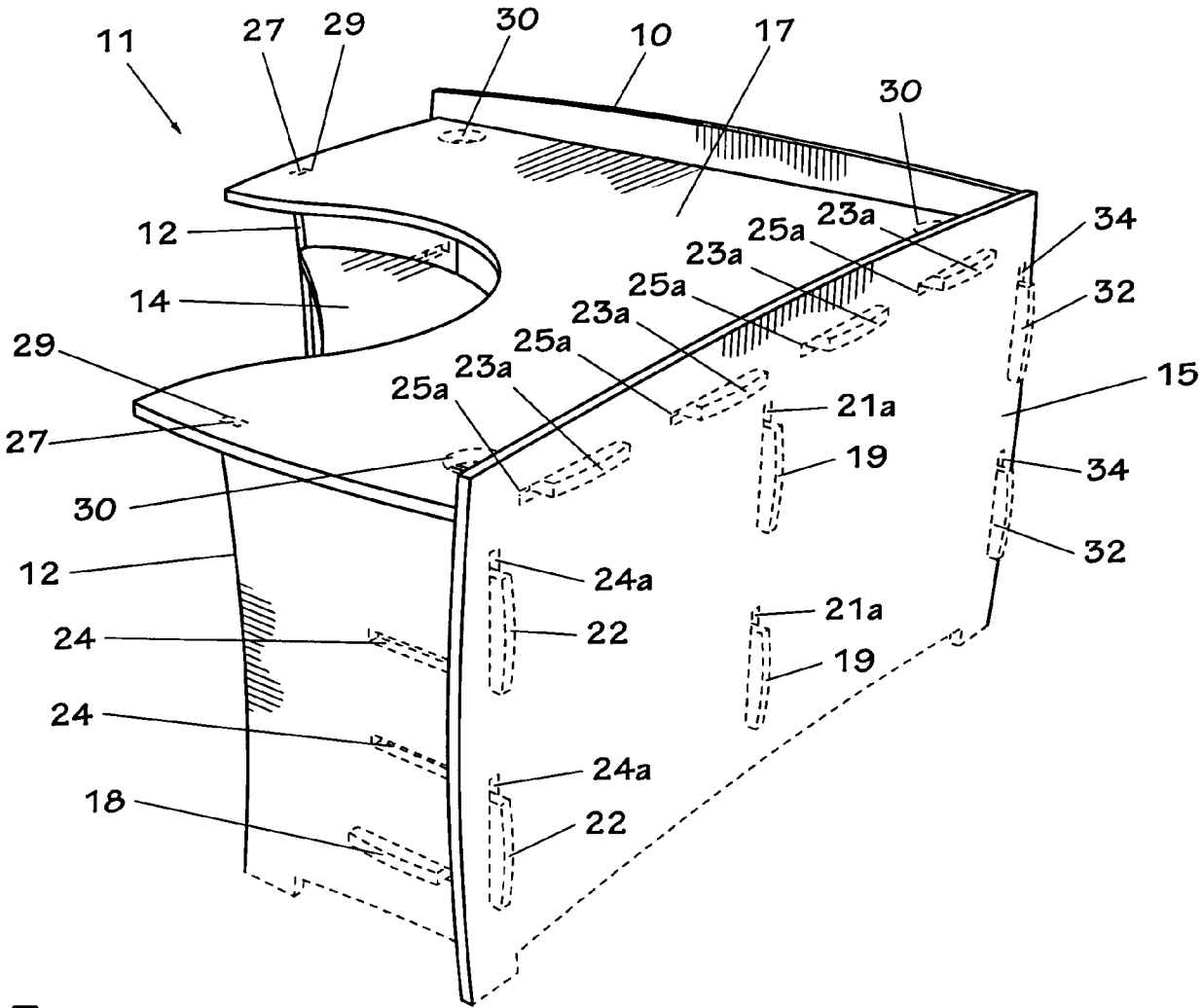
FIG. 3 is a right-side rear perspective view of the desk of FIG. 1.
Figure 4:
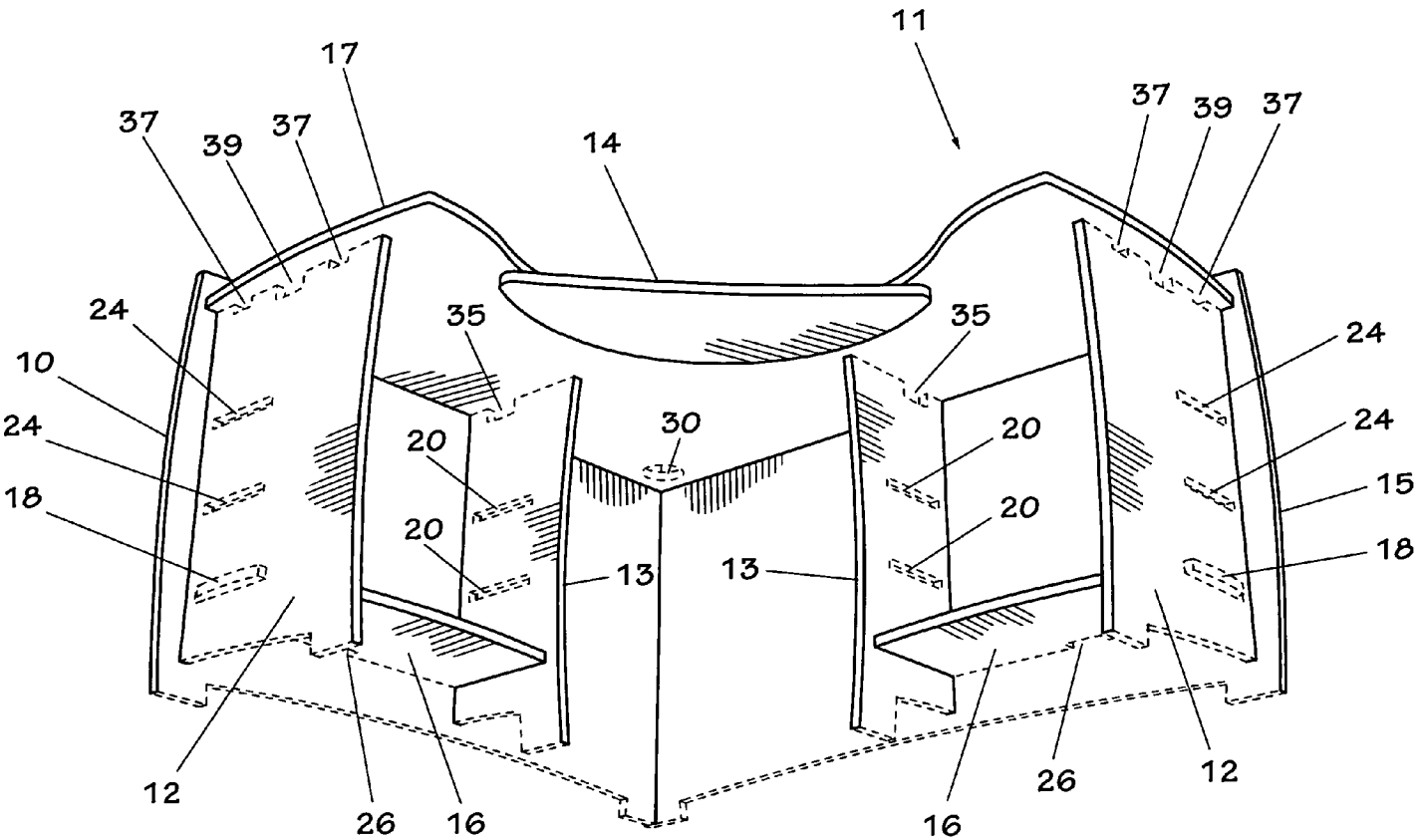
FIG. 4 is a bottom perspective view of the desk of FIG. 1.
Figure 5:
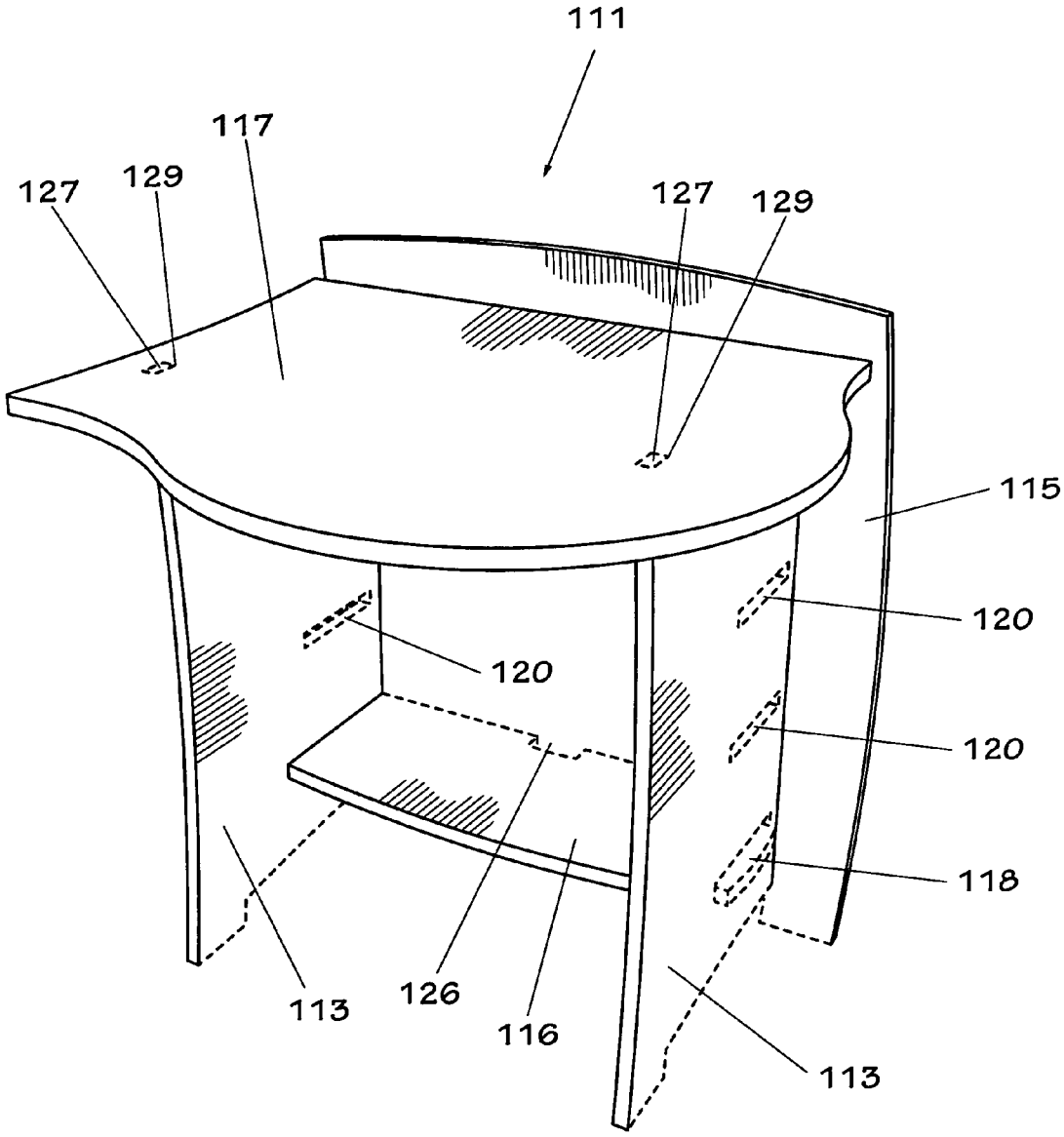
FIG. 5 is a right-side front perspective view of a desk extension according to the present invention.
Figure 6:
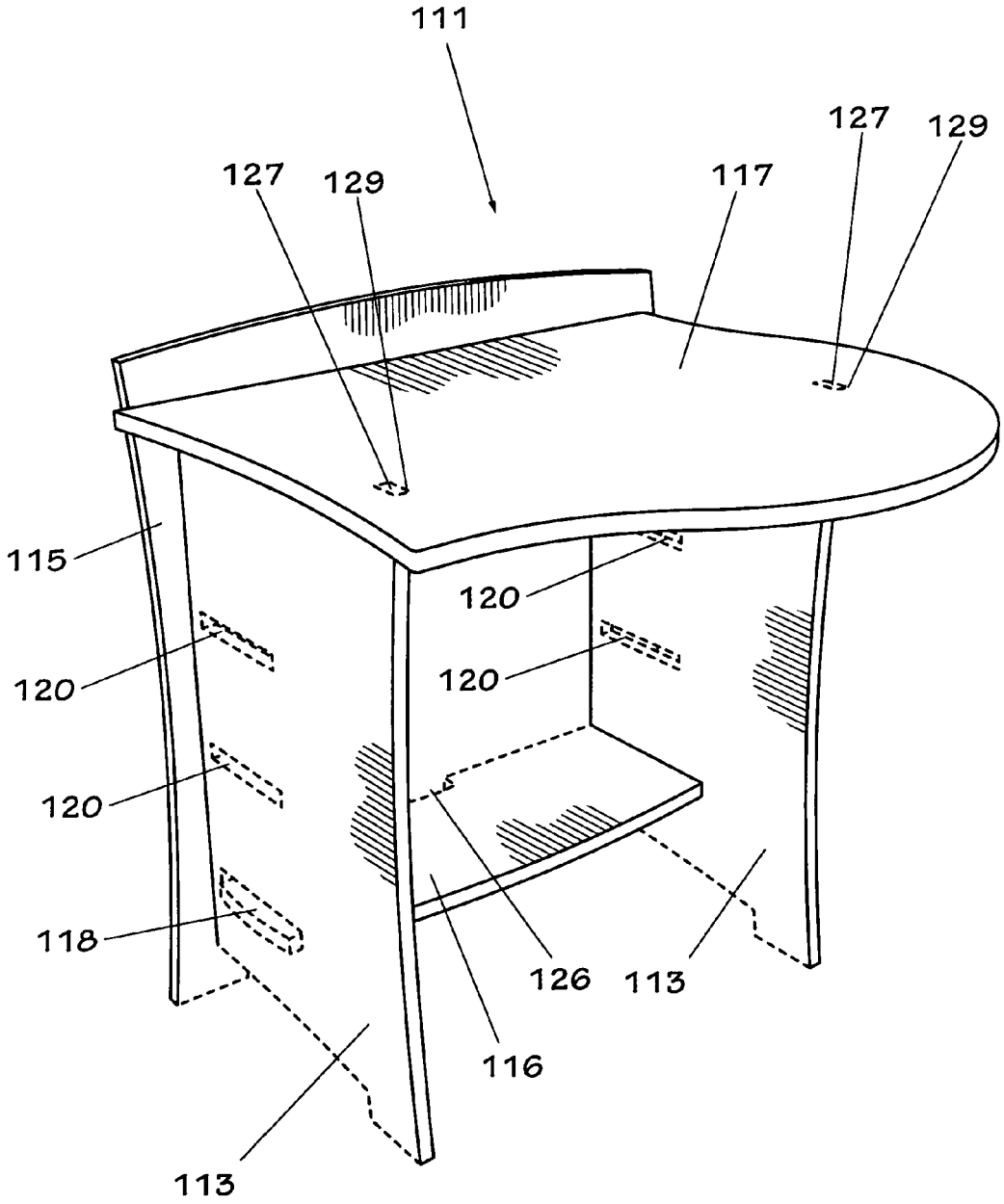
FIG. 6 is a left-side front perspective view of the desk extension of FIG. 5.
Figure 7:
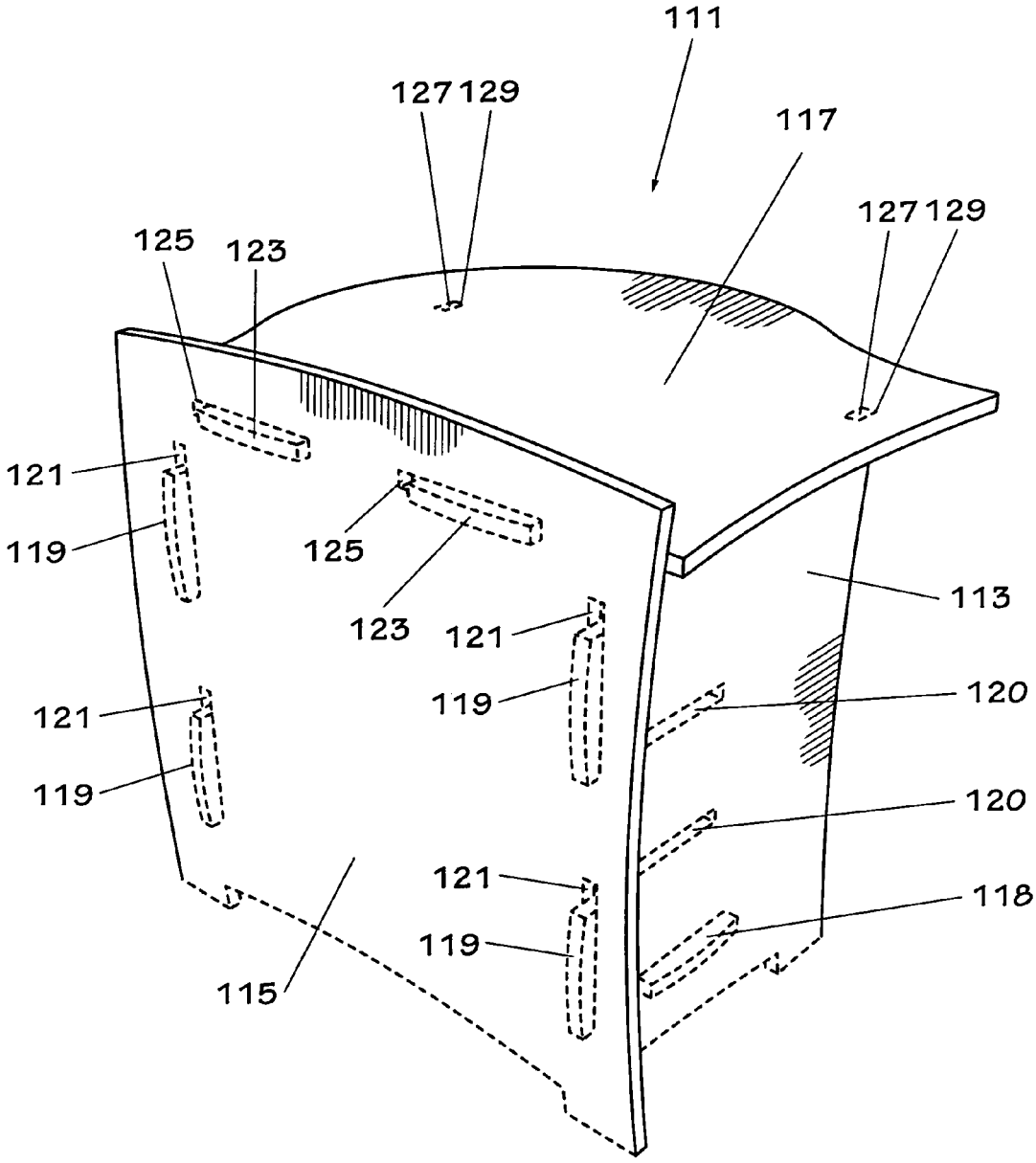
FIG. 7 is a left-side rear perspective view of the desk extension of FIG. 5.
Figure 8:
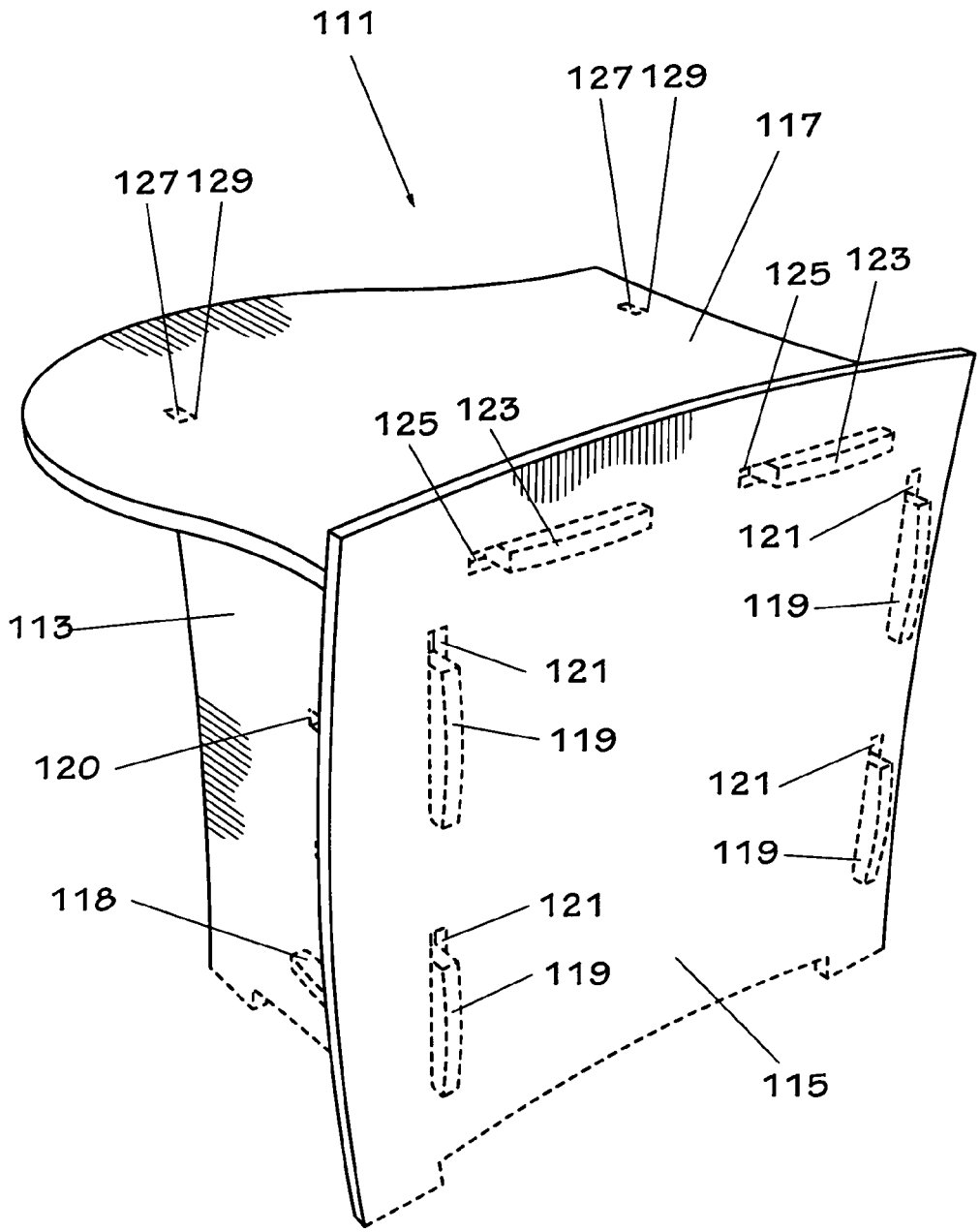
FIG. 8 is a right-side rear perspective view of the desk extension of FIG. 5.
Figure 9:
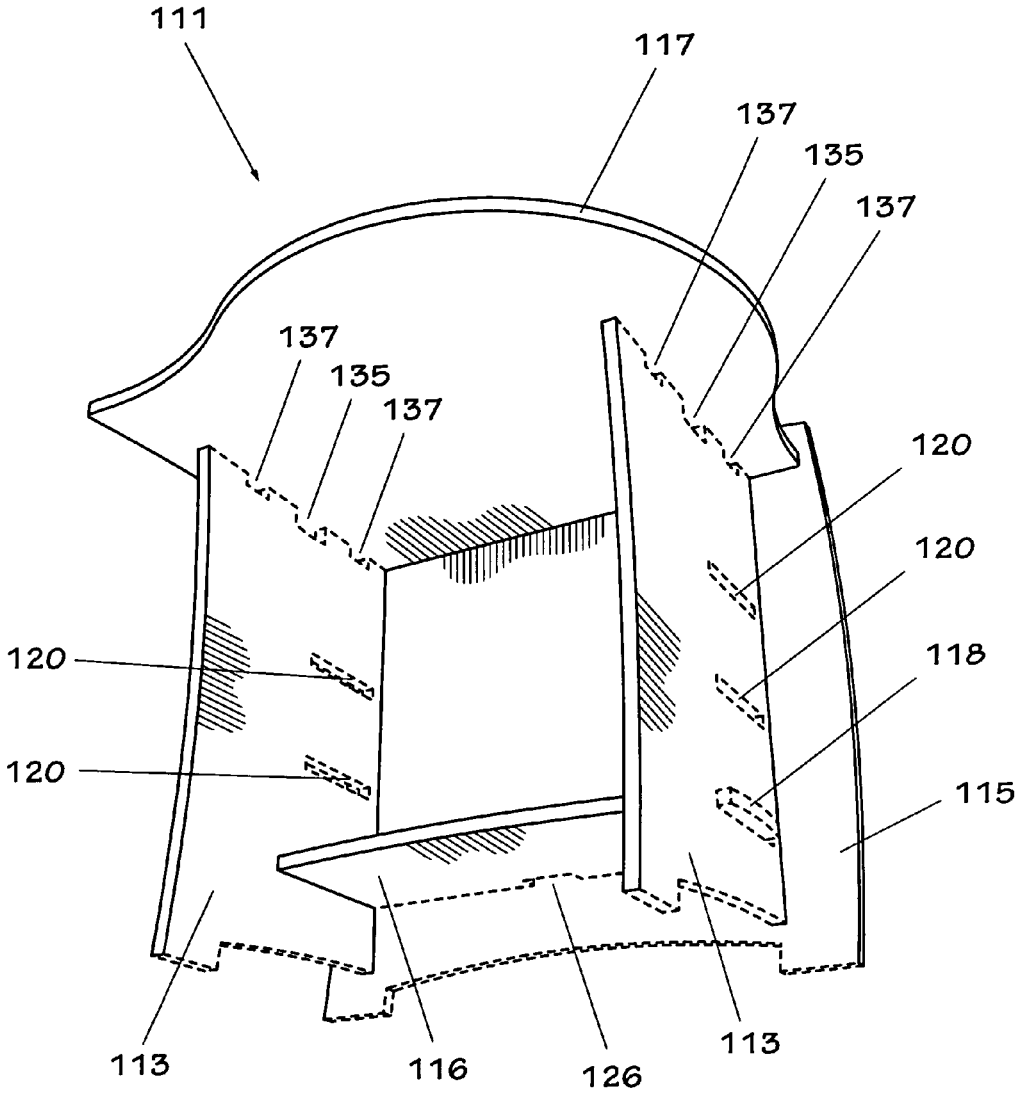
FIG. 9 is a right-side bottom perspective view of the desk extension of FIG. 5.
Figure 10:
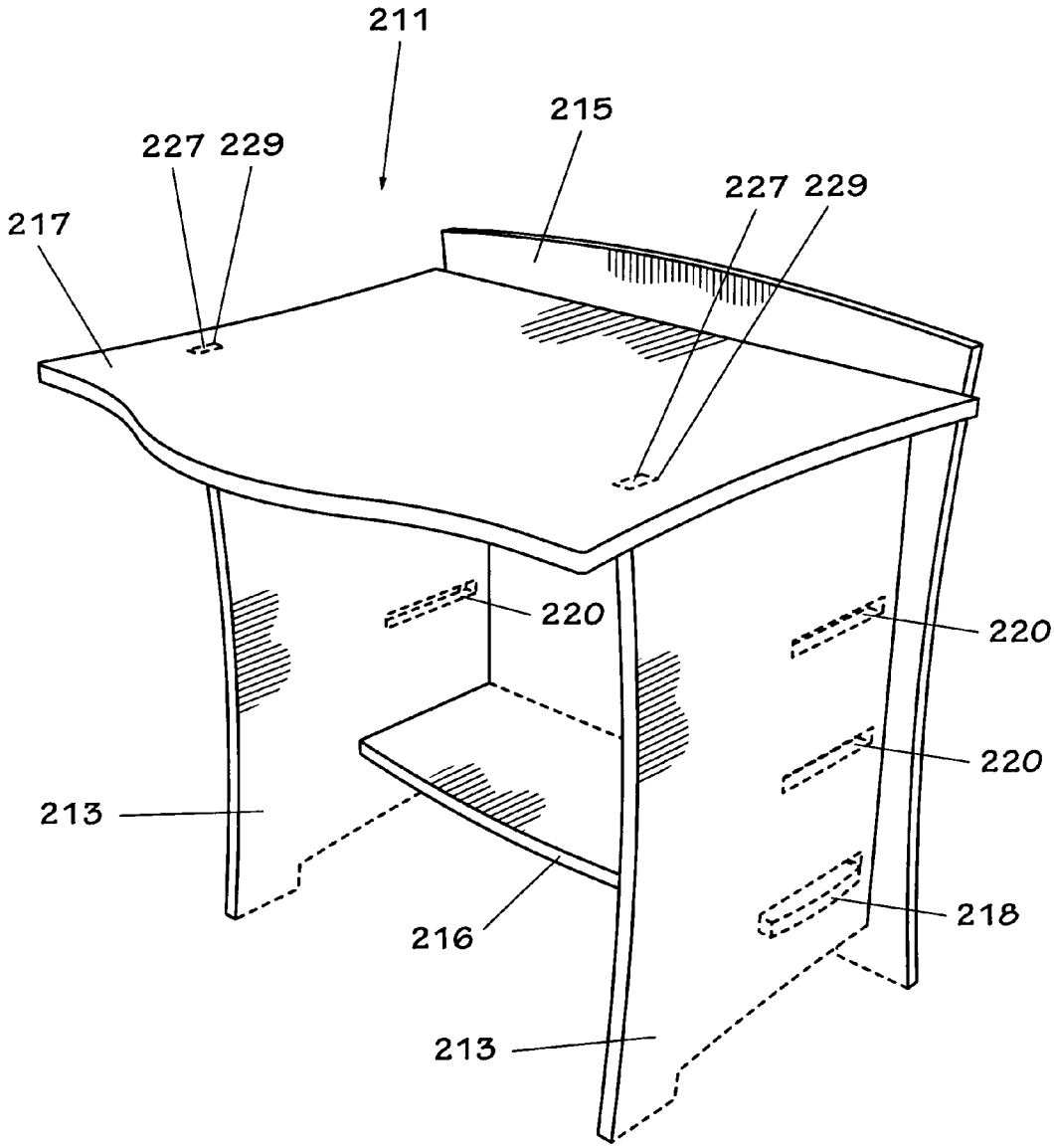
FIG. 10 is a right-side front perspective view of a desk bridge according to the present invention.
Figure 11:
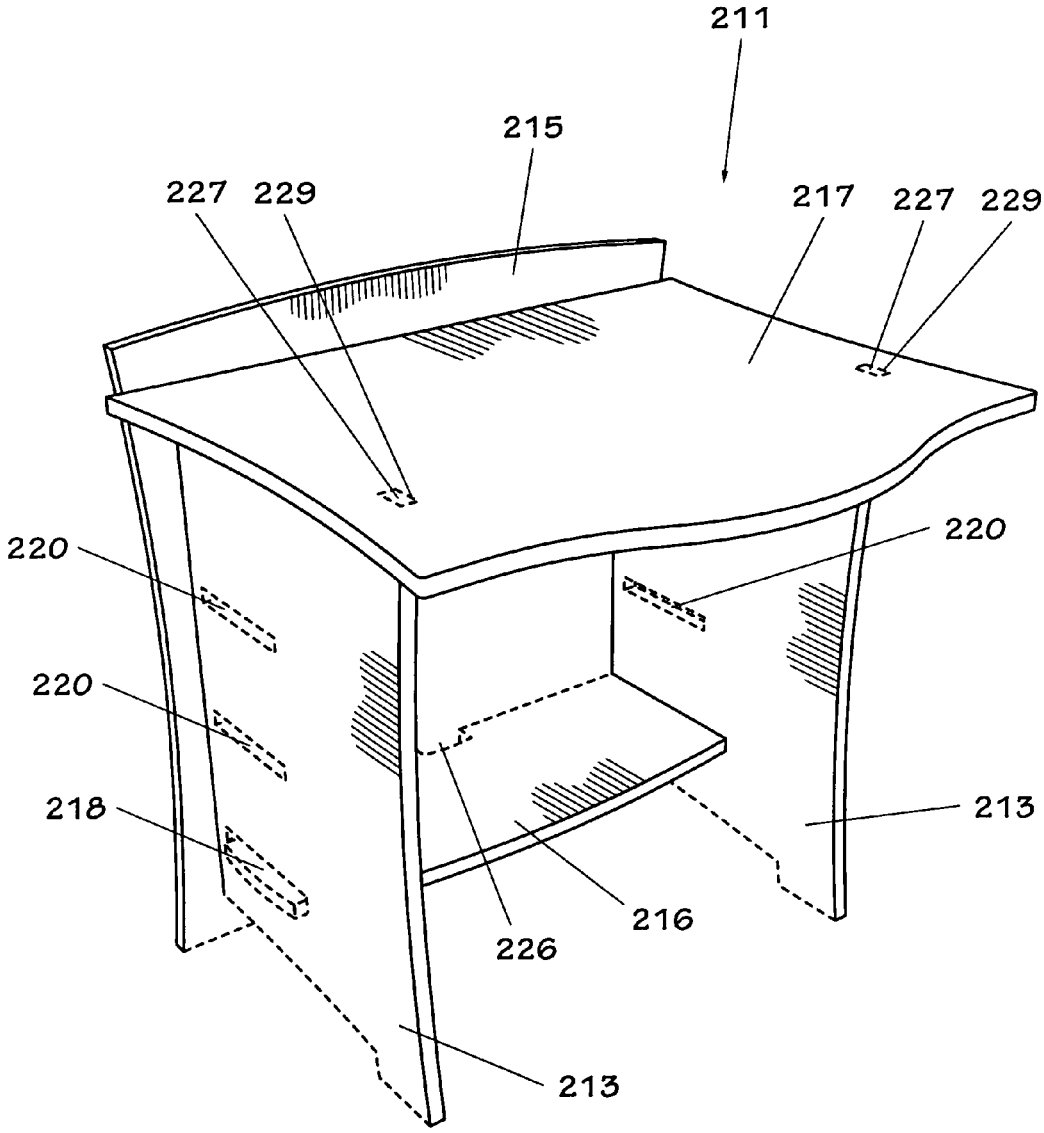
FIG. 11 is a left-side front perspective view of the desk bridge of FIG. 10.
Figure 12:
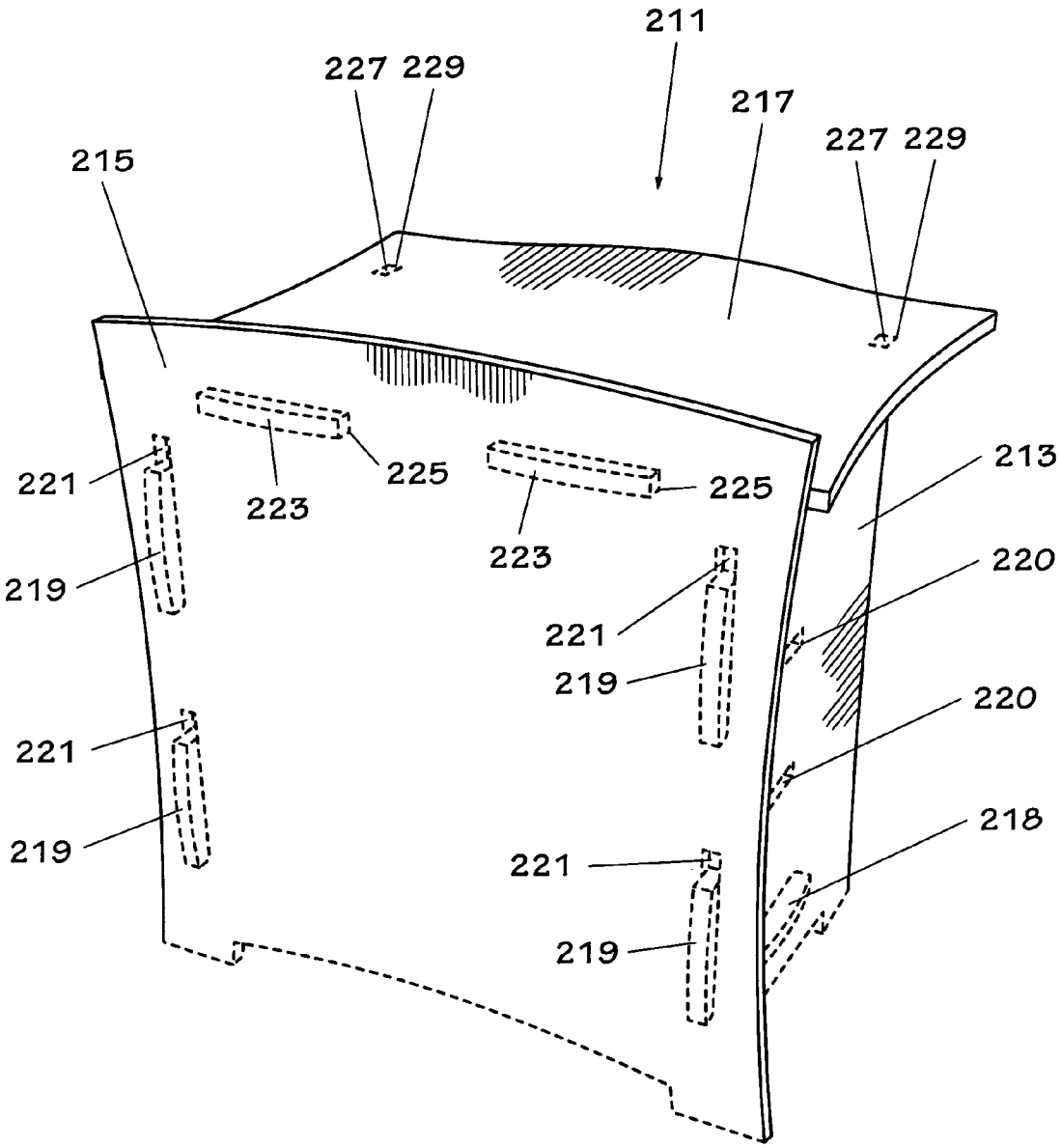
FIG. 12 is a left-side rear perspective view of the desk bridge of FIG. 10.
Figure 13:
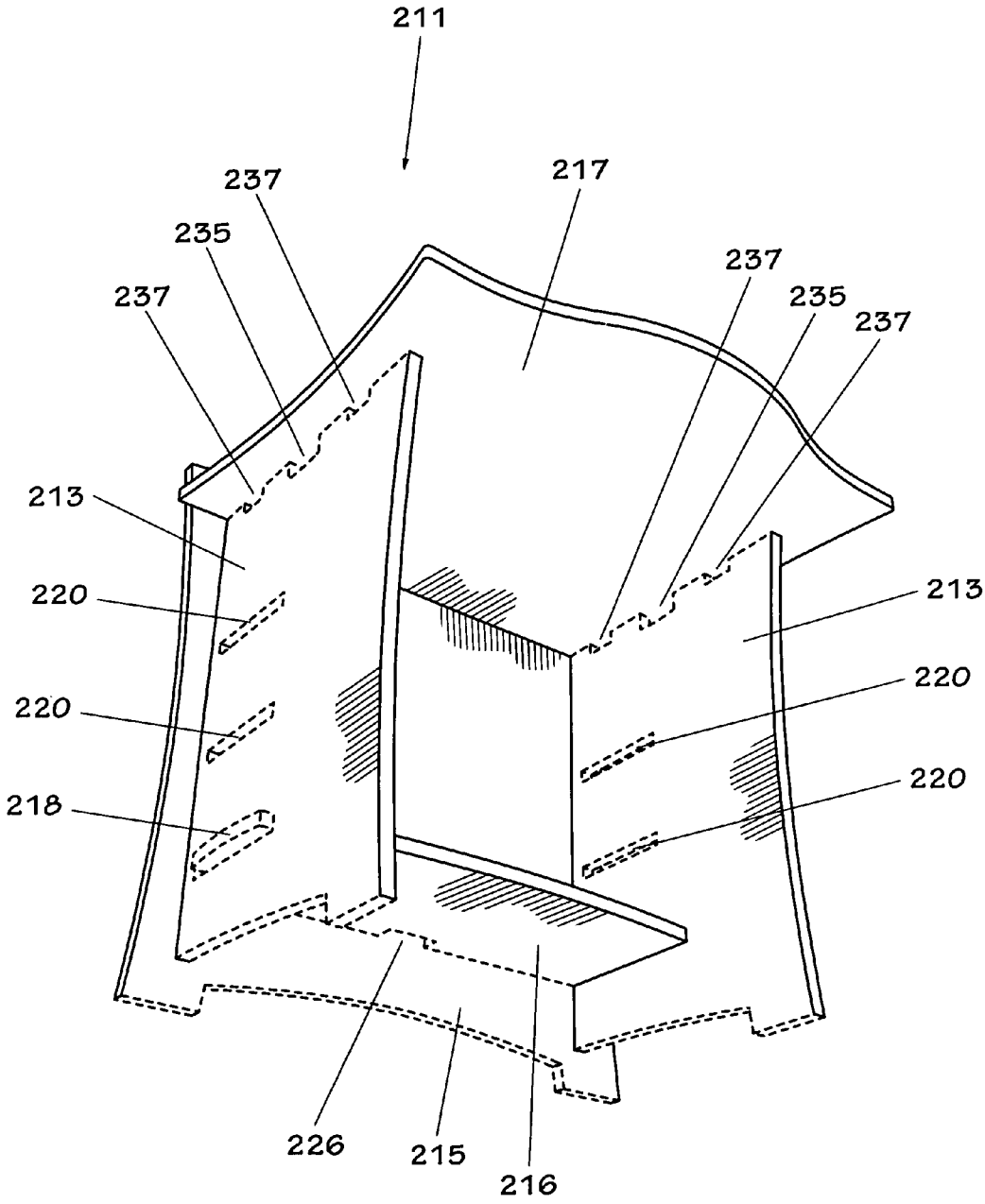
FIG. 13 is a left-side bottom perspective view of the desk bridge of FIG. 10.
Figure 14:
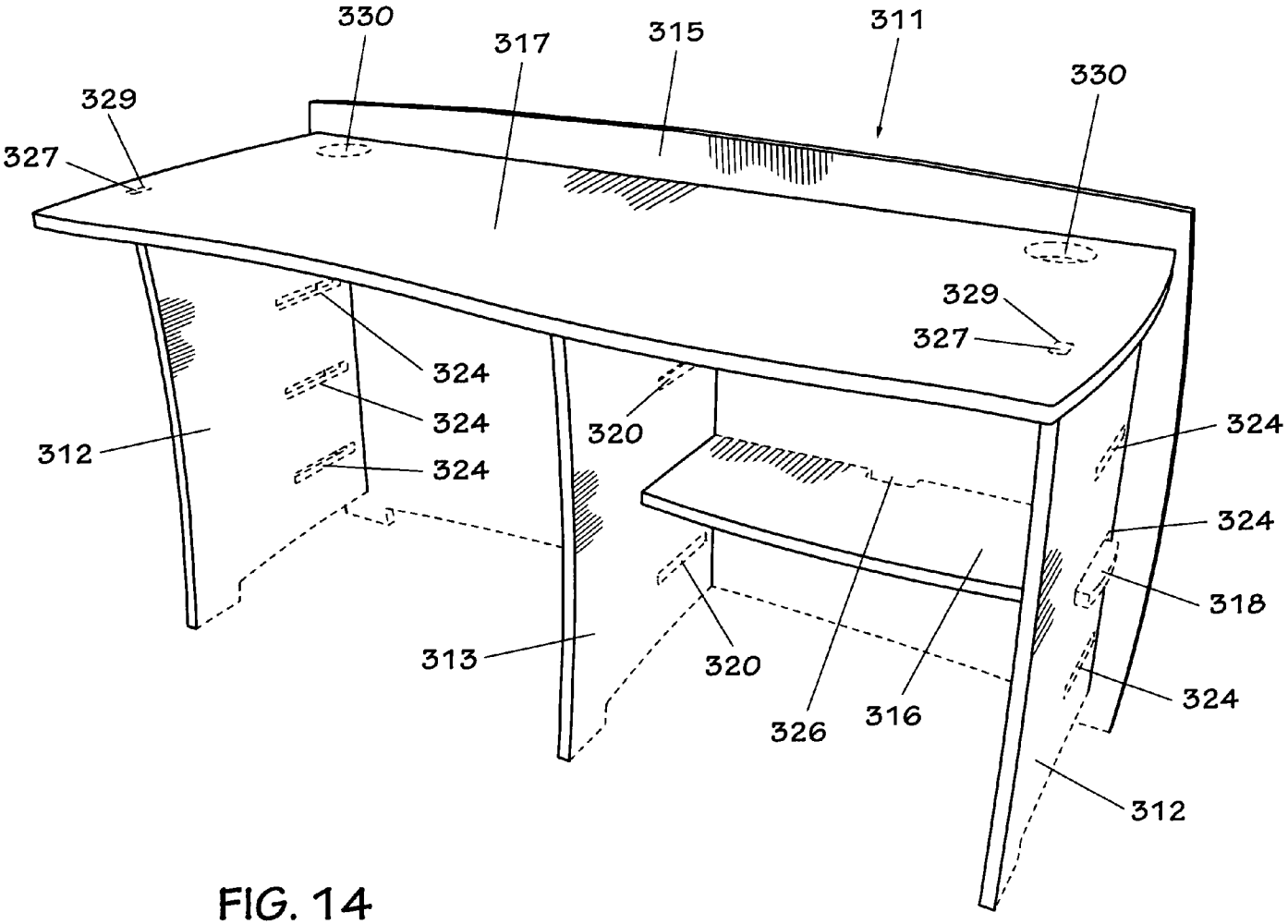
FIG. 14 is a right-side front perspective view of a rectangular desk according to the present invention.
Figure 15:
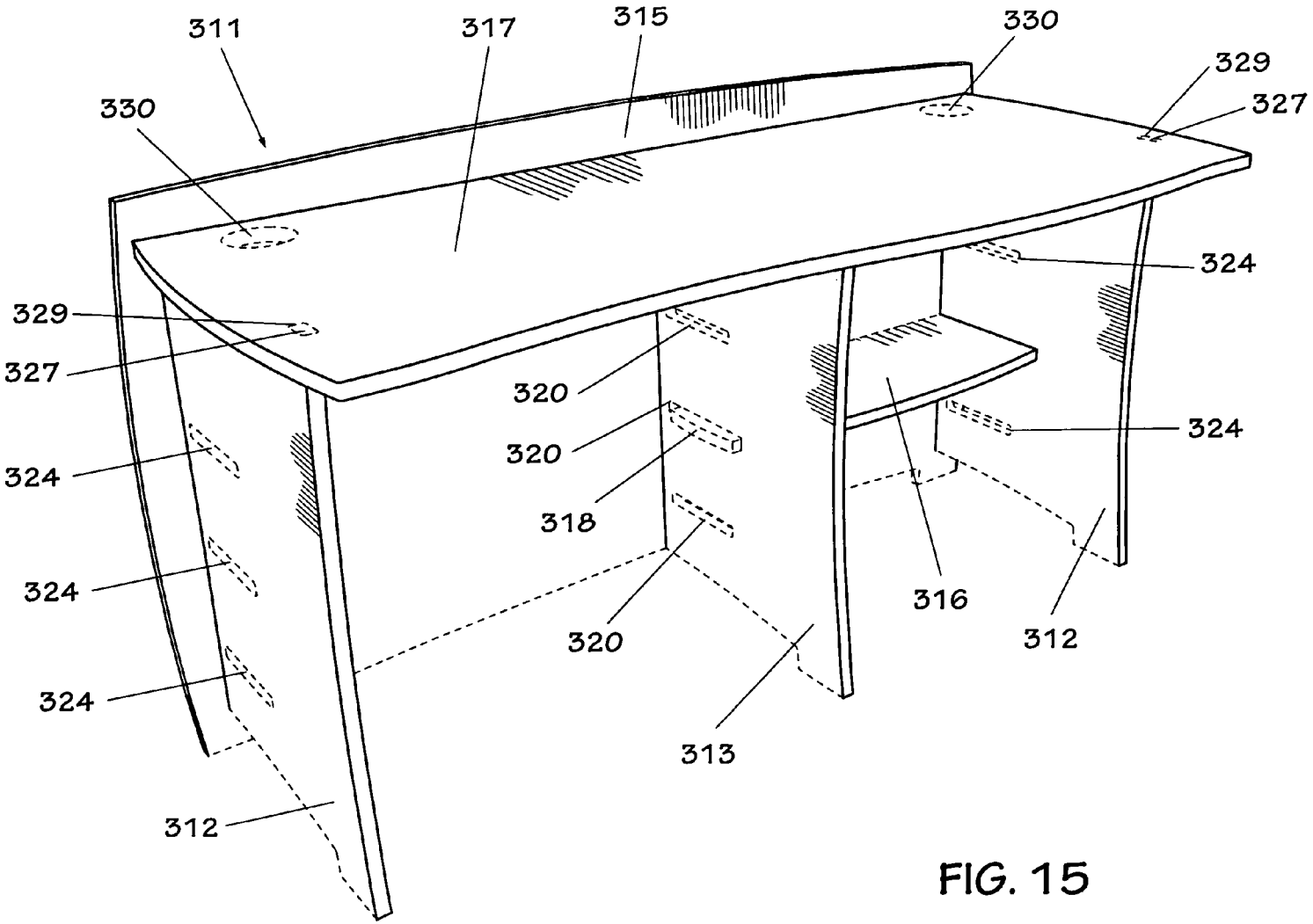
FIG. 15 is a left-side front perspective view of the desk of FIG. 14.
Figure 16:
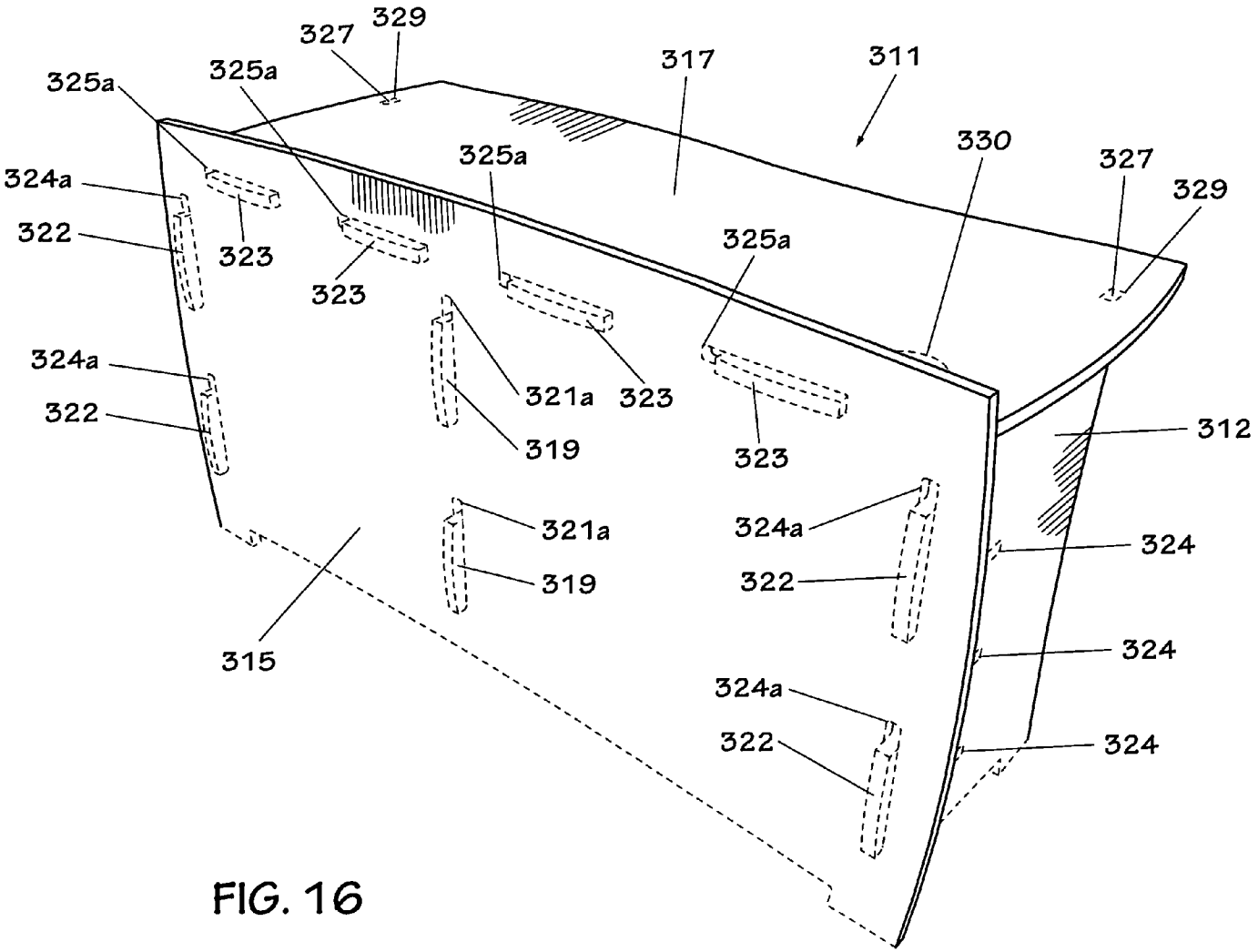
FIG. 16 is a left-side rear perspective view of the desk of FIG. 14.
Figure 17:
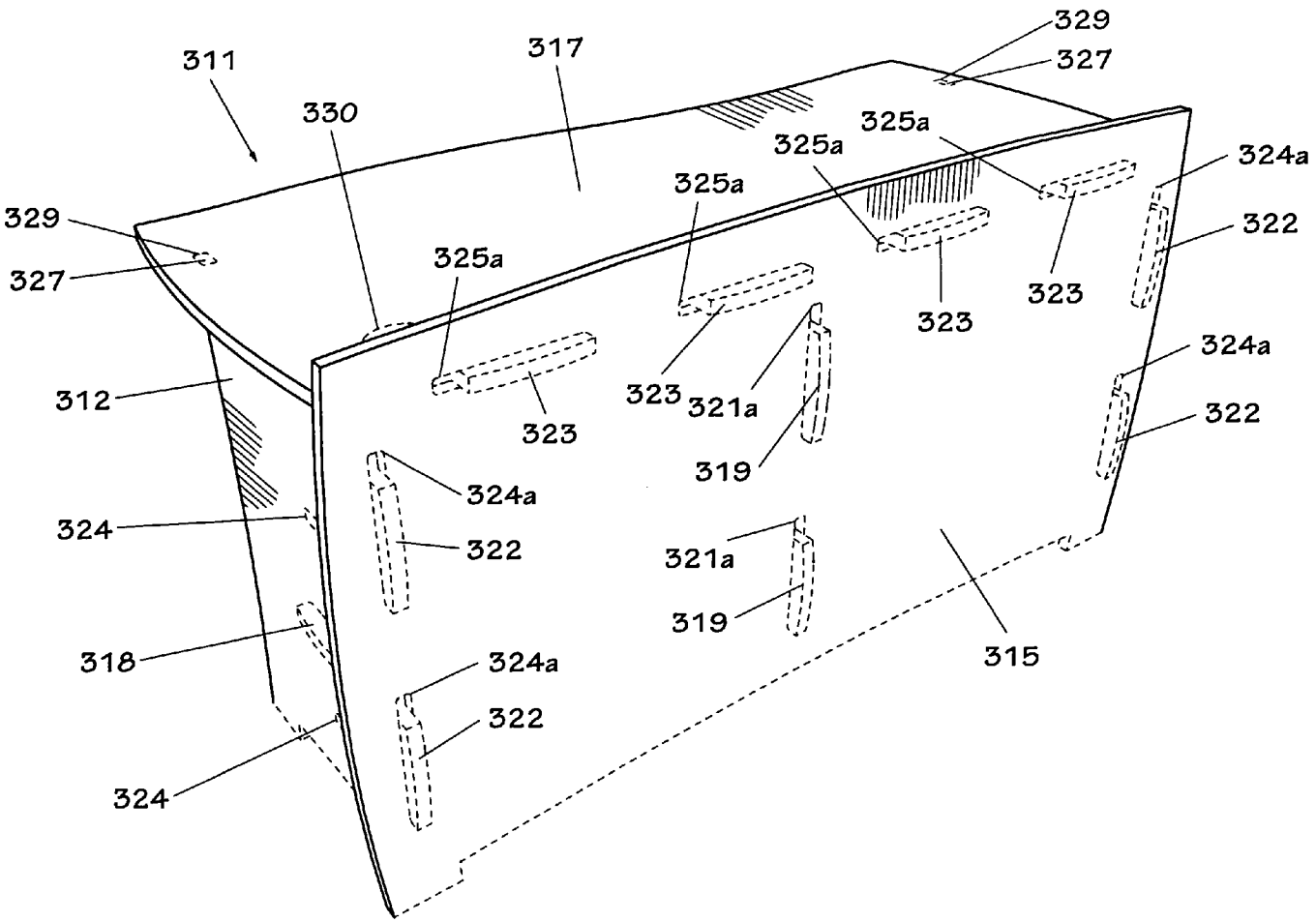
FIG. 17 is a right-side rear perspective view of the desk of FIG. 14.
Figure 18:
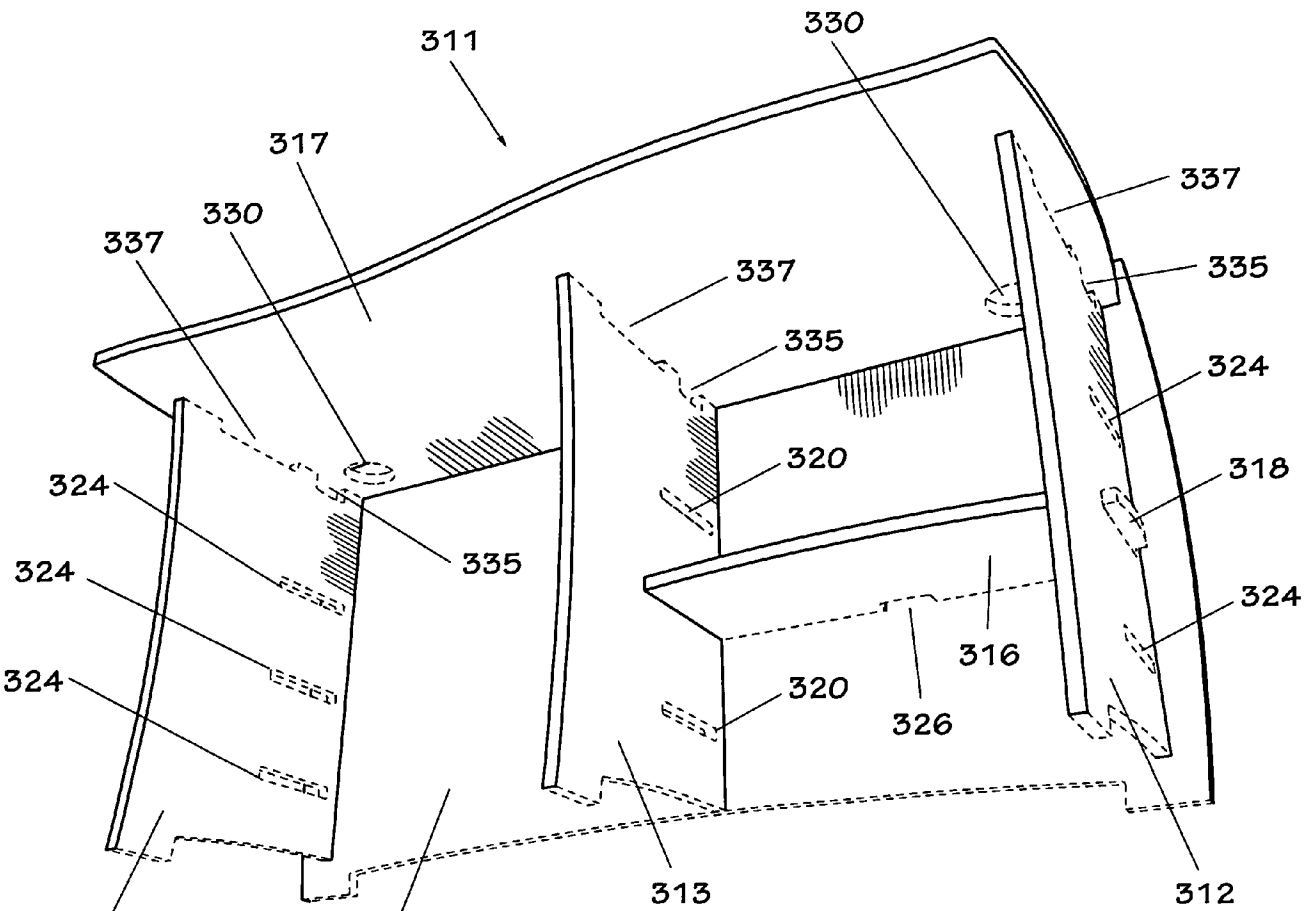
FIG. 18 is a bottom front perspective view of the desk of FIG. 14.
Figure 19:
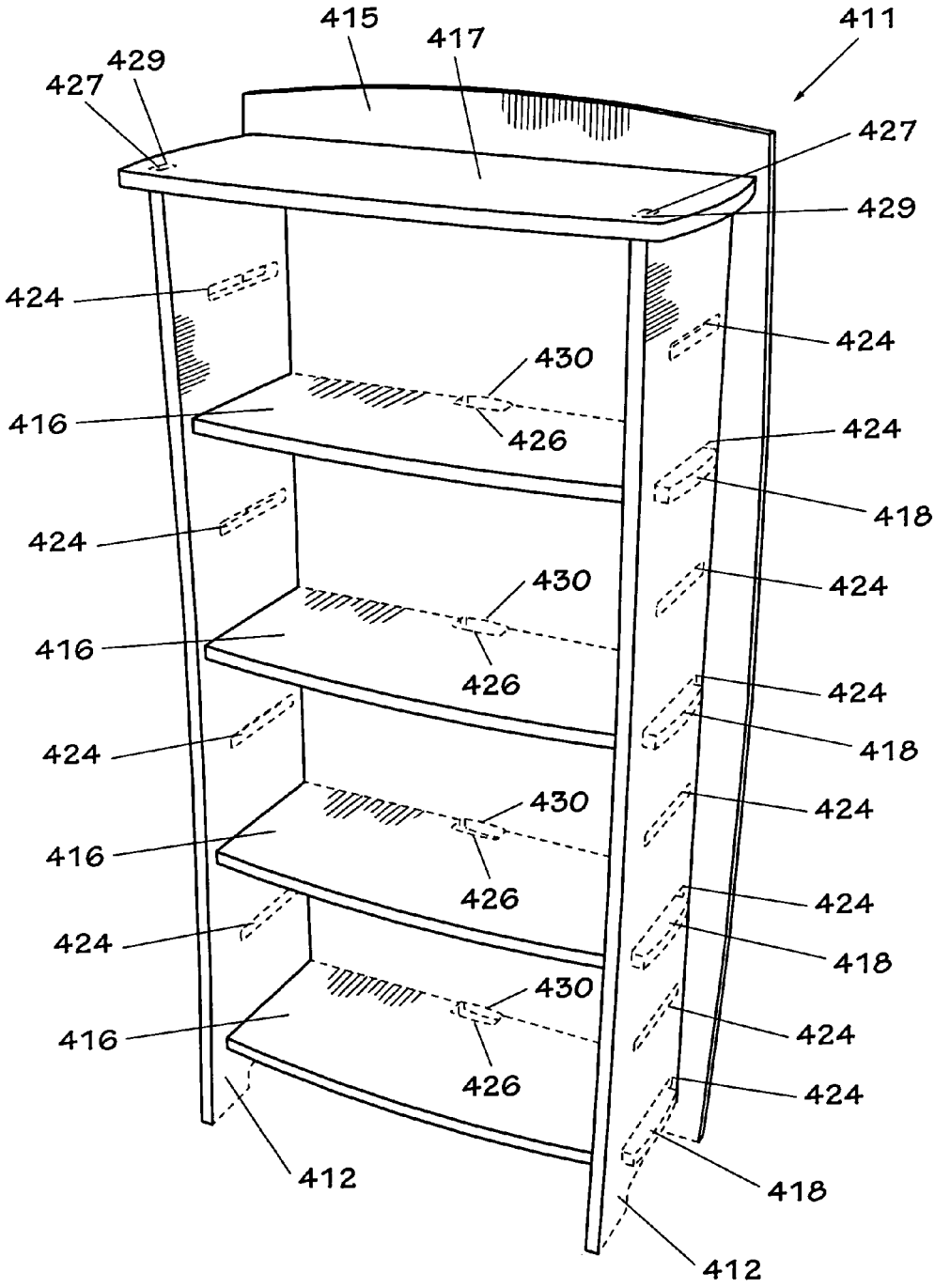
FIG. 19 is a right-side front perspective view of a bookcase according to the present invention.
Figure 20:
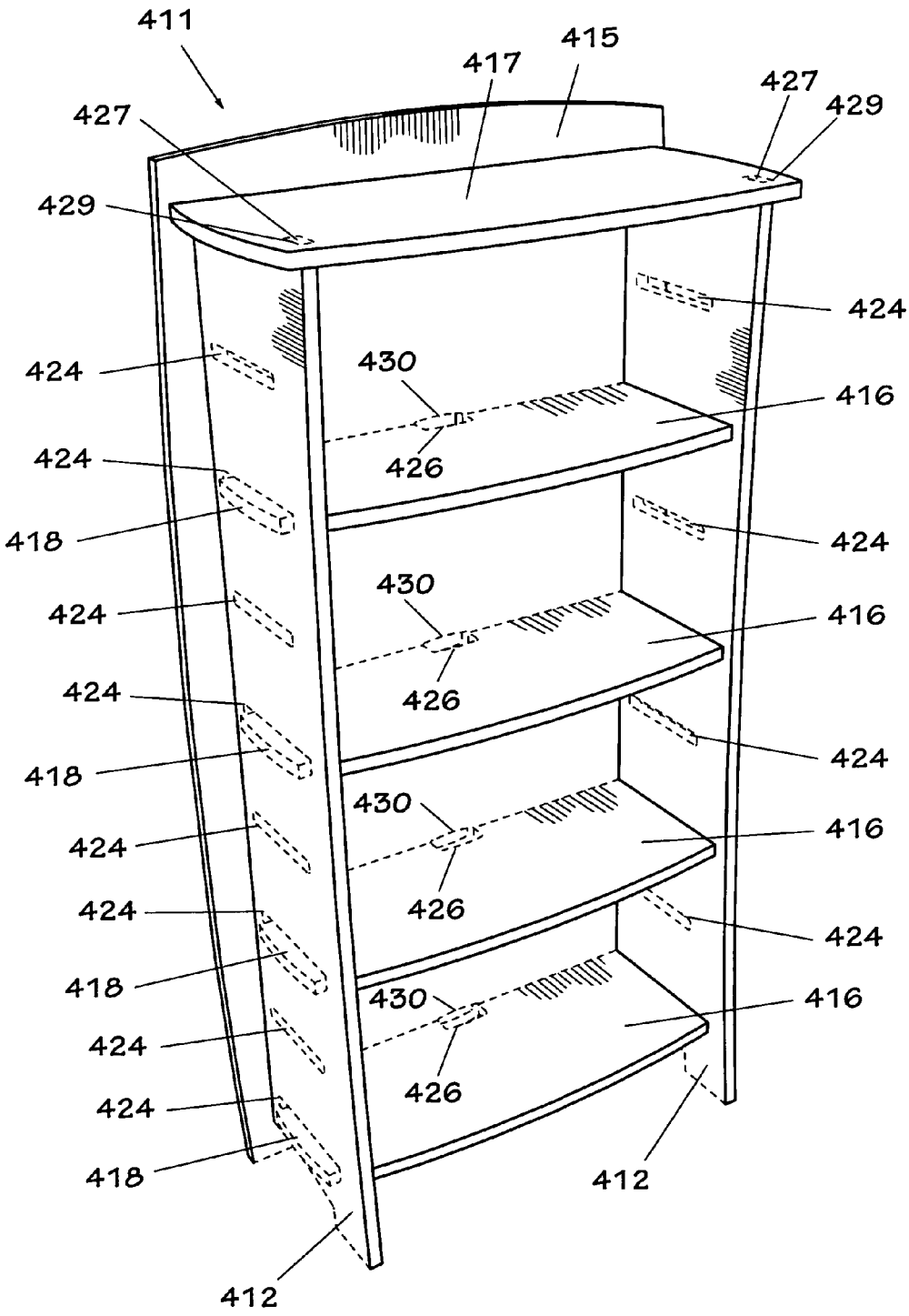
FIG. 20 is a left-side front perspective view of the bookcase of FIG. 19.
Figure 21:
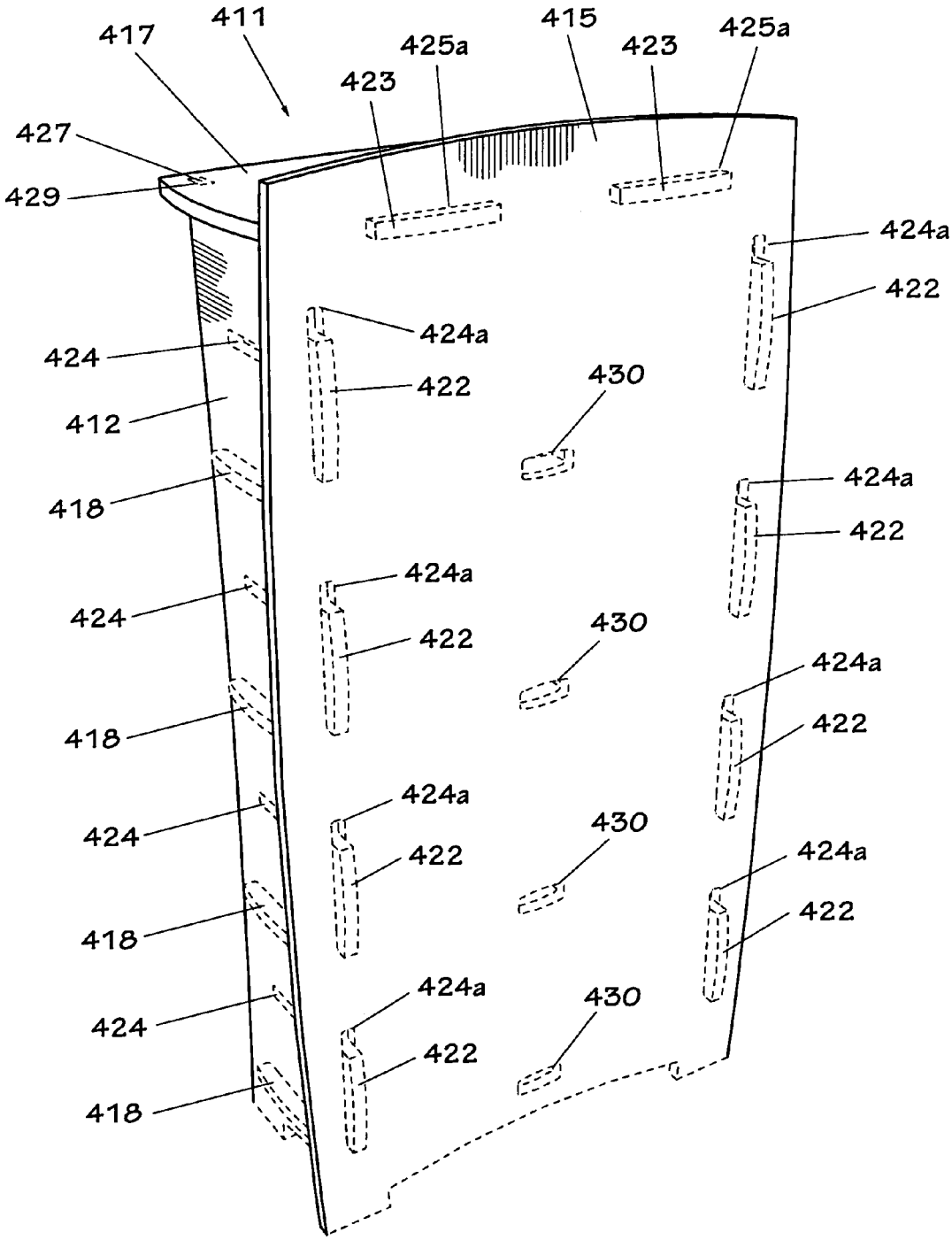
FIG. 21 is a right-side rear perspective view of the bookcase of FIG. 19.
Figure 22:
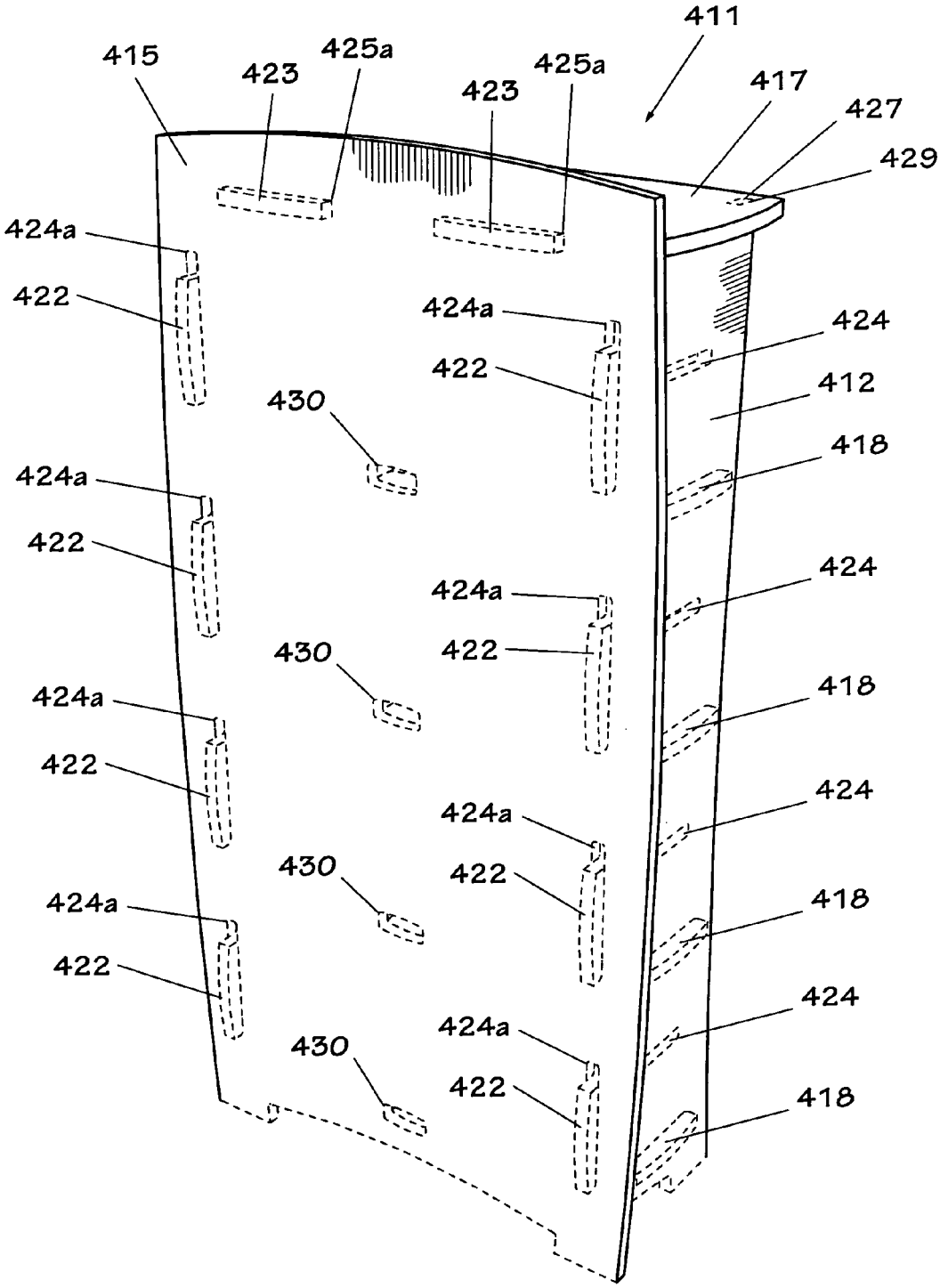
FIG. 22 is a left-side rear perspective view of the bookcase of FIG. 19.
Figure 23:
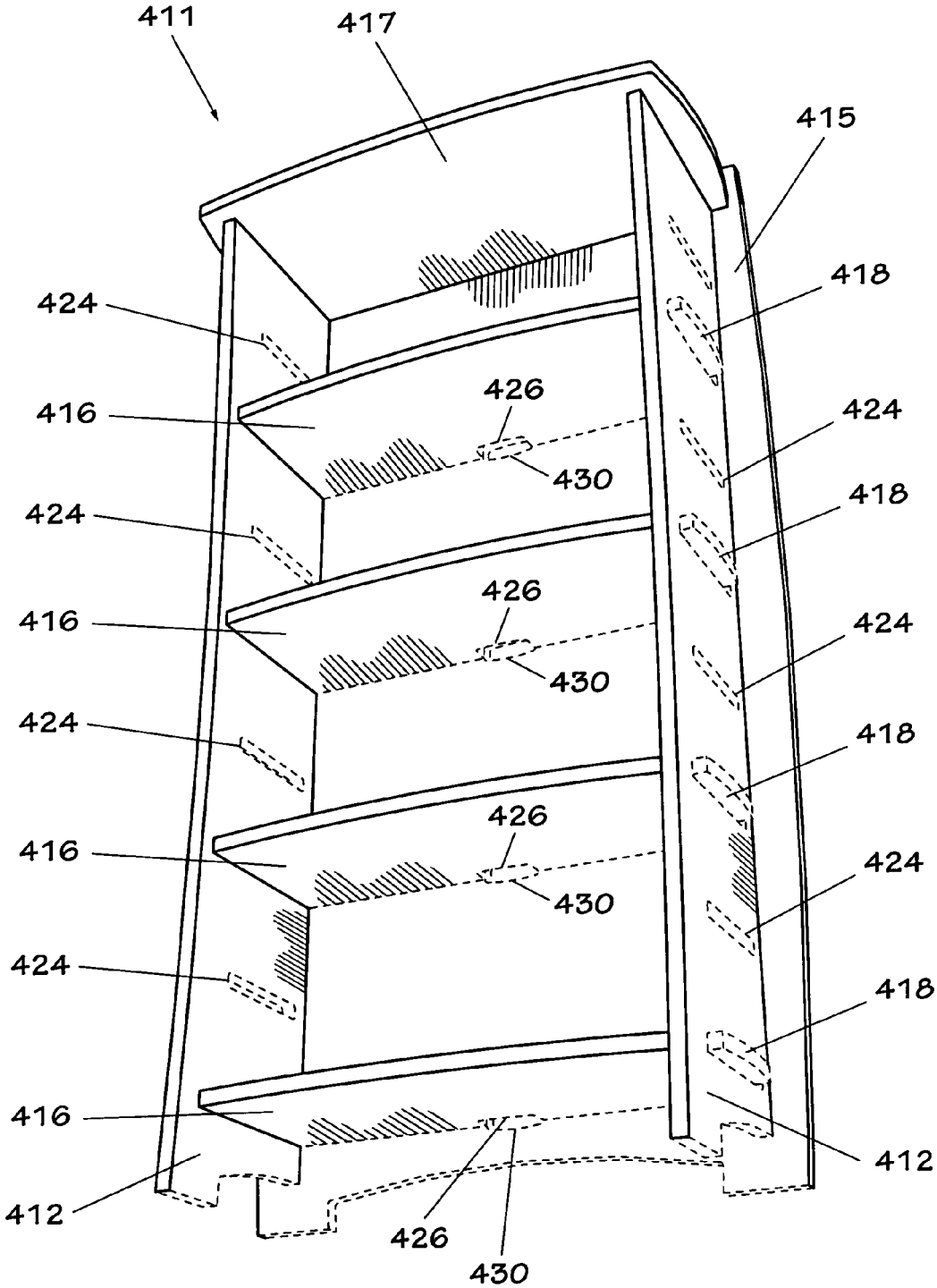
FIG. 23 is a bottom front perspective view of the bookcase of FIG. 19.

Referring to FIG. 1 in the drawings, a desk 11 made in accordance with the modular furniture system of the present invention is illustrated. Desk 11 is an example of the type of furniture that can be assembled with from the interlocking components of the present invention. As explained herein, the modular furniture system of the present invention allows a user to assemble, disassemble, and reconfigure various interchangeable and reversible components into a large variety of pieces of furniture, such as tables, generally rectangular desks, corner desks, desk returns, desk extensions, desk bridges, hutches, bookcases, end tables, and others.

Desk 11 is a corner desk interlockingly assembled from a plurality of wide vertical side supports 12, a plurality of narrow vertical side supports 13, a long vertical rear support 15, a short vertical rear support 10, and a desk work surface 17. Optionally, desk 11 may include a plurality of shelves 16 and a keyboard tray 14. Each wide vertical side support 12 includes a plurality of L-shaped connector tabs 22 which extend rearward and then downward, and a plurality of horizontal slots 24. Each narrow vertical side support 13 includes a plurality of L-shaped connector tabs 19 which extend rearward and then downward, and a plurality of horizontal slots 20. Desk work surface 17 includes a plurality of L-shaped connector tabs 23*a* which extend rearward and then to one side, and a plurality of straight connector tabs 23*b* which extend straight rearward. Each shelf 16 includes an L-shaped connector tab 18. In addition, each shelf 16 includes a notch 26 for the passing through of wires and cables.

Each connector tab 19 of each narrow vertical side support 13 is interlockingly received by a vertical slot 21*a* through long vertical rear support 15 and a vertical slot 21*b* through short vertical rear support 10. Similarly, each connector tab 22 of each wide vertical side support 12 is interlockingly received by a vertical slot 24*a* through long vertical rear support 15 and a vertical slot 24*b* through short vertical rear support 10. Short vertical rear support 10 includes a plurality of L-shaped connector tabs 32 which extend rearward and then downward. Each connector tab 32 of short vertical rear support 10 is interlockingly received by a vertical slot 34 through long vertical rear support 15. Each connector tab 23*a* of desk work surface 17 is interlockingly received by a horizontal slot 25*a* through long vertical rear support 15; and each connector tab 23*b* is slidingly received by a horizontal slot 25*b* through short vertical rear support 10. Each wide vertical side support 12 includes a vertical alignment post 27 which is received by an aperture 29 in desk extension work surface 17.

Desk work surface 17 includes at least one aperture 30 to accommodate wires for computers, phones, and other office-type equipment. Keyboard tray 14 is the only component that may require a fastener or glue. Although not shown in the figures, each narrow vertical side support 13 may include a similar vertical alignment post. Each narrow vertical side support 13 includes at least one notch 35 in the upper edge for passing through wires and cables. Each wide vertical side support 12 includes at least one notch 37 in the upper edge for receiving bowtie coupling components (see FIGS. 38A and 38B) and one notch 39 for passing through wires and cables. The assembly procedure for desk 11 will be discussed in more detail below.

Referring now to FIGS. 5-9 in the drawings, a desk extension 111 made in accordance with the modular furniture system of the present invention is illustrated. Desk extension 111 is interlockingly assembled from a plurality of wide vertical side supports 113, a vertical rear support 115, a desk extension work surface 117, and, optionally, a shelf 116. Each wide vertical side support 113 includes a plurality of L-shaped connector tabs 119 which extend rearward and then downward, and a plurality of horizontal slots 120. Desk extension work surface 117 includes a plurality of L-shaped connector tabs 123 which extend rearward and then to one side. Each shelf 116 includes an L-shaped connector tab 118. In addition, each shelf 116 includes a notch 126 for the passing through of wires and cables.

Each connector tab 119 of each vertical side support 113 is interlockingly received by a vertical slot 121 through vertical rear support 115. Similarly, each connector tab 123 of desk extension work surface 117 is received by a horizontal slot 125 through vertical rear support 115. Each wide vertical side support 113 includes a vertical post 127 which is received by an aperture 129 in desk extension work surface 117. Each wide vertical side support 113 includes at least one notch 137 in the upper edge for receiving bowtie coupling components (see FIGS. 38A and 38B) and one notch 135 for passing through equipment wires and cables.

Referring now to FIGS. 10-13 in the drawings, a desk bridge 211 made in accordance with the modular furniture system of the present invention is illustrated. Desk bridge 211 is interlockingly assembled from a plurality of wide vertical side supports 213, a vertical rear support 215, a desk bridge work surface 217, and, optionally, a shelf 216. Each wide vertical side support 213 includes a plurality of L-shaped connector tabs 219 which extend rearward and then downward, and a plurality of horizontal slots 220. Desk bridge work surface 217 includes a plurality of connector tabs 223 which extend rearward. Each shelf 216 includes an L-shaped connector tab 218. In addition, each shelf 116 includes a notch 226 for the passing through of wires and cables.

Each connector tab 219 of each wide vertical side support 213 is interlockingly received by a vertical slot 221 through vertical rear support 215. Similarly, each connector tab 223 of desk bridge work surface 217 is received by a horizontal slot 225 through vertical rear support 215. Each wide vertical side support 213 includes a vertical post 227 which is received by an aperture 229 in desk bridge work surface 217. Each wide vertical side support 213 includes at least one notch 237 in the upper edge for receiving bowtie coupling components (see FIGS. 38A and 38B), and one notch 235 for passing through equipment wires and cables.

Referring now to FIGS. 14-18 in the drawings, a generally rectangular desk 311 according to the present invention is illustrated. Desk 311 is interlockingly assembled from a plurality of wide vertical side supports 312, a plurality of narrow vertical side supports 313, a vertical rear support 315, and a desk work surface 317. Optionally, desk 311 may include a plurality of shelves 316. Each wide vertical side support 312 includes a plurality of L-shaped connector tabs 322 which extend rearward and then downward, and a plurality of horizontal slots 324. Each narrow vertical side support 313 includes a plurality of L-shaped connector tabs 319 which extend rearward and then downward, and a plurality of horizontal slots 320. Desk work surface 317 includes a plurality of L-shaped connector tabs 323 which extend rearward and then to one side. Each shelf 316 includes an L-shaped connector tab 318. In addition, each shelf 316 includes a notch 326 for the passing through of wires and cables.

Each connector tab 319 of each narrow vertical side support 313 is interlockingly received by a vertical slot 321*a* through vertical rear support 315. Similarly, each connector tab 322 of each wide vertical side support 312 is interlockingly received by a vertical slot 324*a* through vertical rear support 315. Each connector tab 323 of desk work surface 317 is received by a horizontal slot 325*a* through vertical rear support 315. Each wide vertical side support 312 includes a vertical alignment post 327 which is received by an aperture 329 in desk work surface 317.

Desk work surface 317 includes at least one aperture 330 to accommodate wires and cables for computers, phones, and other office-type equipment. Although not shown in the figures, each narrow vertical side support 313 may include a vertical alignment post. Each wide vertical side support 313 includes at least one notch 335 in the upper edge for passing through wires and cables. Each wide vertical side support 312 includes at least one notch 337 in the upper edge for receiving bowtie coupling components (see FIGS. 38A and 38B) and one notch 335 for passing though wires and cables. The assembly procedure for desk 311 is similar to the procedure for desk 11.

Referring now to FIGS. 19-23 in the drawings, a bookcase 411 according to the present invention is illustrated. Bookcase 411 is interlockingly assembled from a plurality of vertical side supports 412, a vertical rear support 415, and a top surface 417. Preferably, bookcase 411 includes a plurality of shelves 416. Each vertical side support 412 includes a plurality of L-shaped connector tabs 422 which extend rearward and then downward, and a plurality of horizontal slots 424. Top surface 417 includes a plurality of connector tabs 423 which extend rearward. Each shelf 416 includes an L-shaped connector tab 418. In addition, each shelf 416 includes a notch 426 for the passing through of wires and cables.

Each connector tab 422 of each vertical side support 412 is interlockingly received by a vertical slot 424*a* through vertical rear support 415. Each connector tab 423 of top surface 417 is received by a horizontal slot 425*a* through vertical rear support 415. Each vertical side support 412 includes a vertical alignment post 427 which is received by an aperture 429 in top surface 417.

Vertical rear support 415 includes at least one aperture 430 to accommodate wires and cables for computers, phones, and other office-type equipment. Although not shown in the figures, each vertical side support 412 may include at least one notch in the upper edge for receiving bowtie coupling components (see FIGS. 38A and 38B) and passing through wires and cables. The assembly procedure for bookcase 411 is similar to the procedure for desk extension 111.

Figure 24:
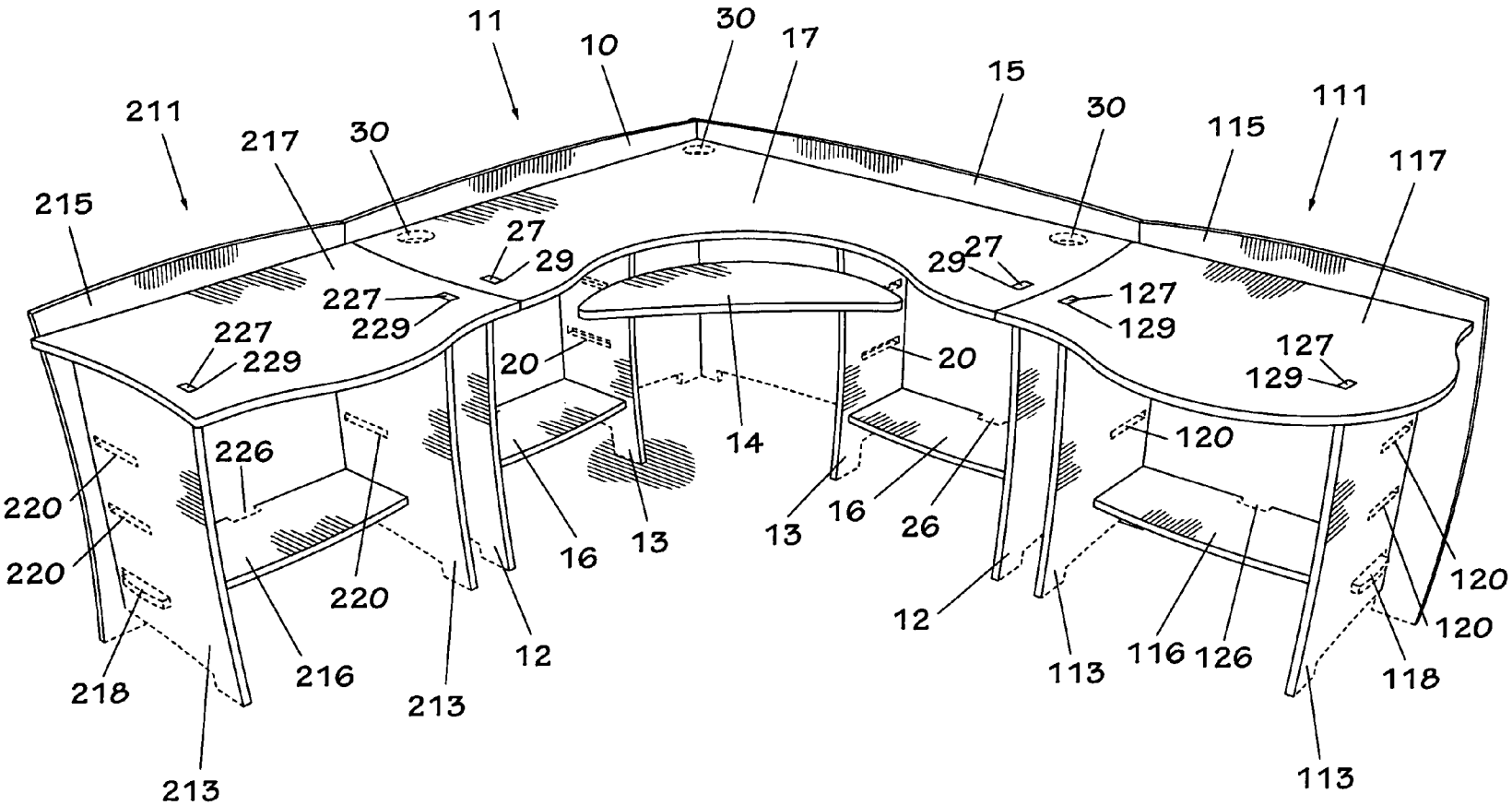
FIG. 24 is a front perspective view of an assembled desk, desk bridge, and desk extension assembled in a right-hand configuration according to the present invention.
Figure 25:
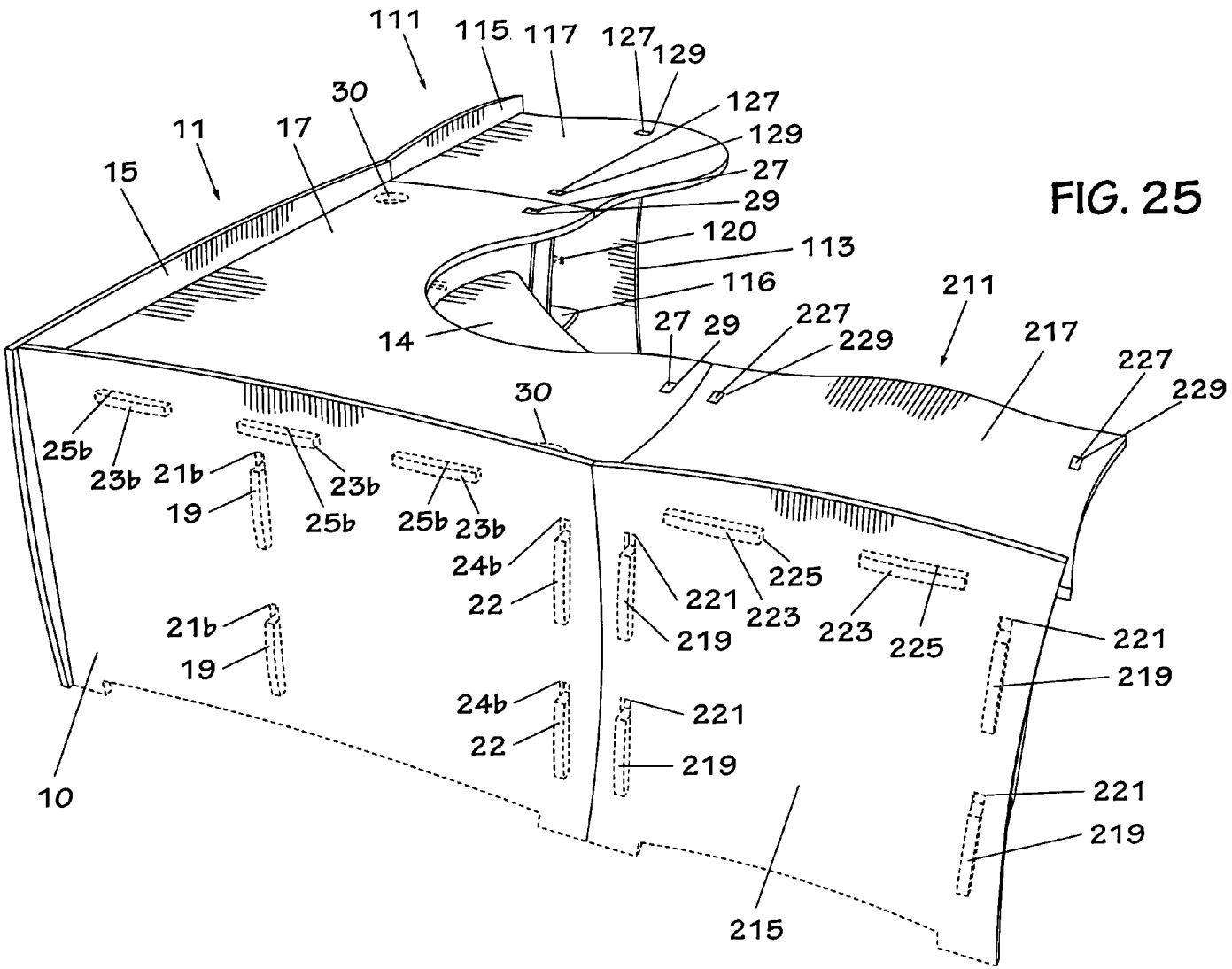
FIG. 25 is left-side rear perspective view of the assembled desk, desk bridge, and desk extension of FIG. 24.
Figure 26:
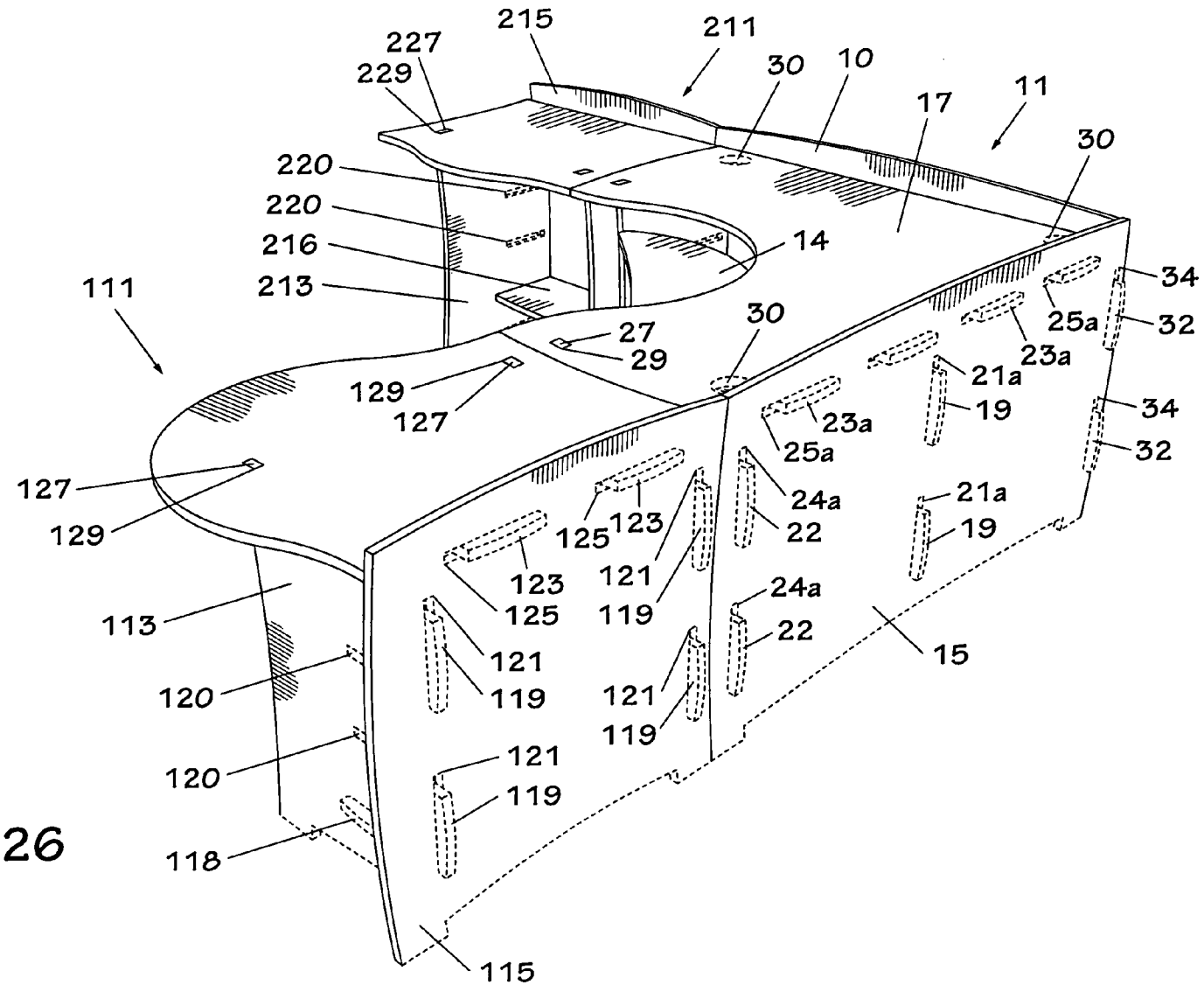
FIG. 26 is a right-side rear perspective view of the assembled desk, desk bridge, and desk extension of FIG. 24.
Figure 27:
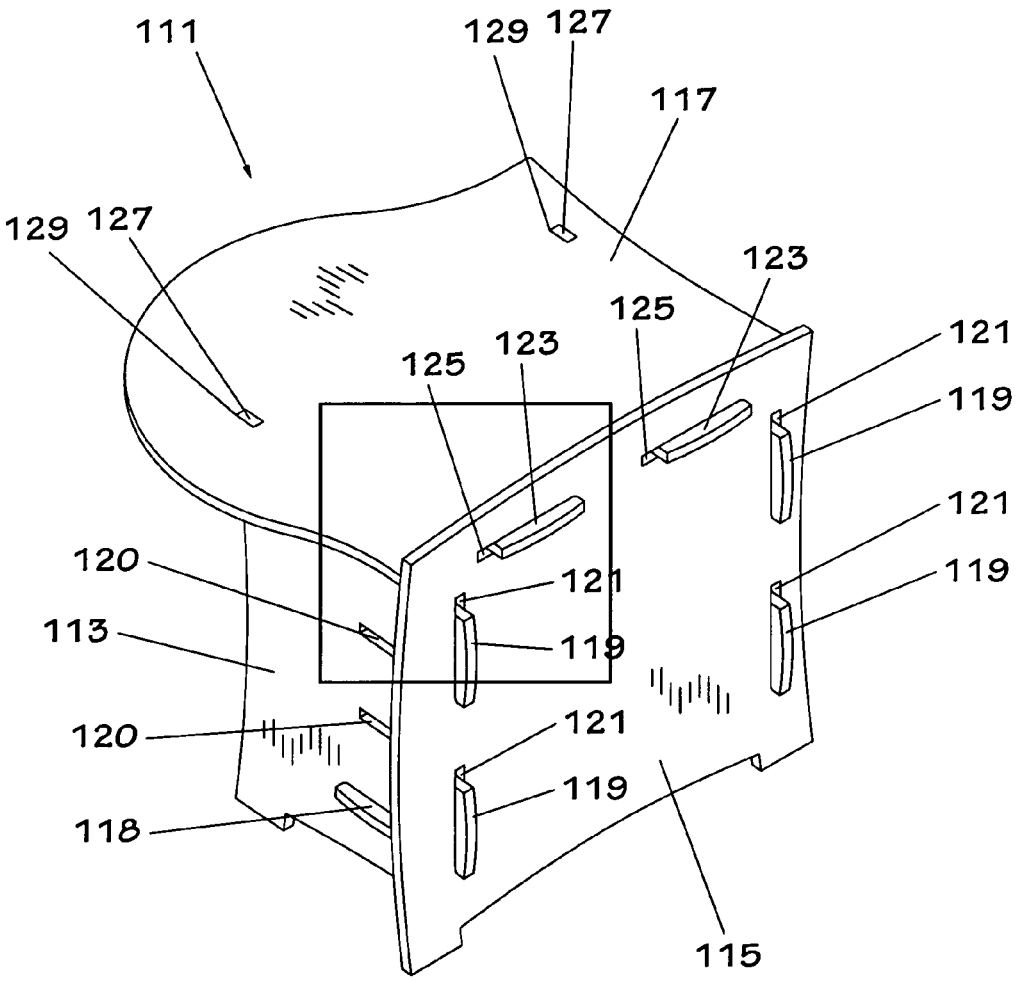
FIGS. 27-36 are perspective views and detailed perspective views illustrating the interlocking assembly of the desk extension of FIGS. 5-9.

Referring now to FIGS. 24-26 in the drawings, desk 11, desk extension 111, and desk bridge 211 have been assembled together according to the method of the present invention. Thus assembled, desk work surface 17, desk extension work surface 117, and desk bridge work surface 217 form a level, continuous work surface. The configuration illustrated in FIGS. 24-26 is considered a "right-hand configuration," as desk extension 111 is interlockingly coupled to the right-hand side of desk 11. It should be understood that the same components could be disassembled, reversed, and reassembled to form a "left-hand configuration" in which desk extension 111 extends to the left-hand side of desk 11. The interlocking coupling of desks 11, desk extensions 111, and desk bridges 211 will be discussed in more detail below with respect to FIGS. 37A, 37B, 38A, 38B, and 39.

Figure 28:
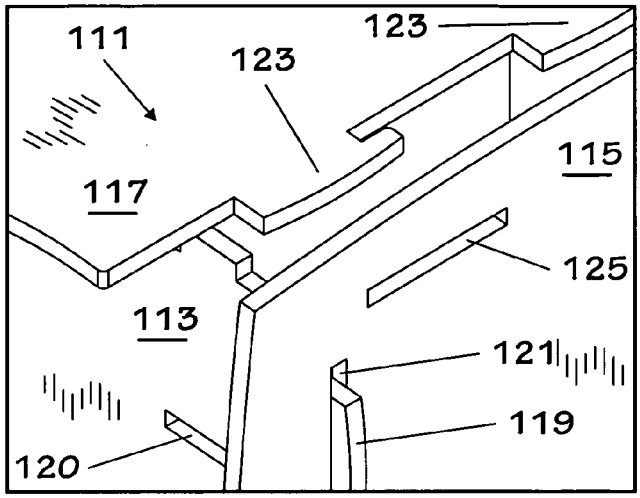
Figure 29:
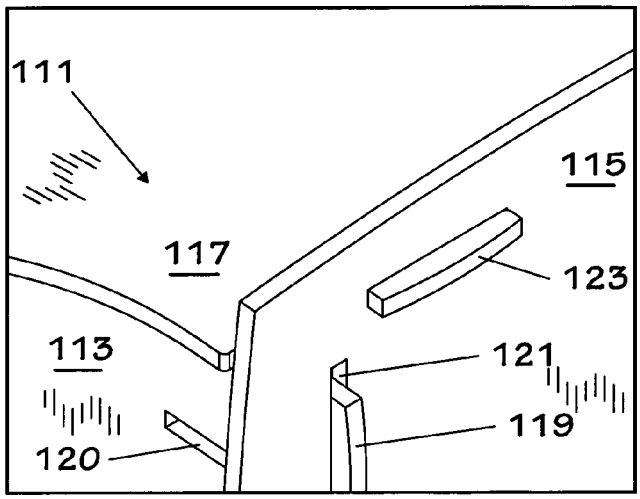
Figure 30:
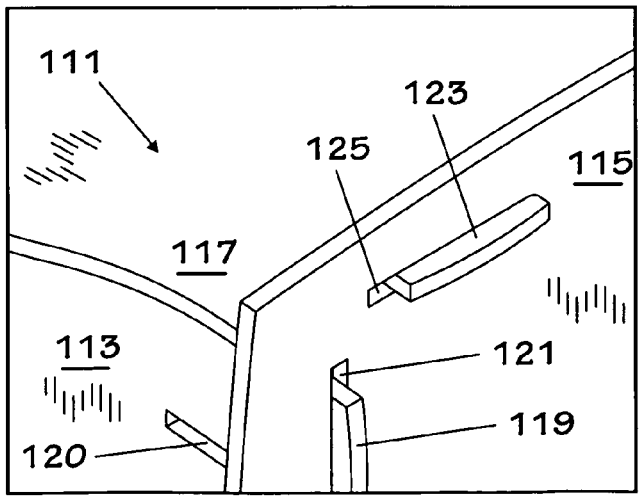
Figure 31:
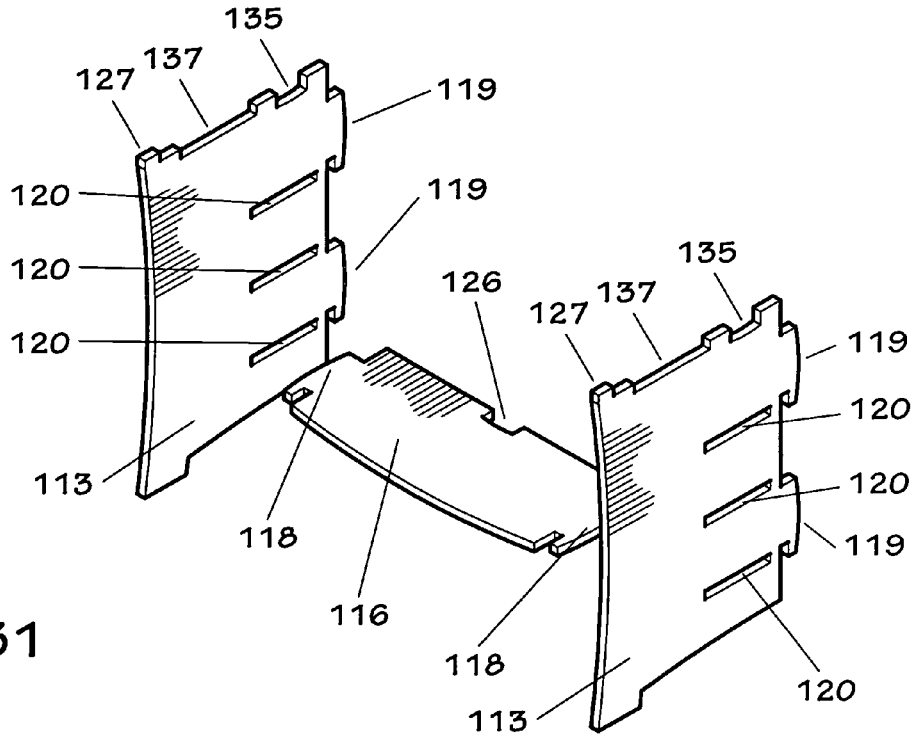
Figure 32:
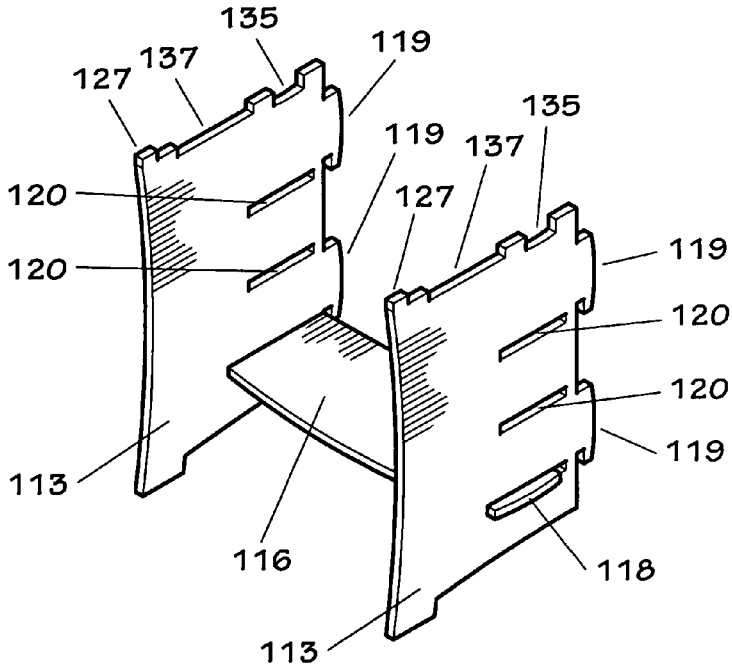
Figure 33:
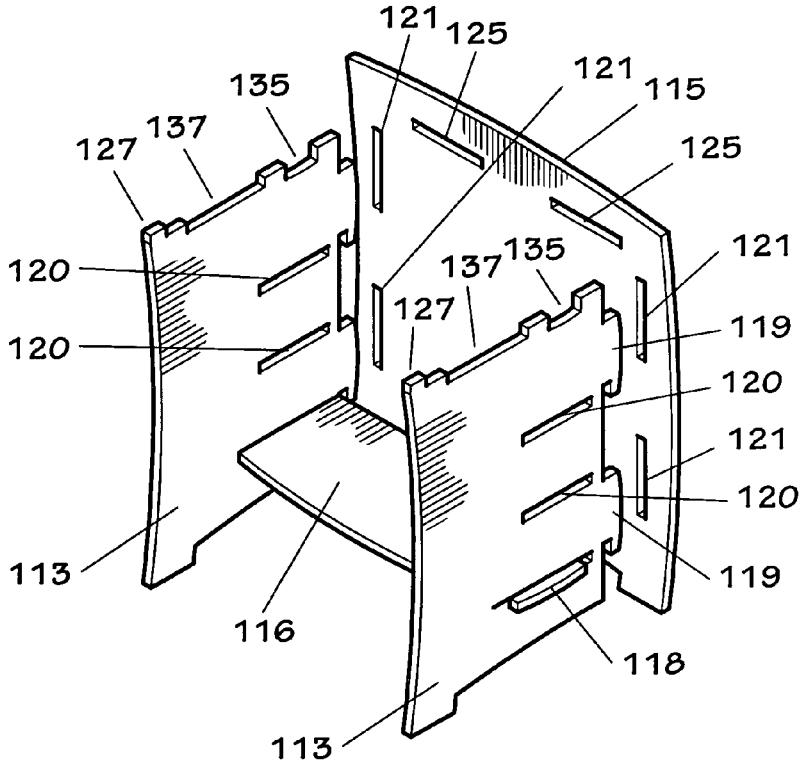
Figure 34:
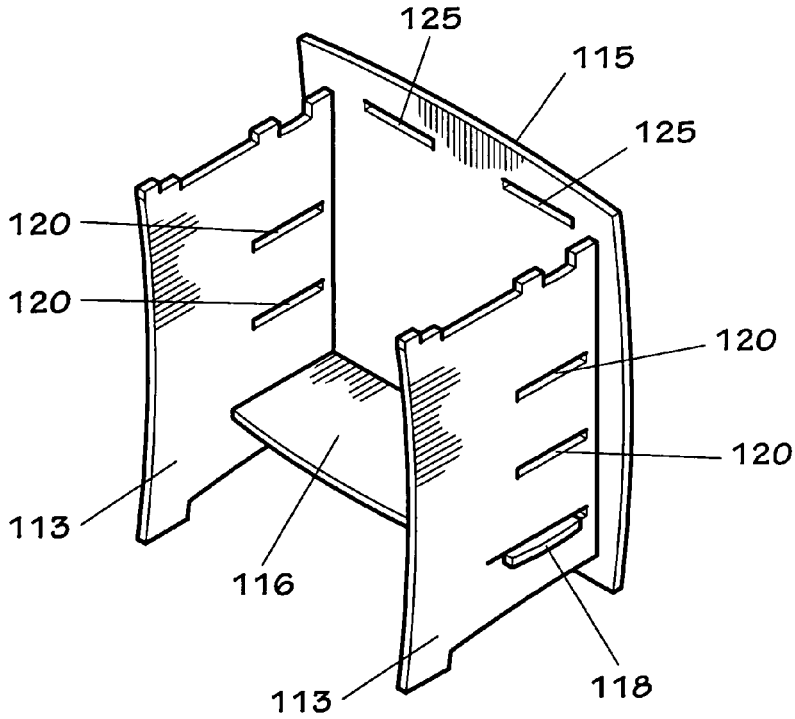
Figure 35:
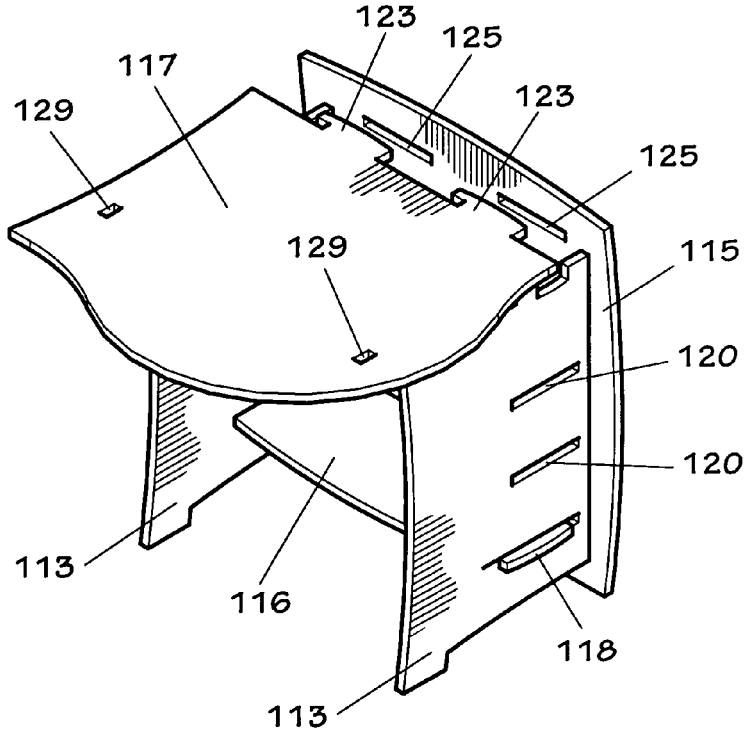

Referring now to FIGS. 27-36 in the drawings, the assembly procedure of desk extension 111 is illustrated. FIGS. 28-30 are enlarged views of the square portion indicated in FIG. 27. First, if optional shelves 116 are desired, shelves 116 are interlockingly coupled between wide vertical side supports 113 by passing connector tabs 118 through horizontal slots 120 and sliding shelf 116 forward. Then, wide vertical side supports 113 are interlockingly coupled to vertical rear support 115 by passing connector tabs 119 through vertical slots 121 and sliding downward. Then, desk extension work surface 117 is interlockingly coupled to vertical rear support 115 by passing connector tabs 123 through horizontal slots 125 and sliding sideways. Desk extension 111 is held together by aligning apertures 129 with vertical posts 127 and lowering desk extension work surface 117 onto vertical side supports 113. It should be understood that a slight clearance between connector tabs and slots is preferable to allow the components to be manually "wiggled" during assembly. However, the interlocking nature of the assembly ensures that the assembled product is sturdy and rigid.

Figure 36:
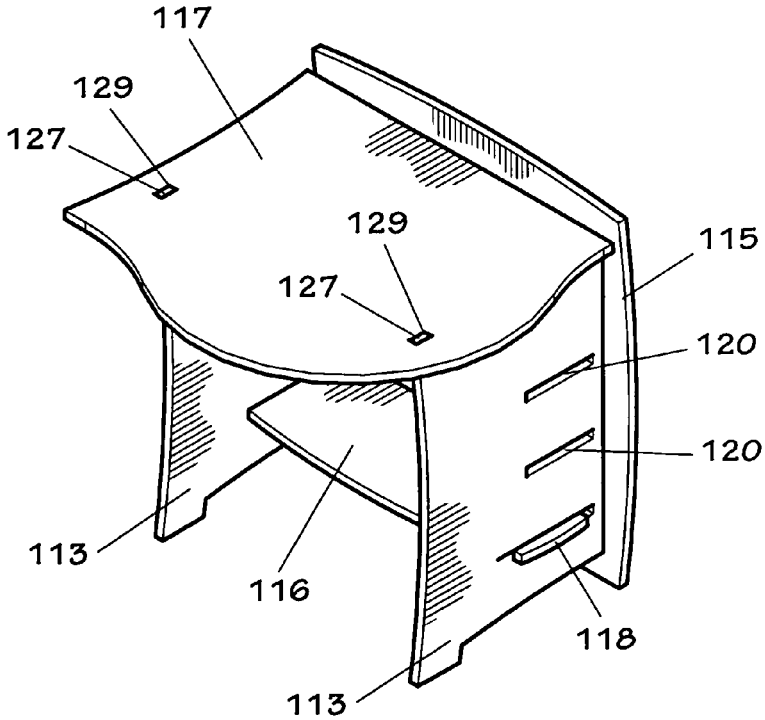
Figure 36C:
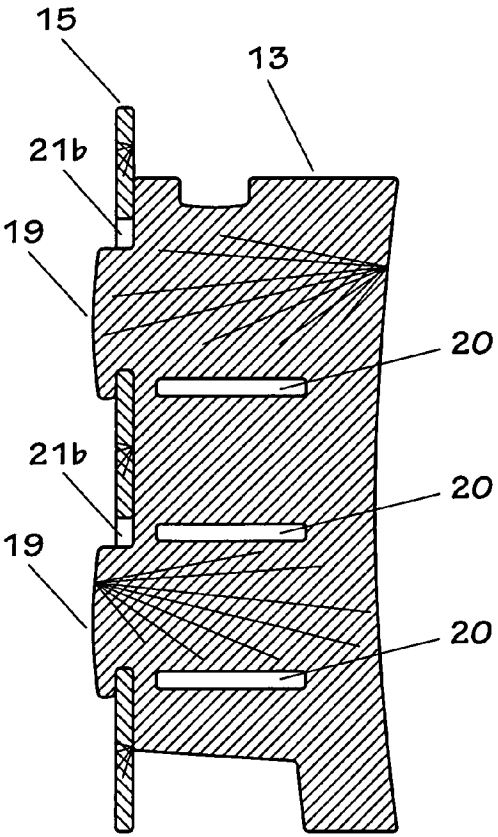
FIGS. 36A-36C are cross-sectional views of the assembly of a narrow vertical side support and a vertical rear support according to the present invention.
Figure 36B:
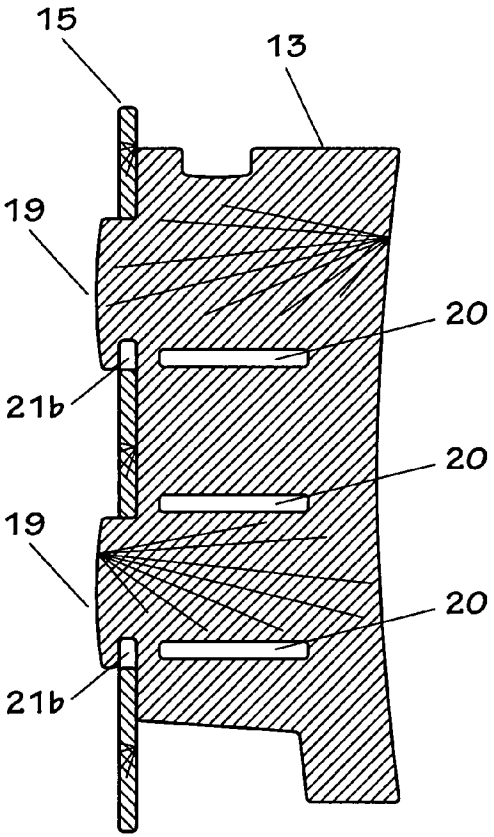
Figure 36A:
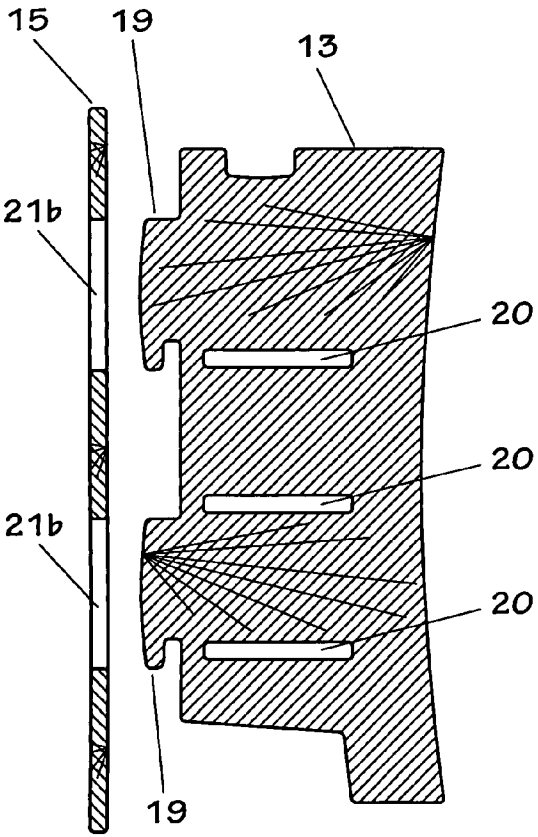

Referring now to FIGS. 36A-36C in the drawings, cross-sectional views of the assembly of narrow vertical side support 13 and long vertical rear support 15 are illustrated. As is shown, L-shaped tabs 19 are configured such that tabs 19 snuggly fit into slots 21*b* when inserted through slots 21*b* in one direction and then translated in a substantially perpendicular direction. This arrangement is similar for all L-shaped connectors and slots. This prevents the components from moving in the direction of original insertion.

Figure 37A:
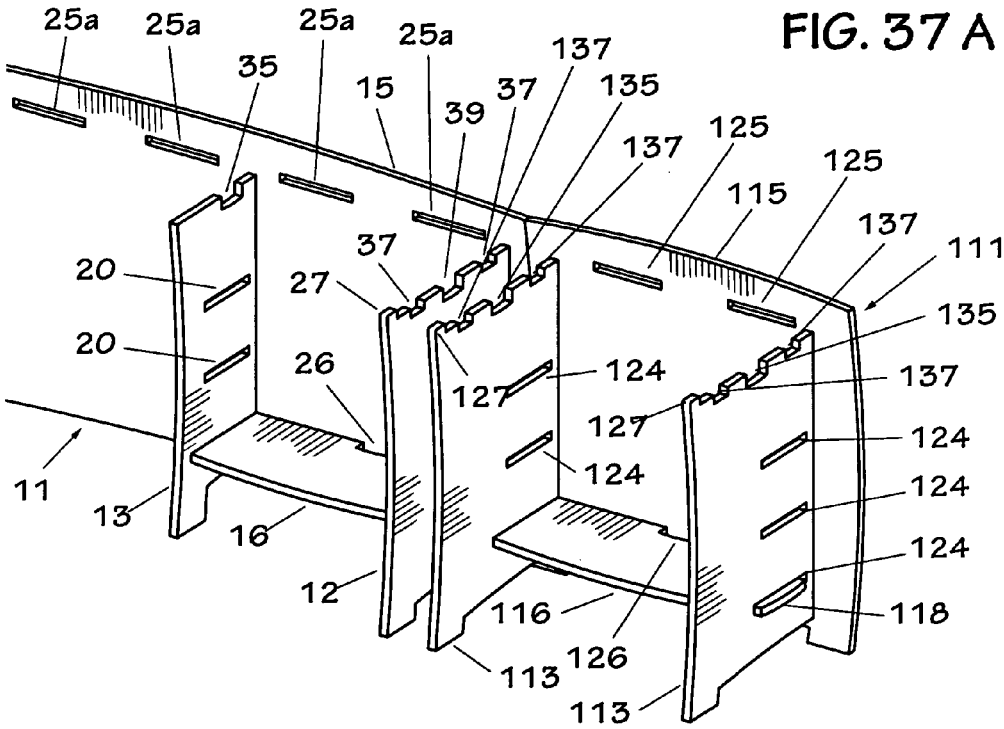
FIGS. 37A, 37B, 38A, 38B, and 39 are perspective views illustrating two embodiments of the interlocking assembly procedure of the desk of FIGS. 1-4 and the desk extension of FIGS. 5-9, one using a single bowtie component and the another using a double bowtie component according to the modular furniture system of the present invention.
Figure 38A:
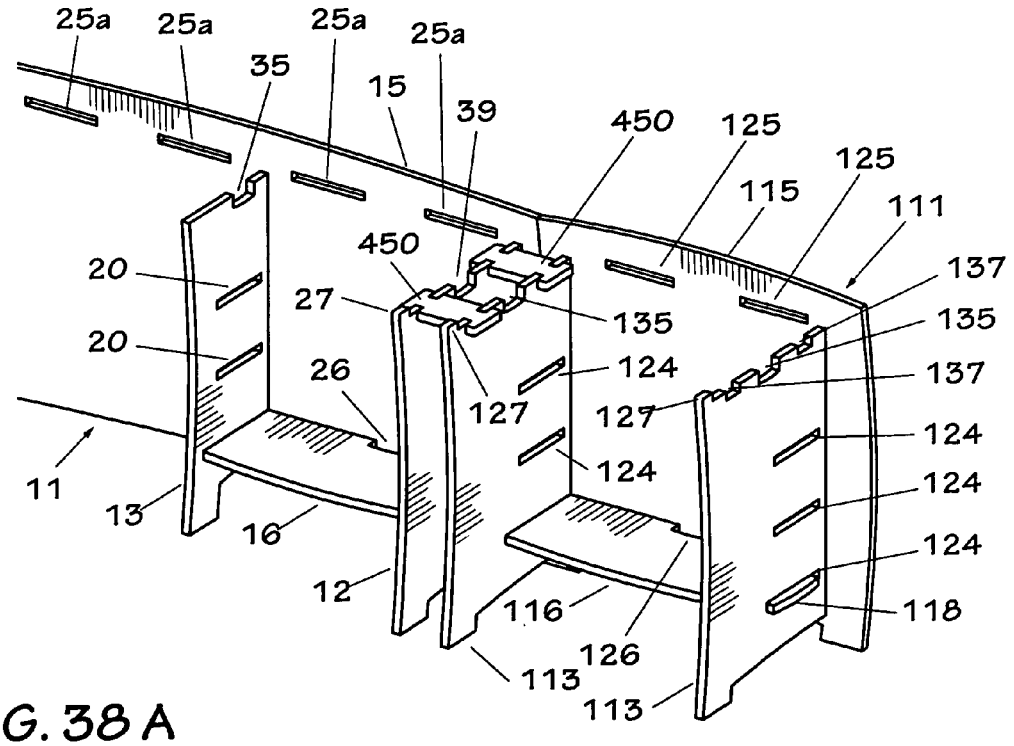
Figure 37B:
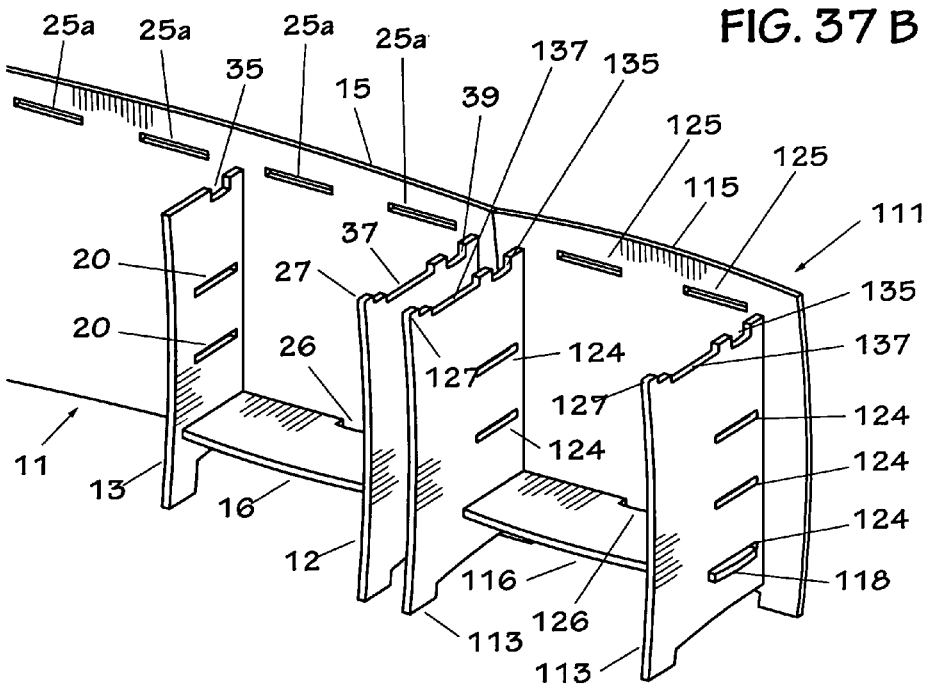
Figure 38B:
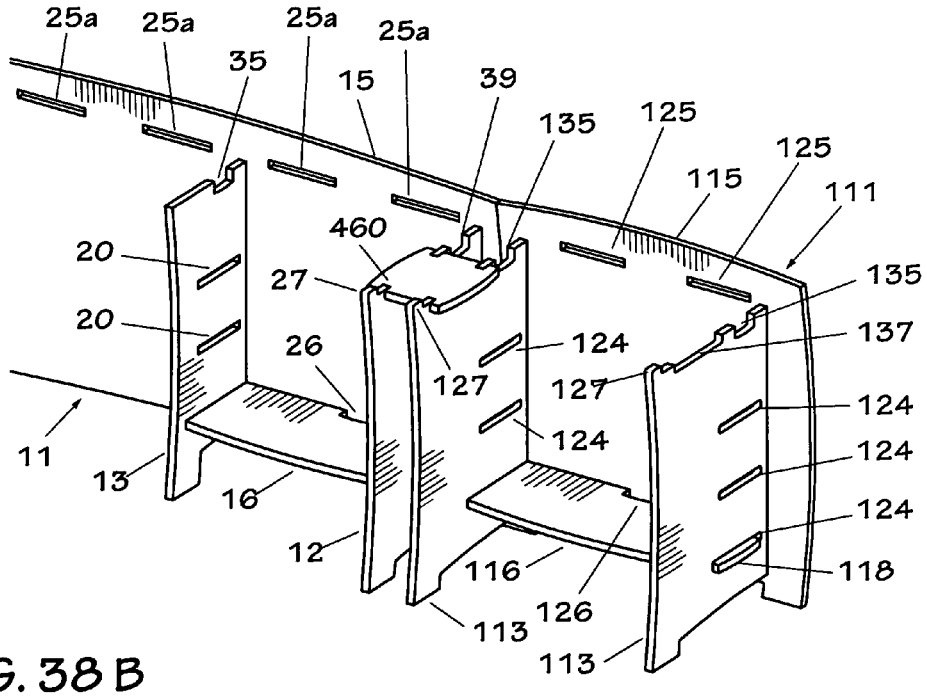
Figure 39:
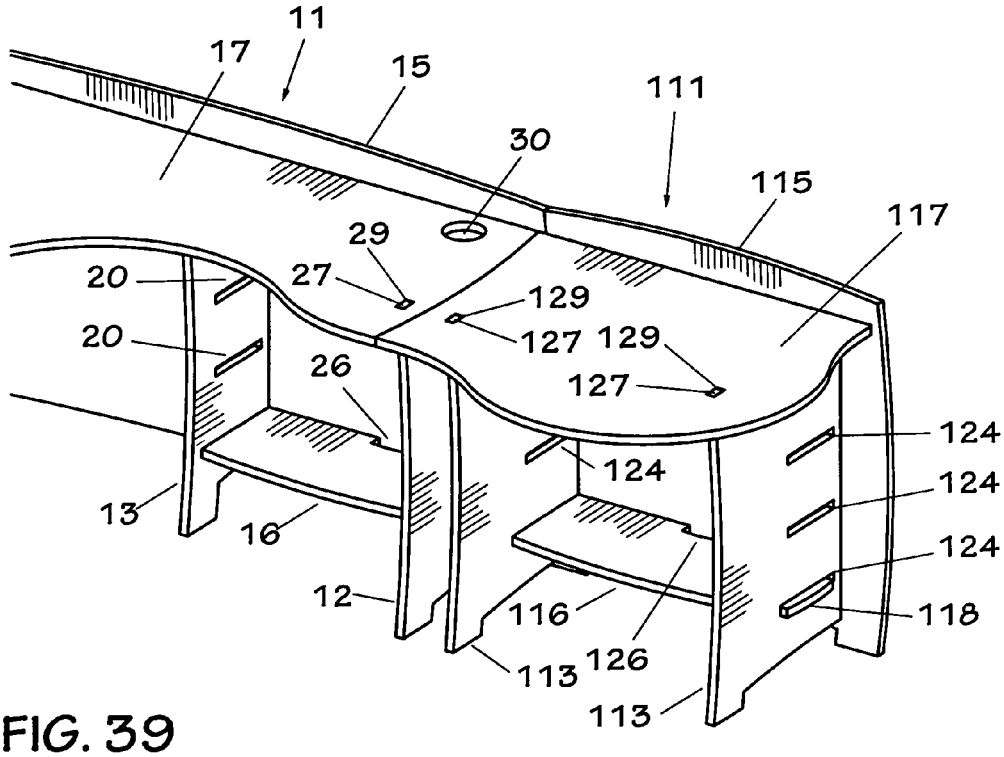
Figure 40:
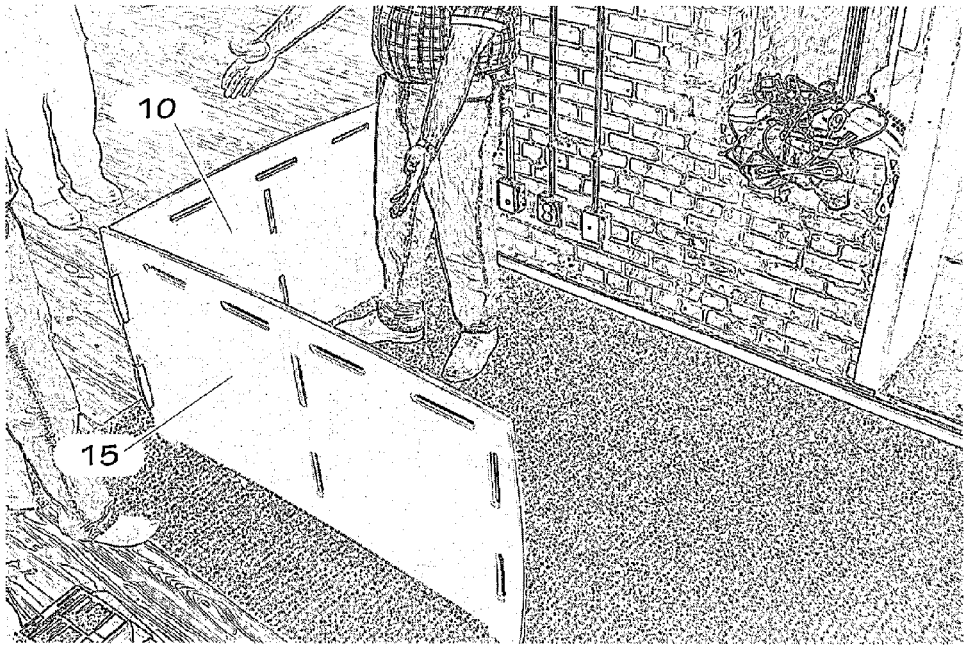
FIGS. 40-46 illustrate the interlocking assembly procedure for assembling a desk and desk extension in a left-hand configuration according to the present invention.
Figure 41:
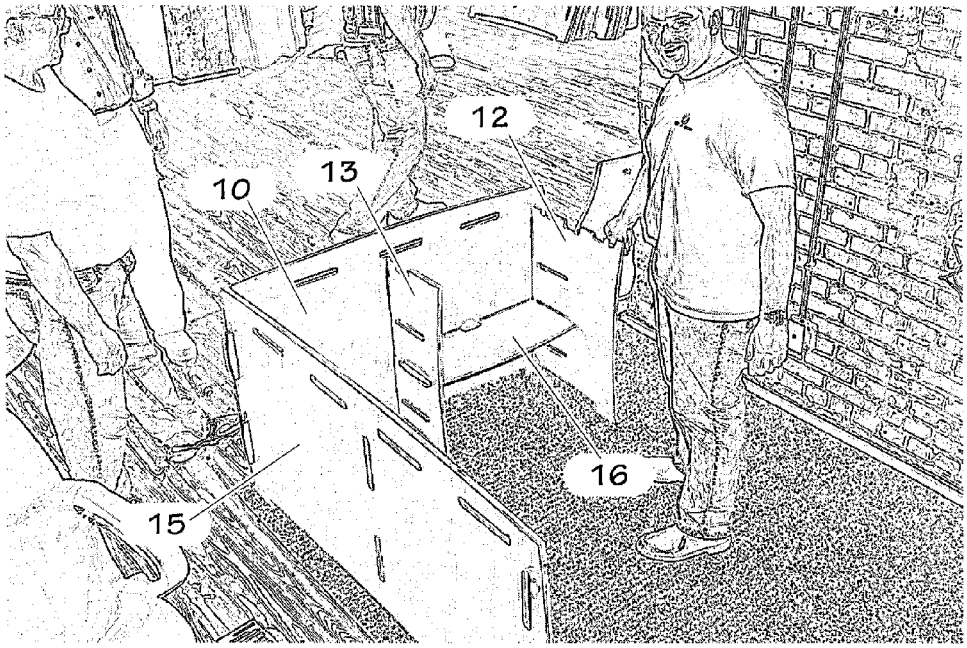
Figure 42:
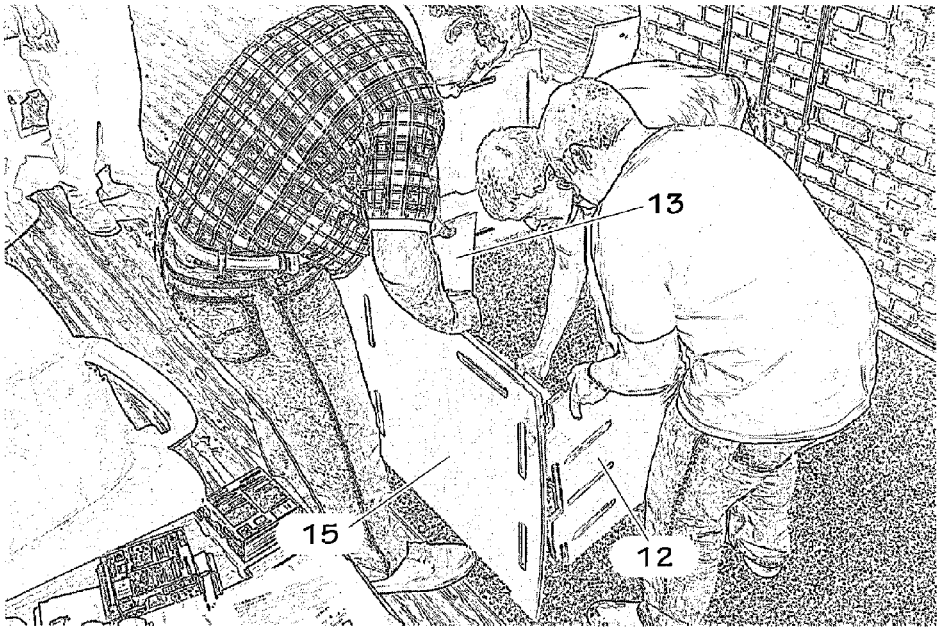
Figure 43:
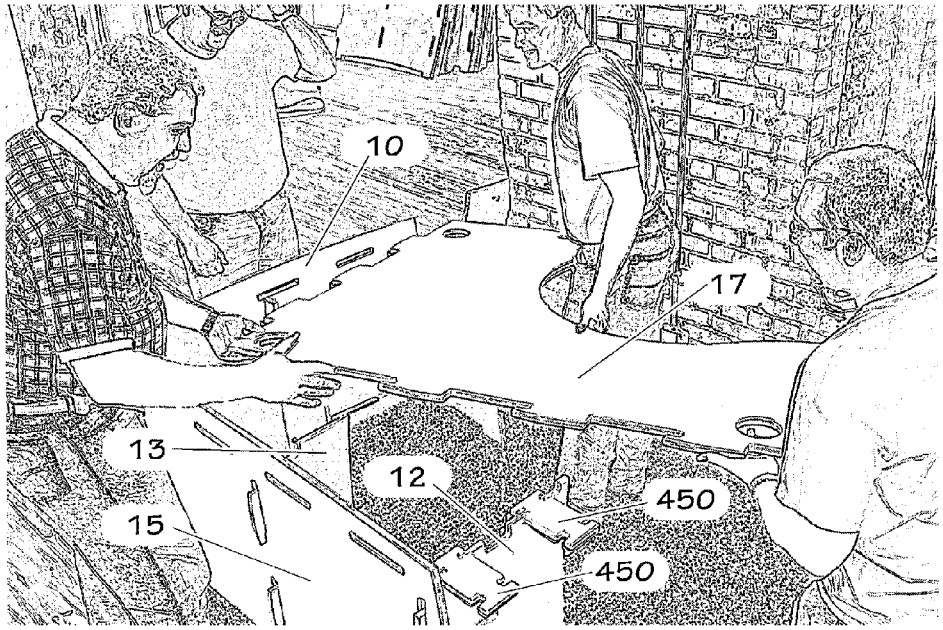
Figure 44:
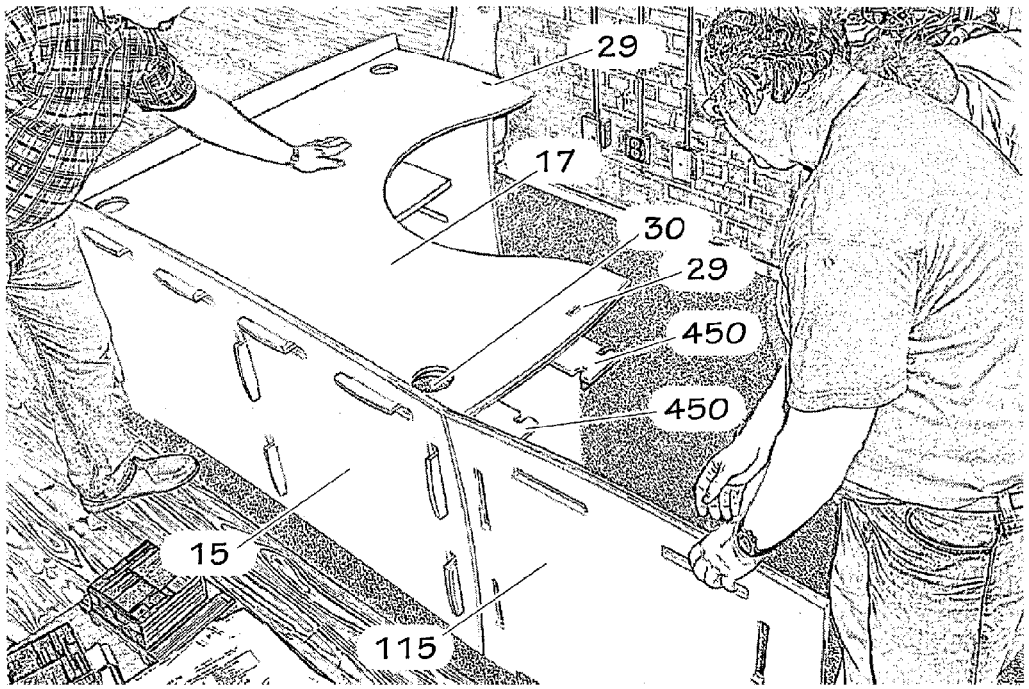
Figure 45:
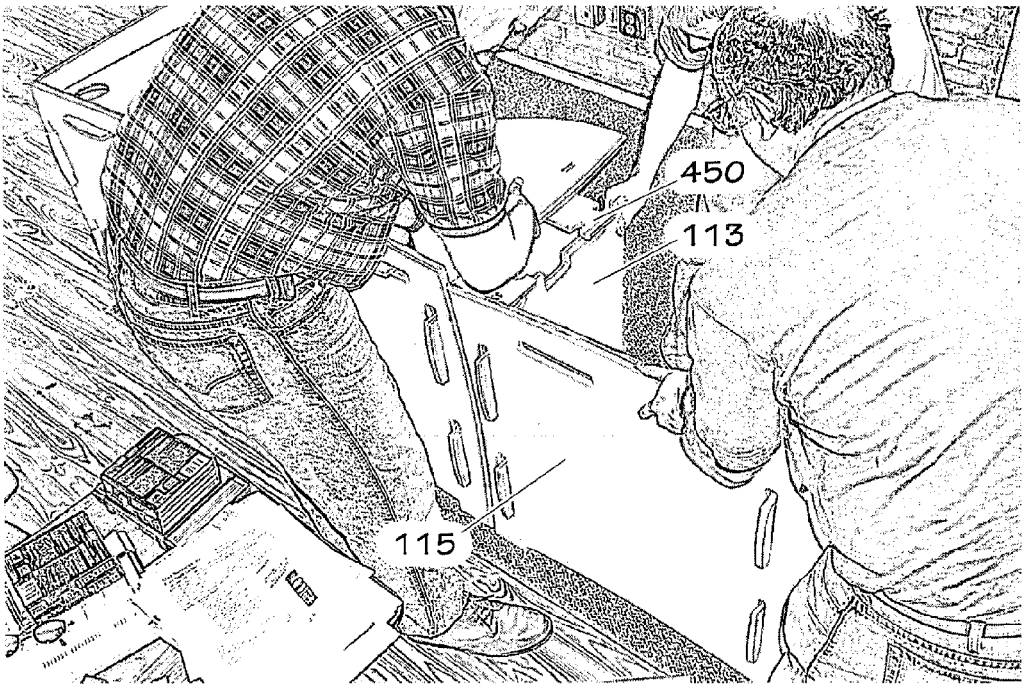
Figure 46:
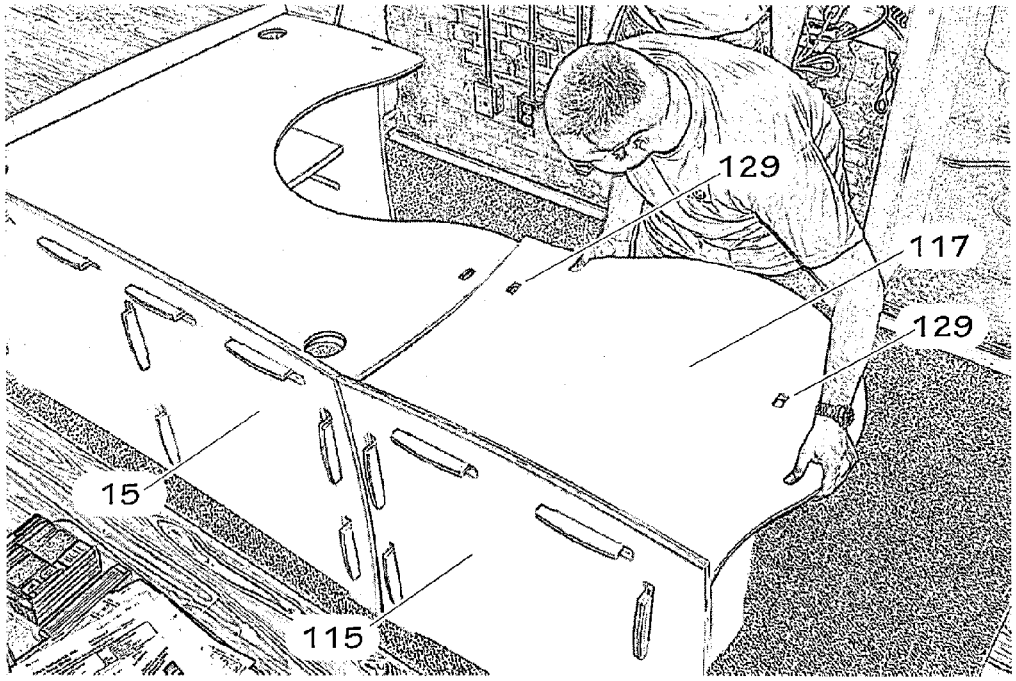
Figure 47:
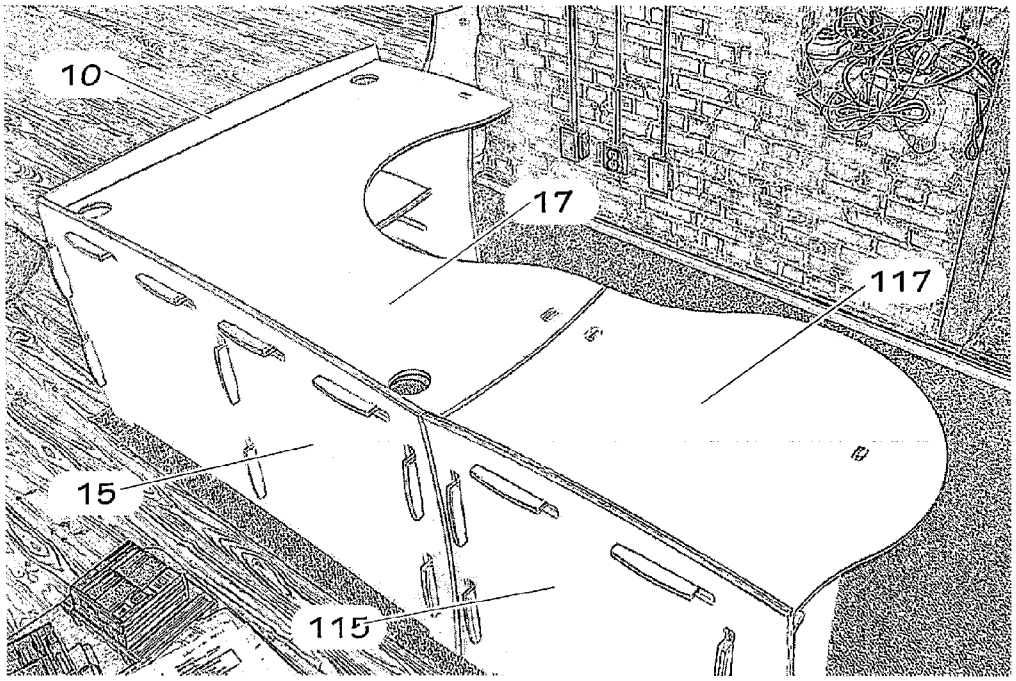
FIGS. 47-50 illustrate the assembled left-hand configured desk and desk extension of FIGS. 40-46.
Figure 48:
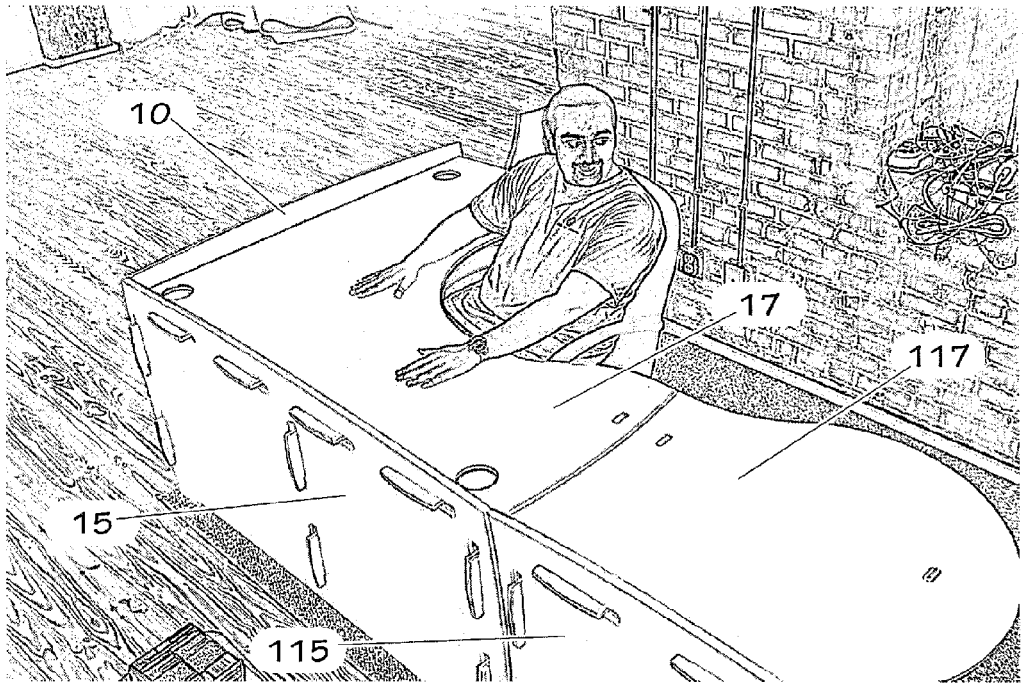
Figure 49:
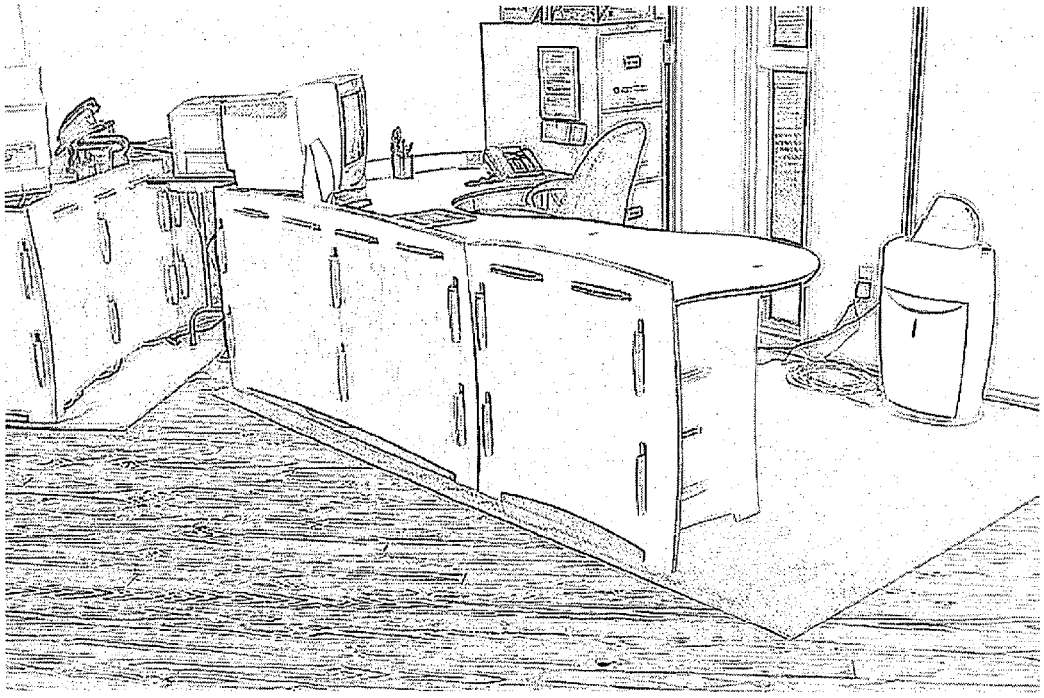
Figure 50:
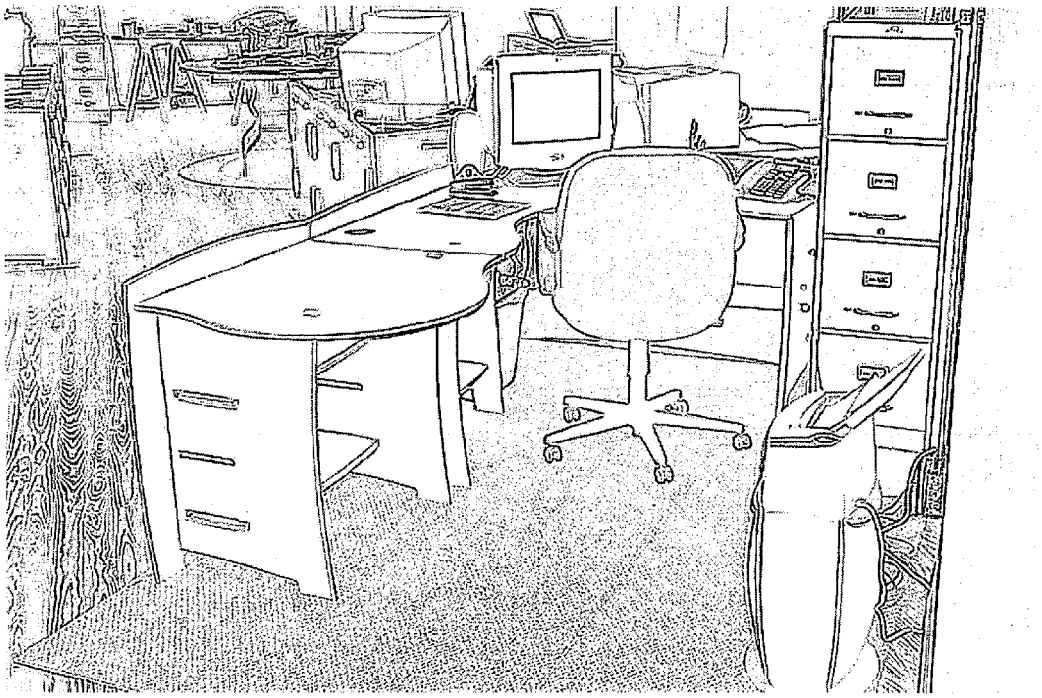

Referring now to FIGS. 37A, 37B, 38A, 38B, and 39 in the drawings, two embodiments of the interlocking assembly procedure of the desk of FIGS. 1-4 and the desk extension of FIGS. 5-9 are illustrated. In FIGS. 37A and 38A, a plurality of bowtie components 450 are interlockingly inserted in notches 37 of desk 11 and notches 335 of desk extension 311. In FIGS. 37B and 38B, a single bowtie component 460 is interlockingly inserted in notches 37 of desk 11 and notches 137 of desk extension 111. As is shown, the notch configuration is slightly different for the single bowtie component. However, in either case, bowtie components 450 or bowtie component 460 are hidden from view by desk work surface 17 and desk extension work surface 117 upon final assembly, as is shown in FIG. 39. Bowtie components 450 and 460 ensure that the assembled modular furniture is rigid and sturdy. Because the single bowtie 460 requires fewer pieces, the single bowtie procedure is the preferred coupling procedure.

Referring now to FIGS. 40-46 in the drawings, the interlocking assembly procedure for assembling a combined desk and desk extension in a left-hand configuration according to the present invention is illustrated. Modules can be assembled without tools. No fasteners or glue is required for assembly. Similar to a Burr puzzle, component pieces are assembled in a predetermined order. As pieces are assembled, a subsequent assembly step secures the pieces of the previous step. The final piece, typically the work surface, becomes the keystone which locks all of the previous pieces together in the final configuration.

First long vertical rear support 15 and short vertical rear support 10 are interconnected. Then, shelves 16 are installed between wide vertical side supports 12 and narrow vertical side supports 13, and coupling wide vertical side supports 12 and narrow vertical side supports 13 to short vertical rear support 10. Also, wide vertical side supports 12 and narrow vertical side supports 13, along with shelves 16 are coupled to long vertical rear support 15. Next, bowtie coupling components 450 or 460 are installed in notches 37. Then, desk work surface 17 is interlockingly installed by aligning vertical posts 27 with apertures 29 and lowering desk work surface 17 onto wide vertical side supports 12 and narrow vertical side supports 13, thereby completing the assembly of the desk module. Vertical posts 27 remain flush with desk work surface 17.

Next, desk extension 111 is assembled by interlockingly coupling the optional shelves 116 between wide vertical side supports 113, and coupling vertical side supports 113 to vertical rear support 115. Then, bowtie components 450 or 460 are connected to notches 137 of desk extension 111. Then, desk extension work surface 117 is interlockingly installed by aligning vertical posts 127 with apertures 129 and lowering desk extension work surface 117 onto vertical side supports 113, thereby completing the assembly of the desk extension module and the combined desk and desk extension unit. Work surfaces use gravity bias to keep modules securely locked together.

On desk 11, the desk work surface 17 may not be tilted up to provide clearance for vertical posts 27 on long and short vertical rear supports 15 and 10, because long and short vertical rear supports 15 and 10 are out-of-plane with one another. This out-of-plane orientation requires that desk work surface 17 be moved in a planar motion only when tabs 23*a* and 23*b* engage slots 25*a* and 25*b* in long and short vertical rear supports 15 and 10. Desk work surface 17 must then be flexed marginally to provide clearance for vertical posts 27 until desk work surface 17 reaches the installed position. At that point, the flexure of desk work surface 17 may be relaxed, allowing vertical posts 27 to protrude into apertures 29, locking desk work surface 17 into place.

Referring now to FIGS. 47-50 in the drawings, the assembled left-hand configured desk and desk extension of FIGS. 40-46 is illustrated. As is shown, office equipment can be arranged in a variety of locations, and the associated wires and cables can be fed through the provided apertures and hidden from sight. This entire assembly procedure can be performed by one person completely without tools, fasteners, or glue of any kind. Disassembly is performed just as quickly and easily by performing the above steps in the reverse order. It should be understood that the modular furniture system of the present invention allows different combinations of furniture to be assembled. All surfaces securely interlock without any hardware, yet are easily released and disassembled by hand.

All component pieces, including work surfaces and vertical supports, are reversible. Because each component is finished on both sides of the planar material from which they are manufactured, many different configurations are possible from the same set of components. This allows the design of asymmetrical modules that may still be used in either left-hand or right-hand configurations. During assembly, the user can choose to make a left-hand or right-hand module by positioning the component pieces in the proper orientation. This allows for maximum versatility by adapting to changing office environments. A user may simply disassemble a module and reassemble it in a different configuration to meet the changing needs. This reversibility simplifies the future design of additional components because a single design can adapt to either left-hand or right-hand configurations of existing components and modules.

Both symmetrical and asymmetrical designs are possible. Asymmetrical designs allow for maximum utilization of raw material. Because all parts are made of the same planar material, it is possible to interlock items of different shapes on the same sheet of raw material to achieve maximum material yield. Asymmetrical designs allow for greater versatility in meeting the needs of various office environments by providing a greater variety of unique configurations than do symmetrical designs.

The modular furniture system of the present invention provides for modular, expandable systems. Individual modules may be securely locked together. Slots provided in vertical supports allow adjacent modules to be interlocked without requiring tools or additional hardware.

For these reasons, the system of the present invention is well suited for small businesses or home office applications, where budgets and space may be limited. In particular, the modular furniture system of the present invention is ideal for contemporary small businesses, such as Internet "start-ups." Who frequently undergo personnel changes and reorganizations, where employees move their cubicles from one area of the office to another.

Figure 51:
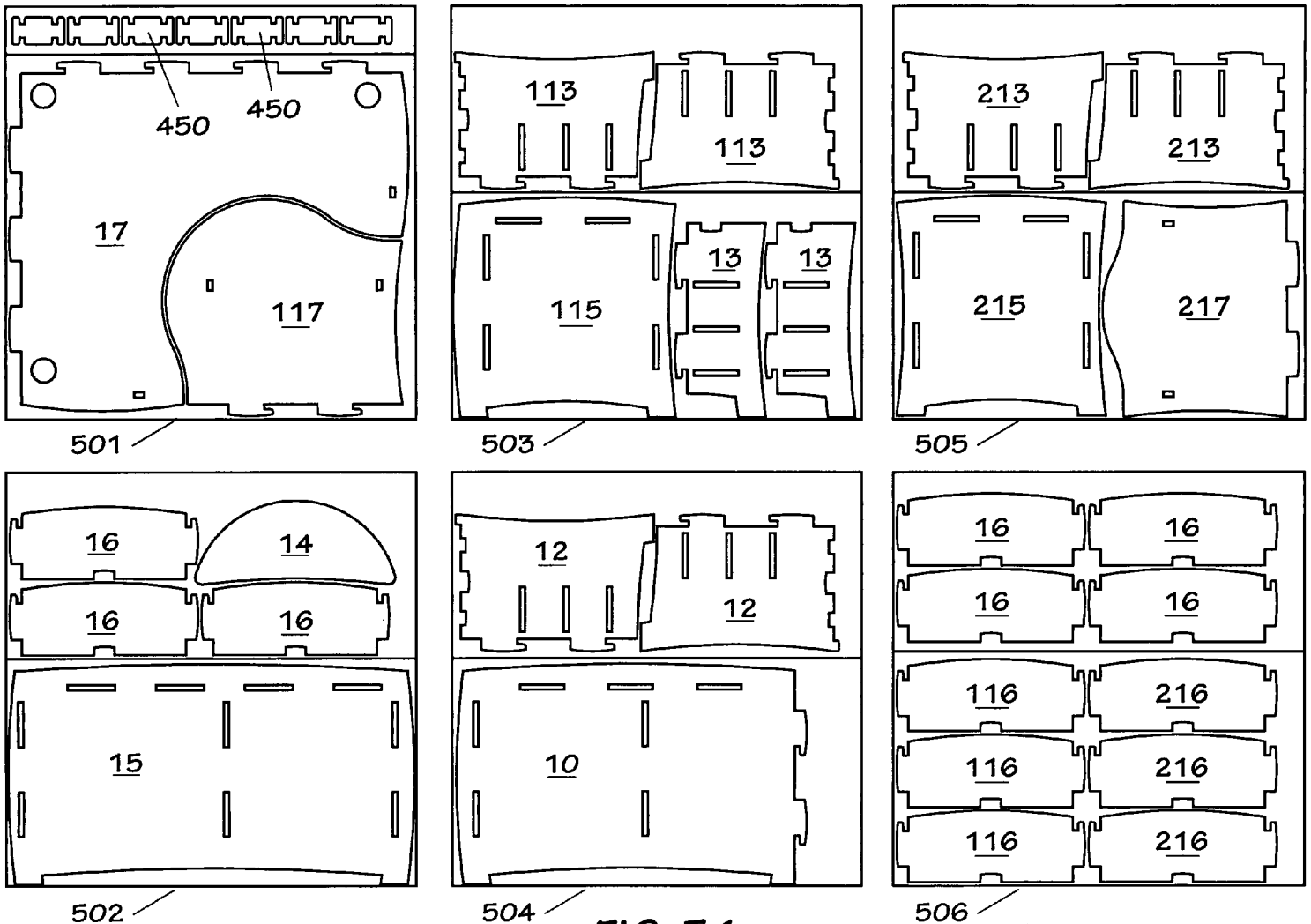
FIG. 51 is a top plan view of layouts of various furniture components on planar pieces of material according to the modular furniture system of the present invention.
Figure 52:
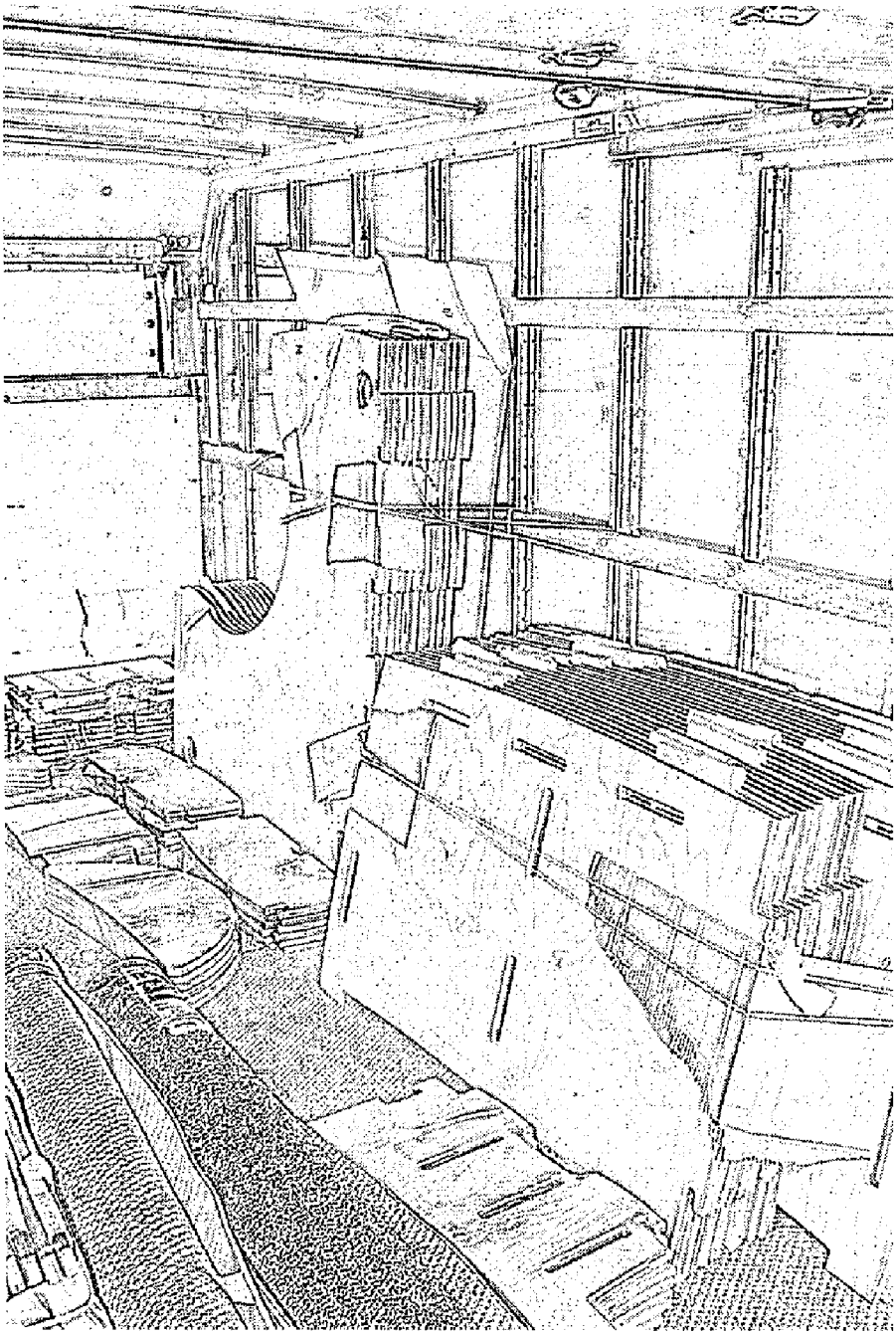
FIGS. 52 and 53 illustrate the stacking and storage capabilities of the modular furniture system of the present invention.
Figure 53:
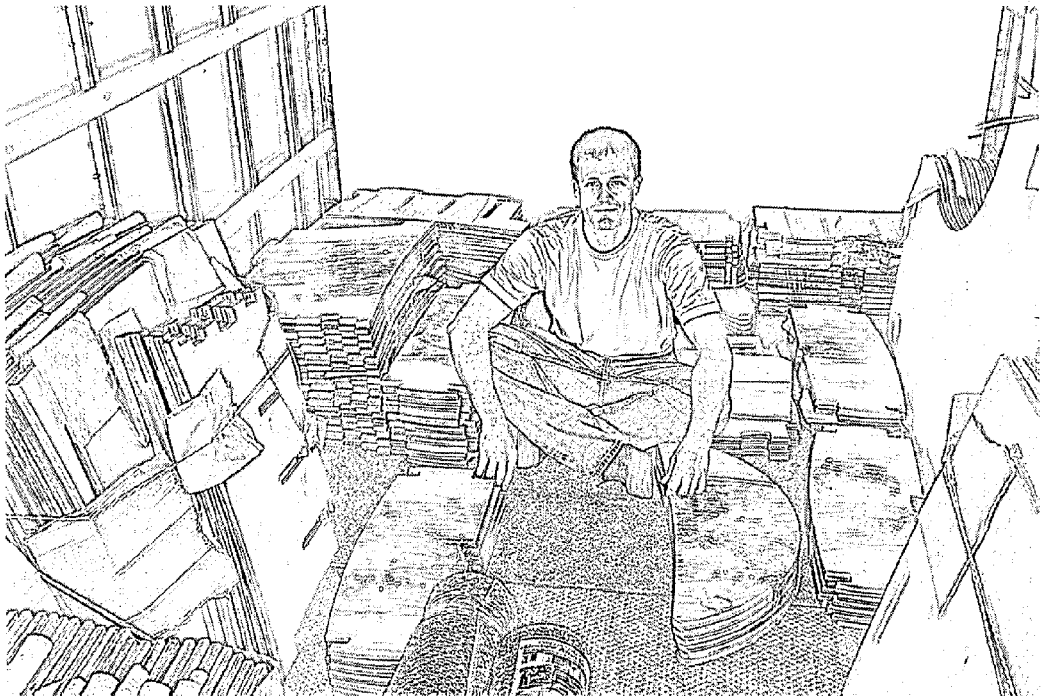

Referring now to FIG. 51 in the drawings, computer numerical control router pattern layouts for all of the required component pieces of desk 11, desk extension 111, and desk bridge 211 on 60-inch by 60-inch material are illustrated. A plurality of planar work pieces 501, 502, 503, 504, 505, and 506 are illustrated. The components of the present invention are preferably fabricated entirely from planar material of uniform thickness. This increases the choices of available and suitable construction materials. In addition, this minimizes the number of different machining processes required for manufacture. All component pieces may be manufactured using the same machining processes. On each work piece, 501, 502, 503, 504, 505, and 506, typical layouts for cutting the components of the present invention are shown. Such layouts ensure that material is efficiently used to manufacture the components of the present invention. This feature has the following advantages: (1) no post-machining assembly is performed, so the amount of material handling and number of required machining operations is minimized, reducing the total cost of manufacture; (2) final components can be produced from raw material in one machining step; (3) the planar design makes machining very suitable to two-axis machining processes such as computer-numerical-control (CNC) routers; (4) flat pieces may be packed and shipped in a flat configuration which minimizes the total size of the shipping package. This packaging allows shipping using normal mail carriers instead of freight carriers (see FIGS. 52 and 53); and (5) flat pieces allow for more compact storage by the user before assembly or after disassembly. It should be understood that other layouts may be used.

An additional set of concerns arises from the variance in the specification of raw materials, variance in manufacturing precision, and tolerances of the finished parts.

Under ideal manufacturing conditions, raw material specifications are exact and manufacturing processes are precise, resulting in ready-to-assemble furniture that assembles easily and yields a secure, solid product for the consumer. In real life, however, raw material specifications cannot be relied upon to be exact or uniform, and manufacturing processes can be imprecise and introduce dimensional variations in manufactured product. These variations in raw material specifications and variations in the precision of manufacturing processes can result in manufactured product that does not meet exact specifications. In these cases, assembly of the product can be difficult, or the assembled product can be less secure and solid than the consumer desires.

The secure-ness of the fit of the assembled product is determined by the fit tolerances in the design of the product. Fit tolerances are introduced in the design to accommodate such things as variations in material thickness and variations in the precision of the manufacturing processes caused by such things as cutter sharpness, machine repeatability, sanding, routing and finishing.

To improve manufacturing yield, loose fit tolerances are typically specified so that less raw material is rejected due to out of specification thicknesses, and so that fewer manufactured parts are rejected due to variations in the precision of the manufacturing processes. Loose fit tolerances specify product dimensions that will accommodate raw material at its greatest acceptable thickness, and accommodate the greatest acceptable variations in manufacturing precision. However, under any conditions other than these extreme conditions, loose fit tolerances can result in joints that are loose and an assembled product that is less than secure.

While an obvious solution would be to reduce the allowable tolerances, it is not practical to do so because it will tend to result in higher costs due to lower raw material yield and part rejection due to out-of-tolerance specifications. It is nearly always beneficial to design the greatest possible loose fit tolerances to maximize yield and minimize costs. For these reasons, it is desired that a joint design be tolerant of wide variations in specifications. In addition, a given tolerance will have less of an impact on the overall secure-ness of a large product and more of an effect on a small product because of the ratio of the tolerance dimensions to the overall product dimensions. A joint design that is tolerant of wide variations in specifications will therefore lessen the effect of loose fit tolerances in small product designs.

Several new and improved joint designs utilizing an L-shaped tab and slot are discussed. The goal of each design is to reduce or eliminate the amount of slack present in the existing joint design when material variations and variations in manufacturing precision yield less than secure joints that are manufactured to a particular joint specification.

There are two basic methods to make a joint more secure. The first method is to create an interference fit so that the two joining panels interfere with one another to make a secure connection, relying on the elasticity and compressibility of the material to relax the interference enough that it can be overcome by human force, allowing the joint to be fully assembled. The second method is to create flexure in or around the joint, where the flexure of the material produces a force that urges the panels in directions that will tighten the joint and make a more secure connection. Considering this, certain joint designs are more appropriate for some materials than for others.

An interference fit works sufficiently well for materials that exhibit some degree of elasticity and compressibility. This is because these materials are softer and relax under compression, or have elasticity that allows the interference to be overcome with a reasonable amount of assembly force. For example, plywood constructed from Poplar plies is soft and compresses easily, so an interference fit is well suited for this material. Plywood constructed from Birch plies is harder and less compressible, so an interference fit is less suited to this material unless parameters of the joint design are such that the interference can be overcome with a reasonable level of effort. The joint design can be altered to properly accommodate various materials, designing into the joint the level of assembly force required to fully assemble the joint. Controlling the amount of interference between joint panels to dictate the required assembly force does this. A small amount of interference may be all that is required to produce a secure fit while only requiring a minimal assembly force. By enlarging the amount of interference, the fit may be made more secure, but at the expense of a greater required assembly force.

A flexure fit is best suited to hard materials that exhibit some degree of elasticity, but little compressibility. It is possible to use a flexure fit for softer materials as well, but when softer materials are used, the flexure may relax over time as the materials compress or take on a permanent deformation due to the forces induced by flexure. Plywood constructed from Birch plies is well suited to a flexure fit. And like an interference fit, the level of assembly force required to fully assemble a flexure fit joint can be engineered into the design.

A combination of fits can also be used for other materials. For example, blow molded plastic panels can allow engineering of properties where panels compress where needed and flex where needed. Metal panels can be engineered for flexure, while mating panels made of wood can compress.

In the following descriptions, the term "design" is generally used to refer to the general shape of the members being assembled to form the joint, but does not refer to the exact dimensions of the shapes. "Specification" is generally used to refer to a particular implementation of a joint design, where the exact shape dimensions and tolerances need be specified for a particular material in a specified range of acceptable thicknesses.

Figure 54:
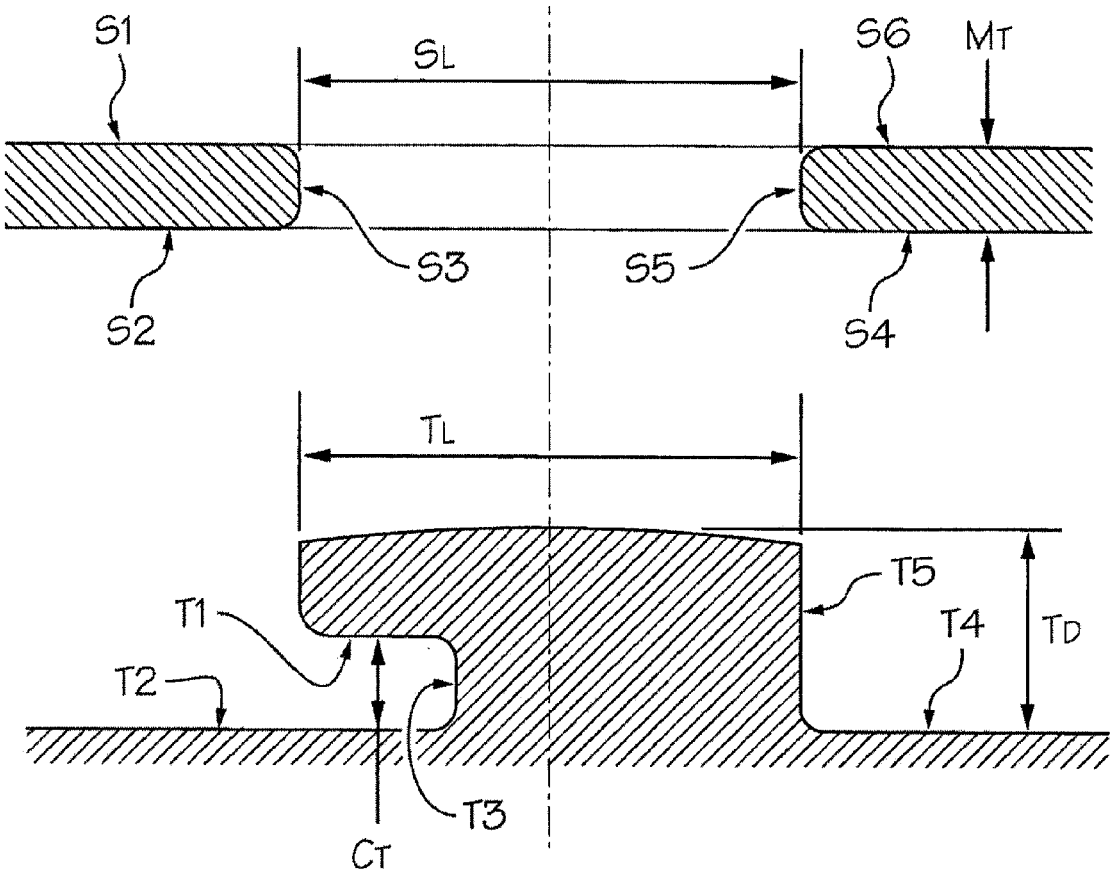
Fig. 54 (Prior Art)
FIG. 54 is a schematic view of an existing joint design.

FIG. 54 is a schematic view of an existing (prior art) joint design. This figure will now be utilized to define certain dimensions which will be utilized in the subsequent figures. The slot is formed in a material having a thickness of MT. The slot has a slot length SL. The length SL generally matches the length of a tab TL. The tab has a depth of TD. Three mating surfaces T1, T2, and T3 together form a U-shaped cavity which is sized to receive the material which carries the slot. The cavity has a cavity thickness CT. Surfaces T1 and T2 are substantially parallel to one another. Surface T3 is substantially perpendicular to surfaces T1 and T2. The other side of the tab is defined by surfaces T4 and T5 which are substantially perpendicular to one another. On one side of the slot, the material has three surfaces S1, S2, and S3. Surfaces S1 and S2 are substantially parallel to one another, subject to material quality and properties. Surface S3 is substantially perpendicular to surfaces S1 and S2 and forms an edge which mates into the cavity defined by the L-shaped tab. On the other side of the slot, the material has three surfaces S4, S5, and S6. Surfaces S4 and S6 are substantially parallel to one another, subject to material quality and properties. Surface S5 is substantially perpendicular to surfaces S4 and S6. When the tab and slot are brought together, surface S1 engages surface T1, surface S2 engages surface T2, and surface S4 engages surface T4. During assembly surface S5 and surface T5 engage one another, but as the edge S3 is moved into the cavity, surface S5 is brought out of engagement with surface T5, and surface S3 engages surface T3.

Figure 55A:
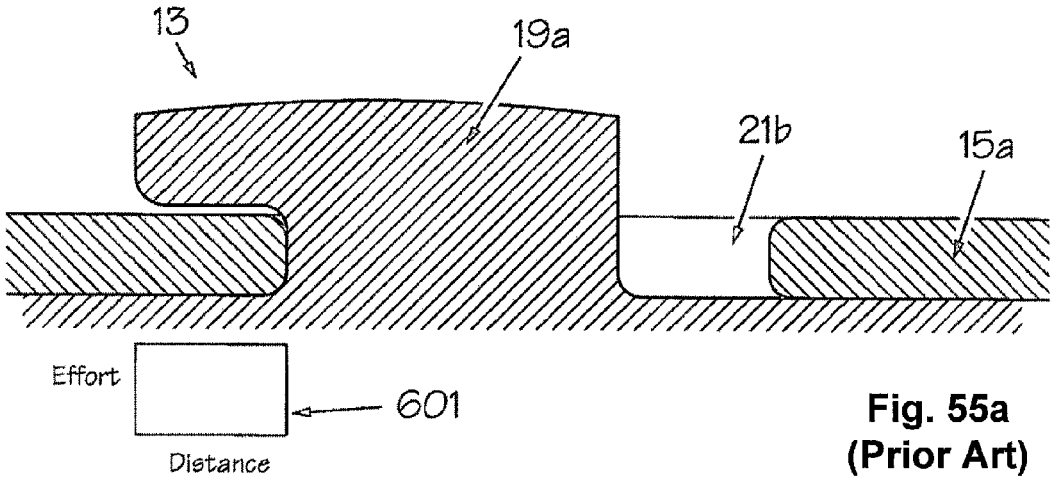
Fig. 55a (Prior Art)
FIGS. 55*a*-55*c* are cross-sectional views of the assembly of an existing joint design, each view illustrating a different material thickness, and the joint design being shown in a loose fit tolerance configuration.
Figure 55B:
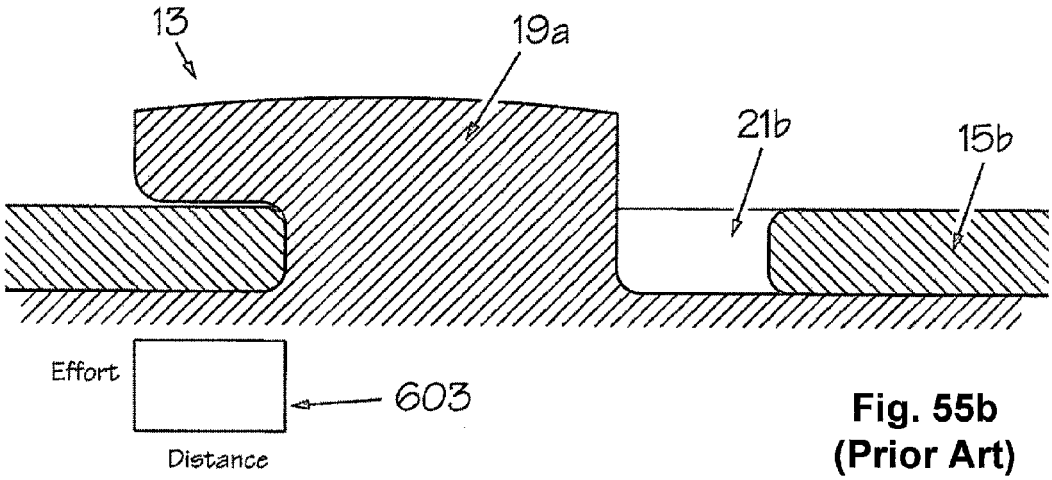
Fig. 55b (Prior Art)
Figure 55C:
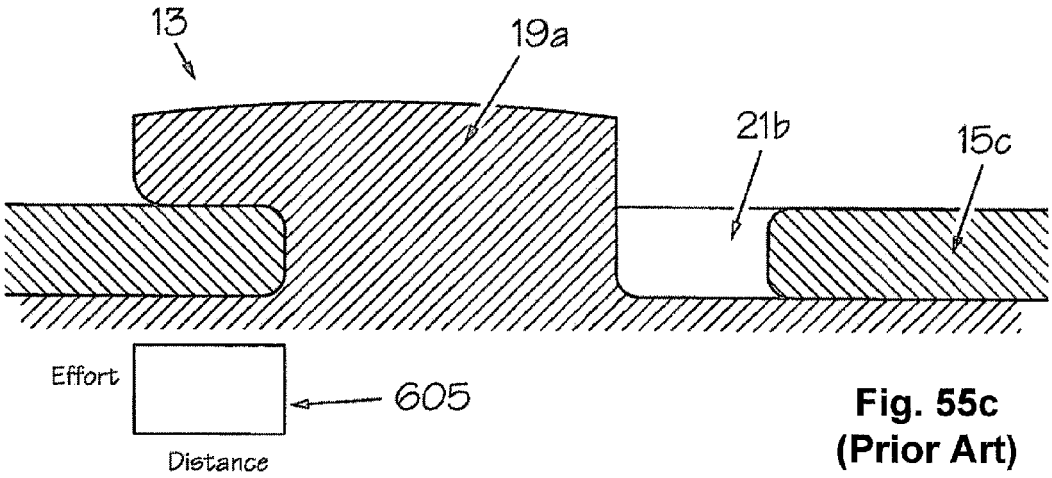
Fig. 55c (Prior Art)

FIGS. 55*a*-55*c* illustrate an existing (prior art) L-shaped tab and slot joint design that is produced with loose fit tolerances. The joint is capable of accommodating material within a range of specified thicknesses, without resisting assembly. Tab 19*a* fits into slot 21*b*. The edge of the slot fits loosely into the cavity defined by the L-shaped portion of the tab 19*a*. FIG. 55*a* illustrates the use of thin material which provides a loose connection. Graph 601 generally illustrates the assembly force required to completely assemble the joint. FIG. 55*b* illustrates the use of thicker material, which provides a more secure connection. Graph 603 generally illustrates the assembly force required. FIG. 55*c* illustrates the use of the thickest allowable material, producing a zero-fit, but non-interfering, connection. Graph 605 generally illustrates the assembly force required. Note that there is no interference in the joint, so no significant force is required for assembly. In FIGS. 55*a*, 55*b*, and 55*c*, the tab 19*a* is a single specification. The material which is utilized to form the slot 21*b* varies in thickness. FIG. 55*a* utilizes a material for the slot that has a thickness 15*a*. FIG. 55*b* utilizes a material for the slot that has a thickness of 15*b*. FIG. 55*c* utilizes a material for the slot that has a thickness of 15*c*.

Figure 56A:
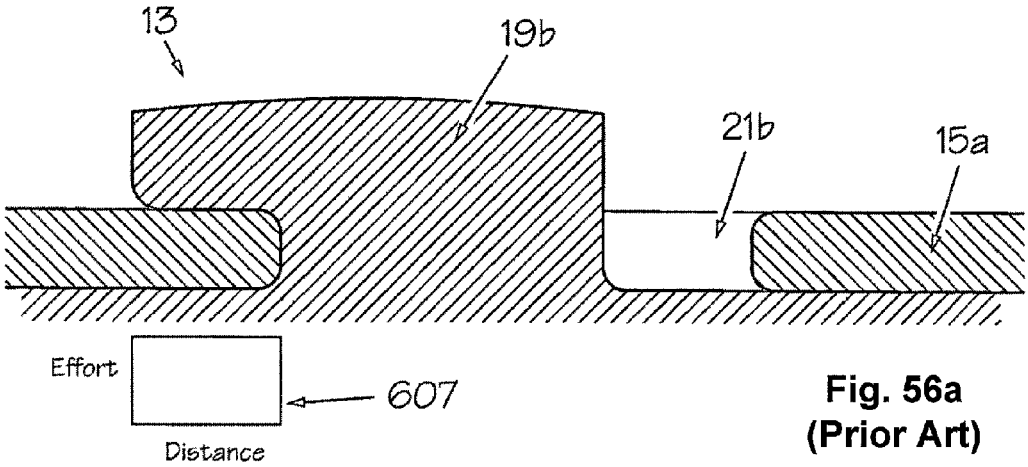
Fig. 56a (Prior Art)
FIGS. 56*a*-56*c* are cross-sectional views of the assembly of an existing joint design, each view illustrating a different material thickness, and the joint design shown in a close fit tolerance configuration, yielding an interference fit in most cases.
Figure 56B:
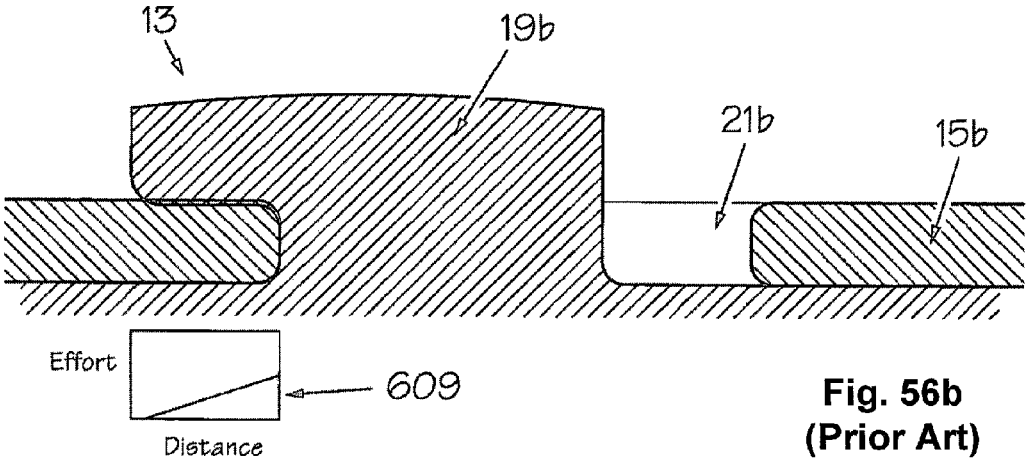
Fig. 56b (Prior Art)
Figure 56C:
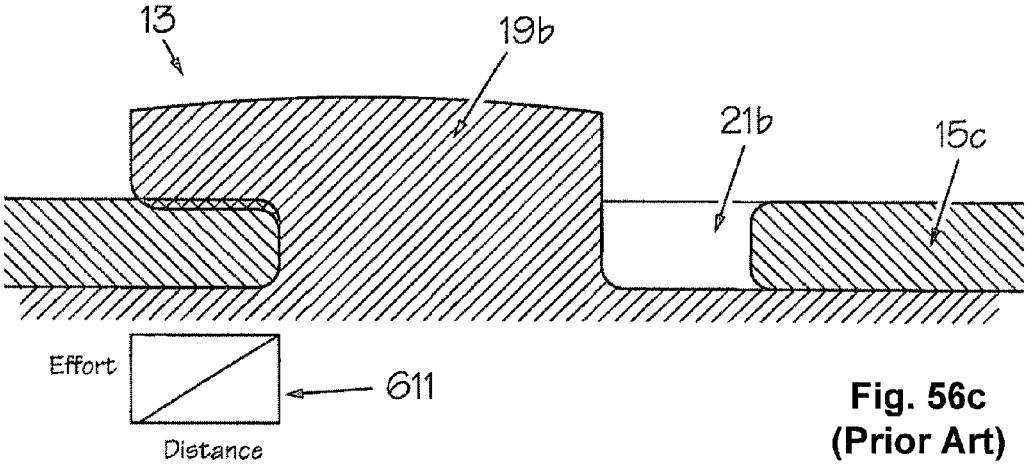
Fig. 56c (Prior Art)

FIGS. 56*a*-56*c* illustrate an existing (prior art) joint that is produced with close fit tolerances. The joint is designed to accommodate material within a range of specified thicknesses, but the joint will produce an interference fit within this range. While this close fit tolerance joint would be secure within this range of thicknesses, the interference fit when material is above minimum thickness would require an assembly force that is too high for a typical consumer to overcome without tools, possibly resulting in damage to the parts. FIG. 56*a* illustrates a close fit, while FIGS. 56*b* and 56*c* depict an interference fit. Graphs 607, 609, and 611 generally illustrate the assembly force required. In FIGS. 56*a*, 56*b*, and 56*c*, the tab 19*b* is a single specification. The material which is utilized to form the slot varies in thickness. FIG. 56*a* utilizes a material for the slot that has a thickness 15*a*. FIG. 56*b* utilizes a material for the slot that has a thickness of 15*b*. FIG. 56*c* utilizes a material for the slot that has a thickness of 15*c*.

Figure 59A:
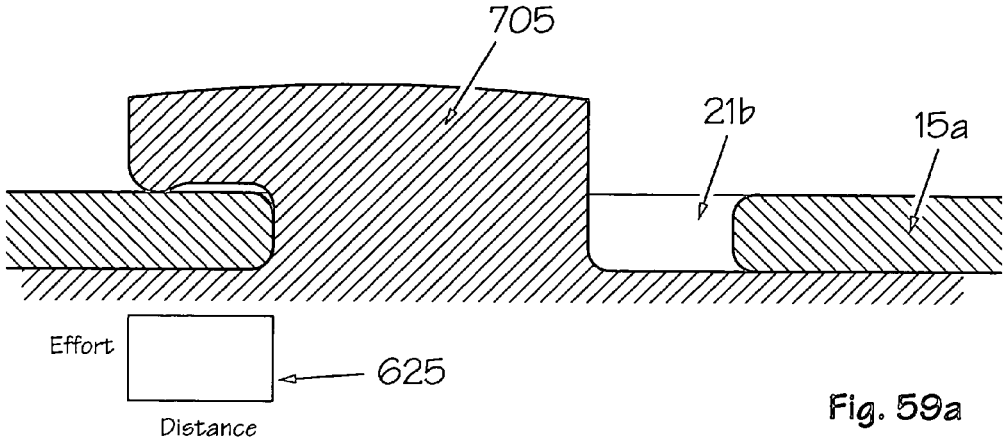
FIGS. 59*a*-59*c* are cross-sectional views of the assembly of an improved joint design with a raised portion on the undercut of the L-shaped tab, producing an interference fit. The raised portion is positioned to maximize distance over which force must be exerted when assembling the joint.
Figure 59B:
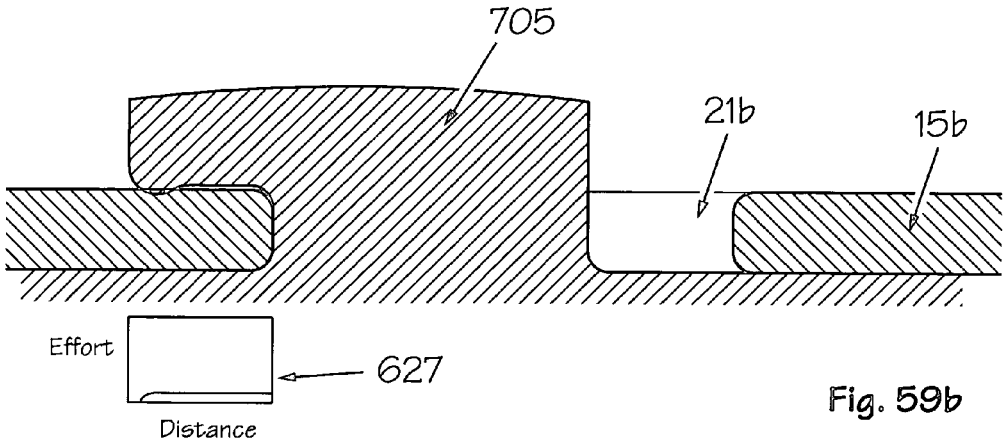
Figure 59C:
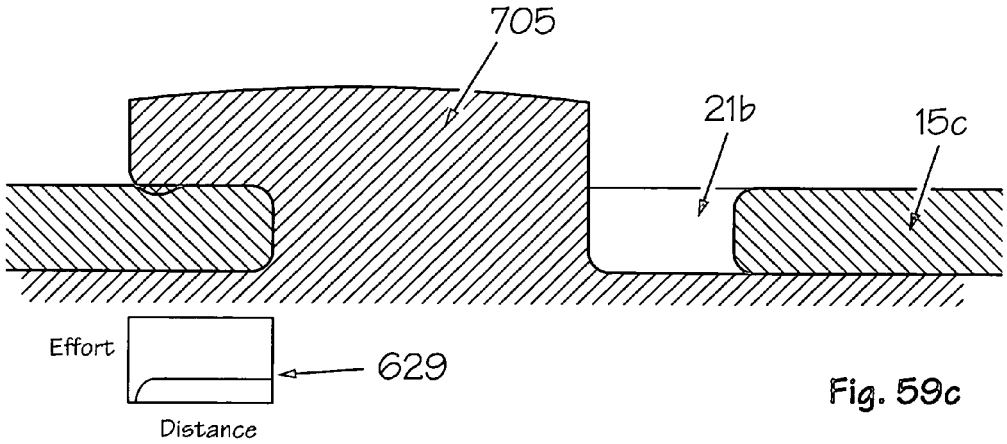
Figure 60A:
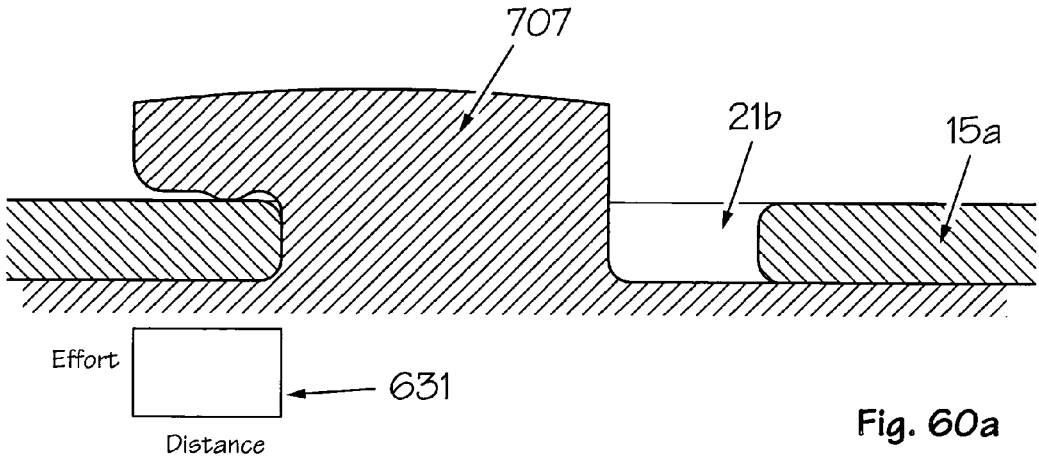
FIGS. 60*a*-60*c* are cross-sectional views of the assembly of an improved joint design with a raised portion on the undercut of the L-shaped tab, producing an interference fit. The raised portion is positioned to minimize distance over which force must be exerted when assembling the joint.
Figure 60B:
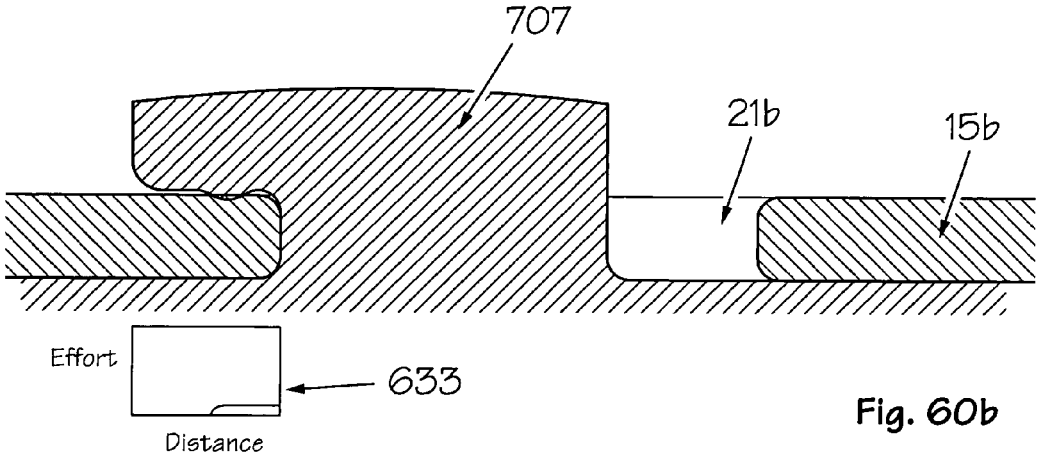
Figure 60C:
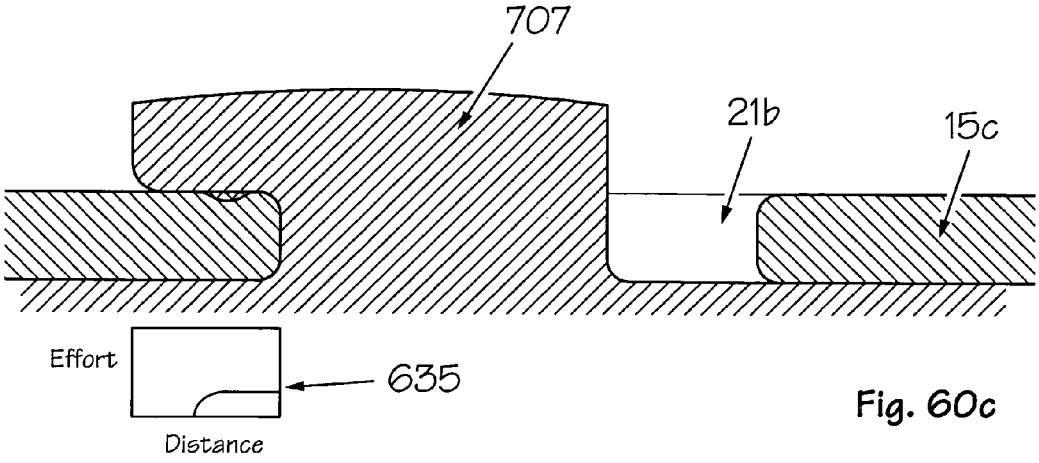
Figure 61A:
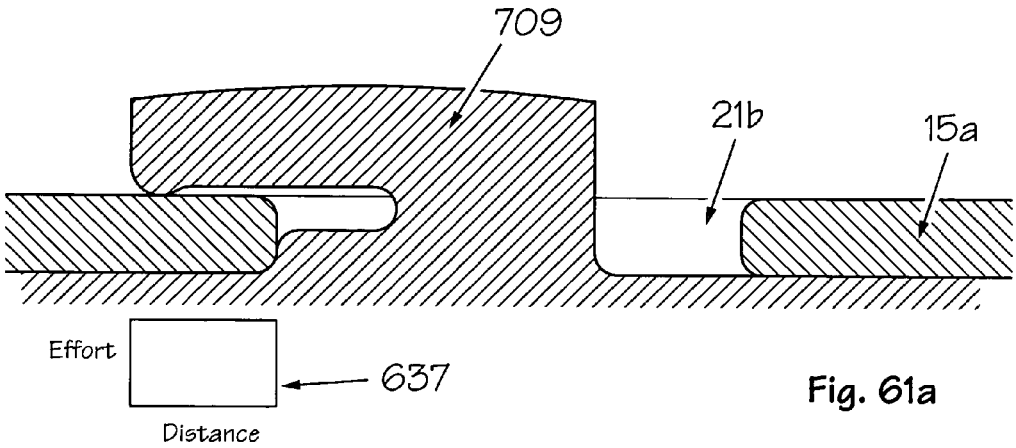
FIGS. 61*a*-61*c* are cross-sectional views of the assembly of an improved joint design with an L-shaped tab designed for flexure.
Figure 61B:
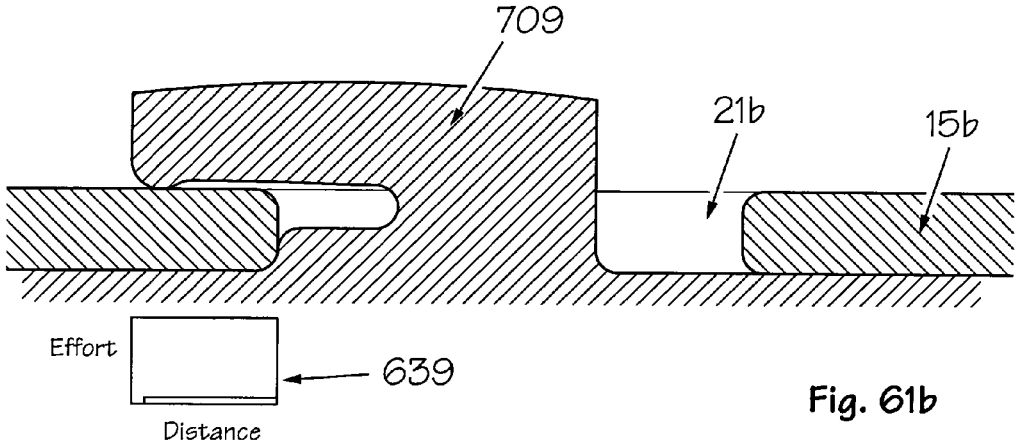
Figure 61C:
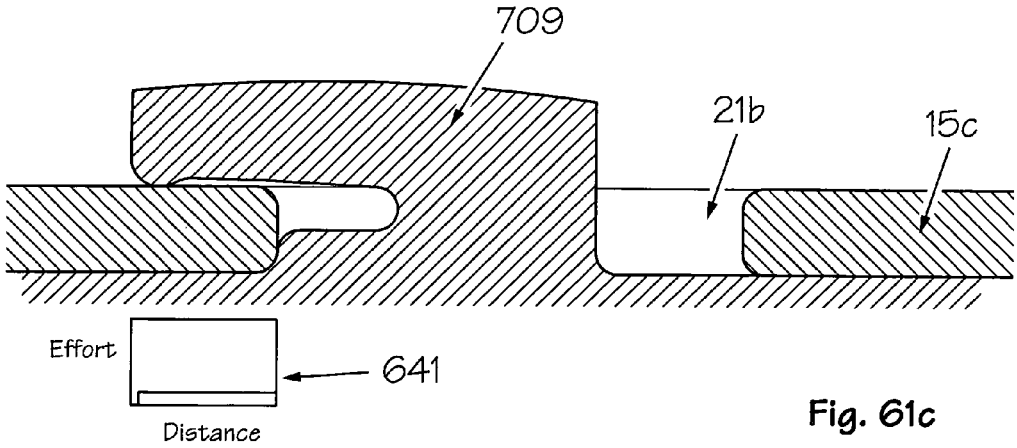
Figure 62:
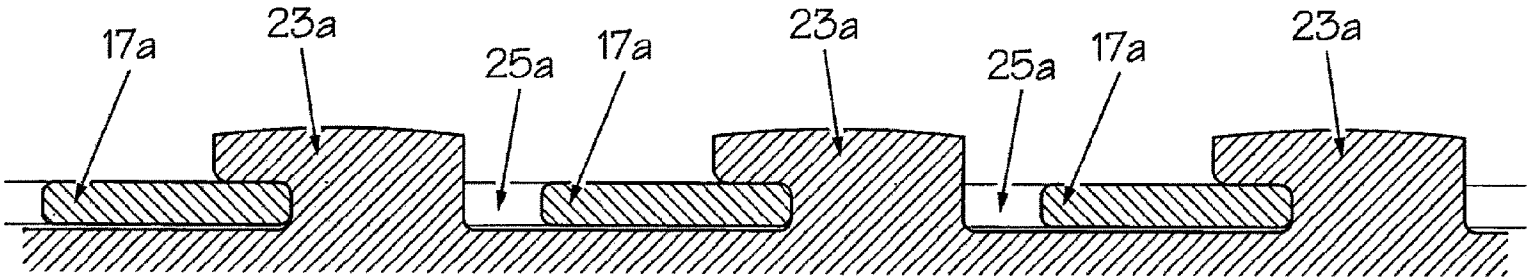
Fig. 62 (Prior Art)
FIG. 62 is a cross-sectional view of the assembly of an existing joint design shown in a loose fit tolerance configuration.
Figure 63:
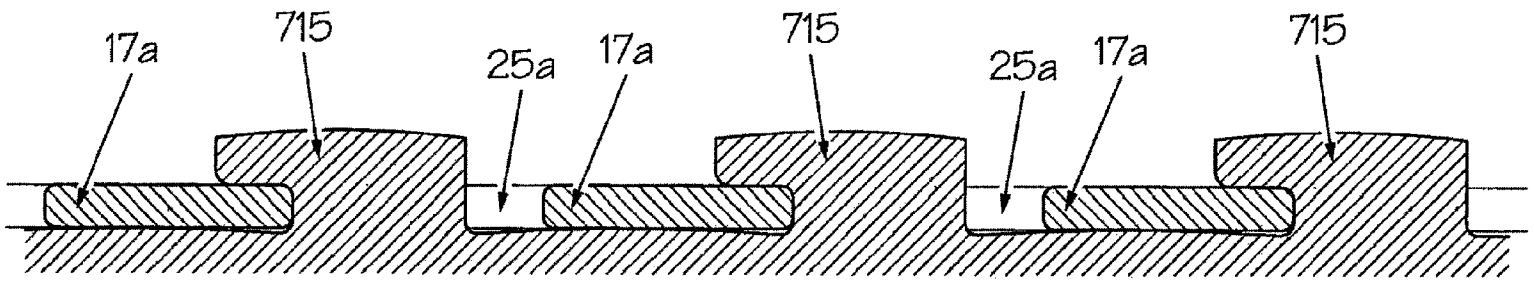
FIG. 63 is a cross-sectional view of the assembly of an improved joint design illustrating interference curves located adjacent to L-shaped tabs.
Figure 64:
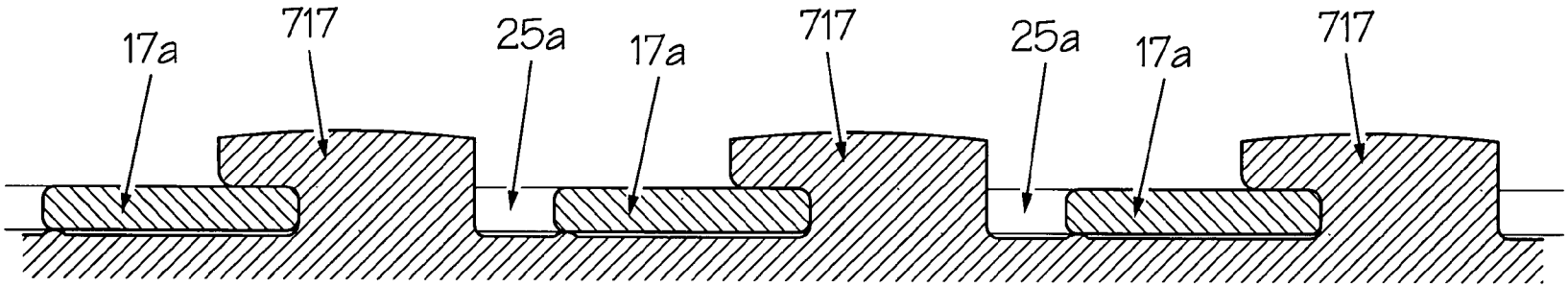
FIG. 64 is a cross-sectional view of the assembly of an improved joint design illustrating interference bumps located adjacent to L-shaped tabs, the joint being shown in a loose fit tolerance configuration with minimum thickness material for this joint configuration.
Figure 65:
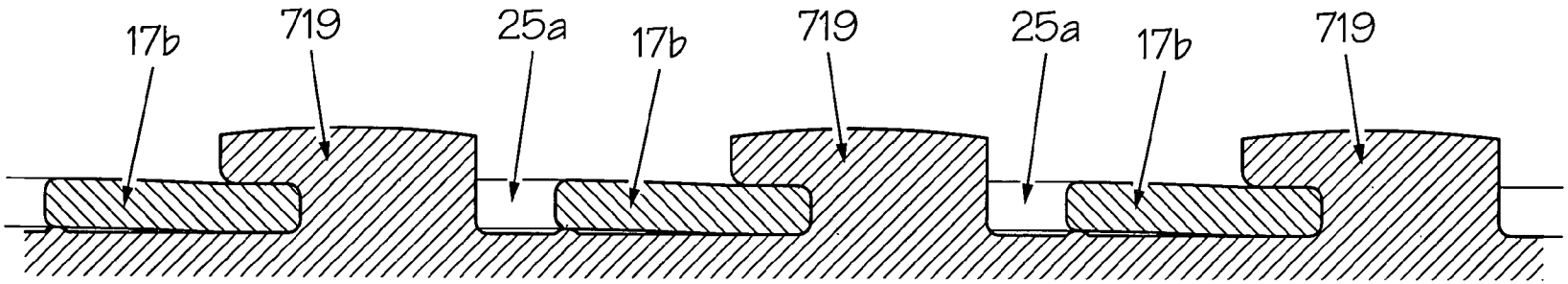
FIG. 65 is a cross-sectional view of the assembly of an improved joint design illustrating interference bumps located adjacent to L-shaped tabs, the joint being shown in a loose fit tolerance configuration with maximum thickness material for this joint configuration.
Figure 66A:
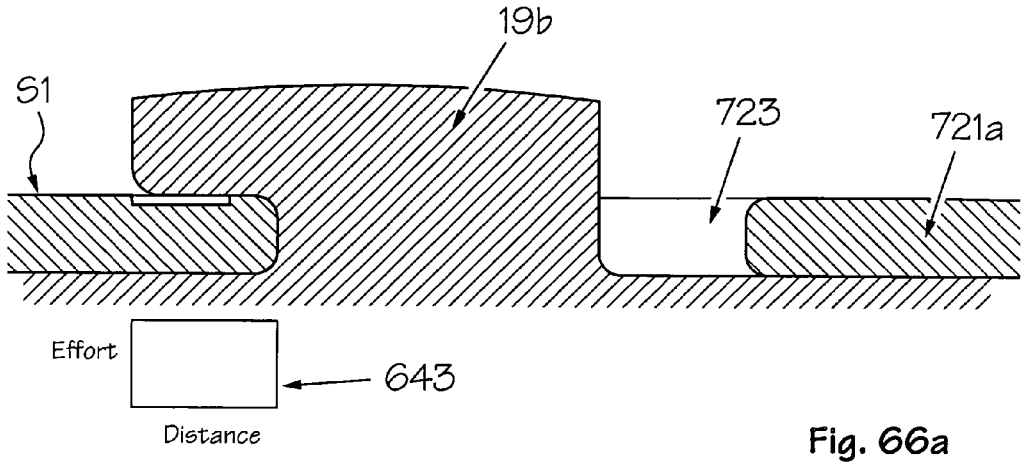
FIGS. 66*a*-66*c* are cross-sectional views of the assembly of an improved joint design where the material is machined thinner in an area, leaving a raised area for interference with the L-shaped tab.
Figure 66B:
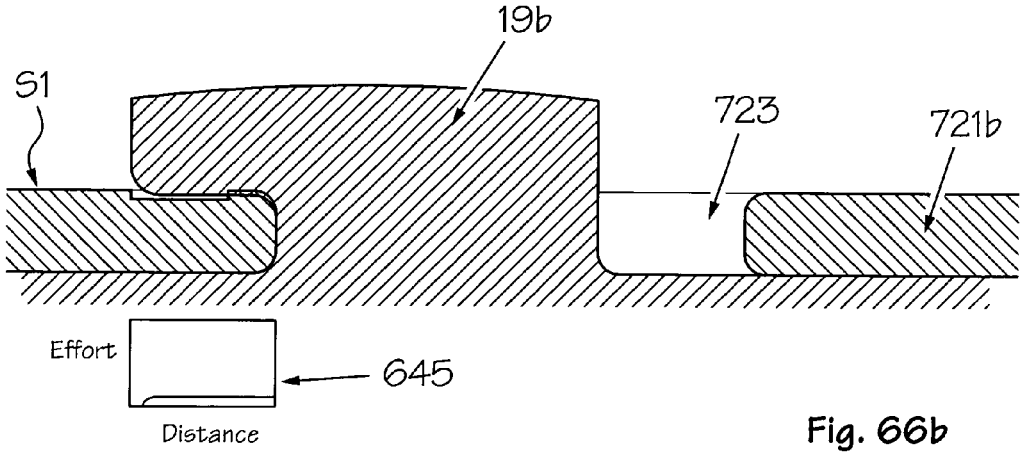
Figure 66C:
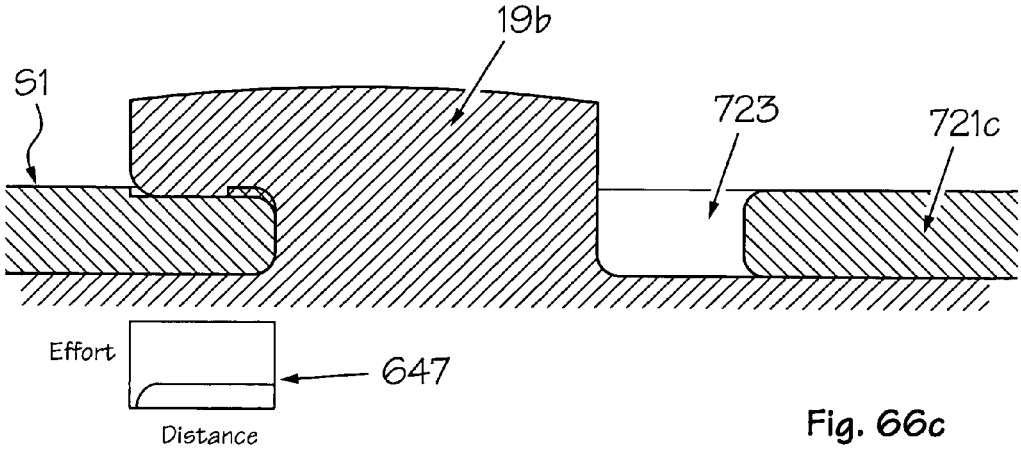
Figure 67A:
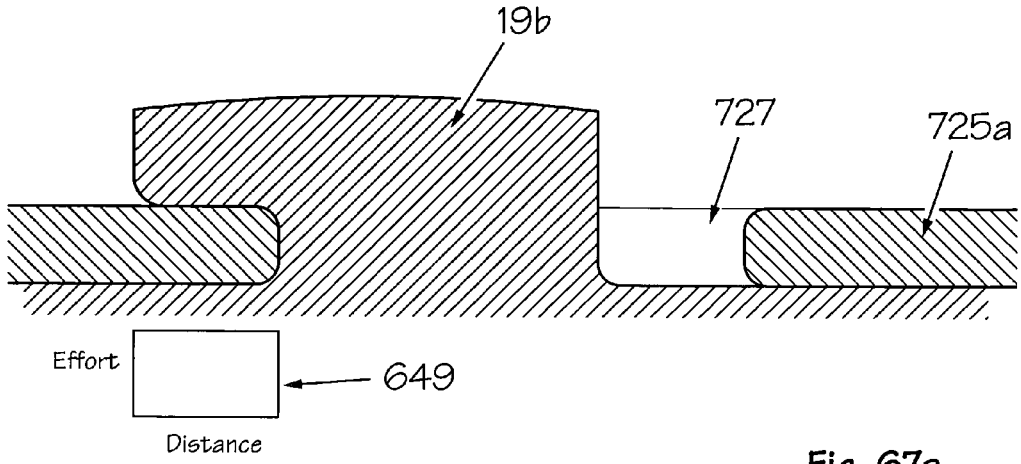
FIGS. 67*a*-67*c* are cross-sectional views of the assembly of an improved joint design where the material is machined in an area to an exact thickness to provide a zero-tolerance fit, regardless of raw material thickness.
Figure 67B:
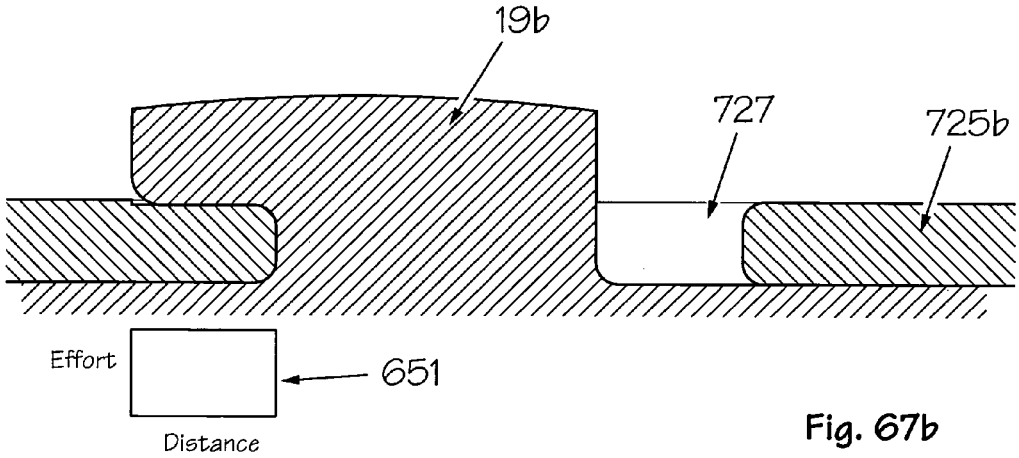
Figure 67C:
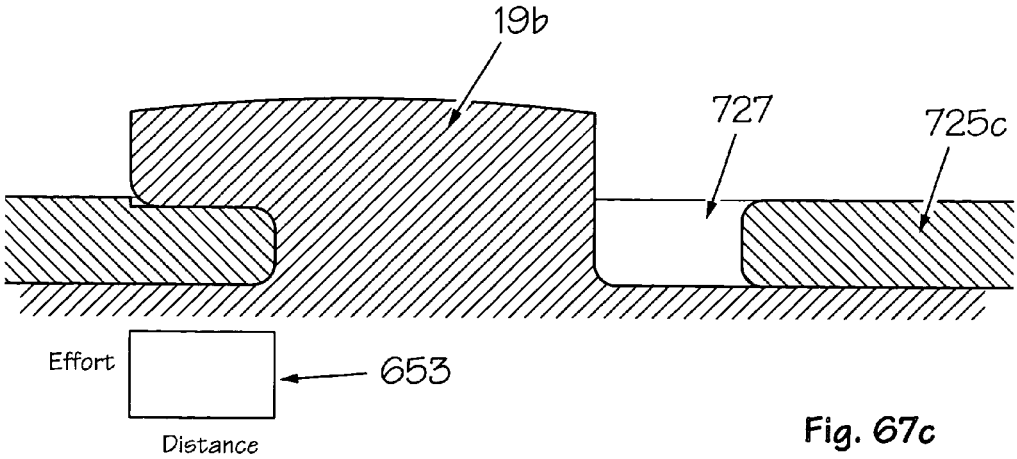
Figure 68A:
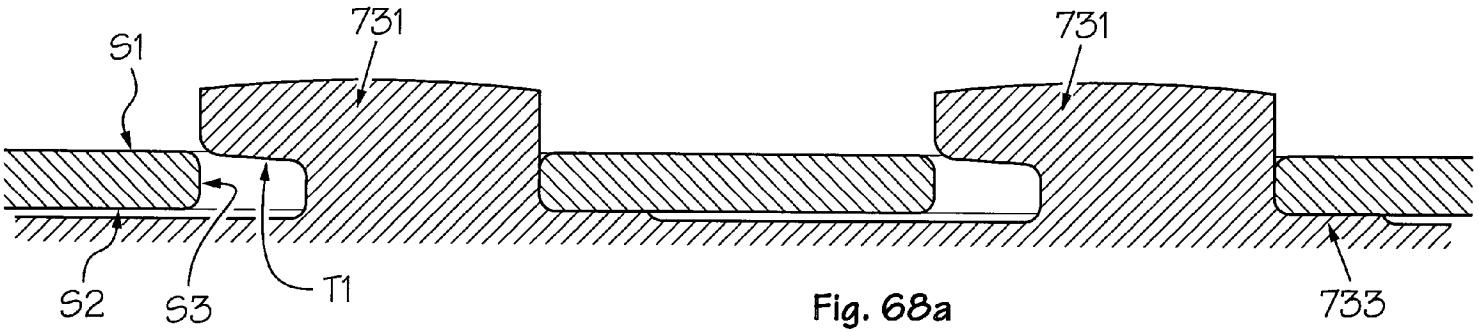
FIGS. 68*a*-68*c* are cross-sectional views of the assembly of an improved joint design that provides a locking mechanism to resist disassembly of the assembled joint.
Figure 68B:
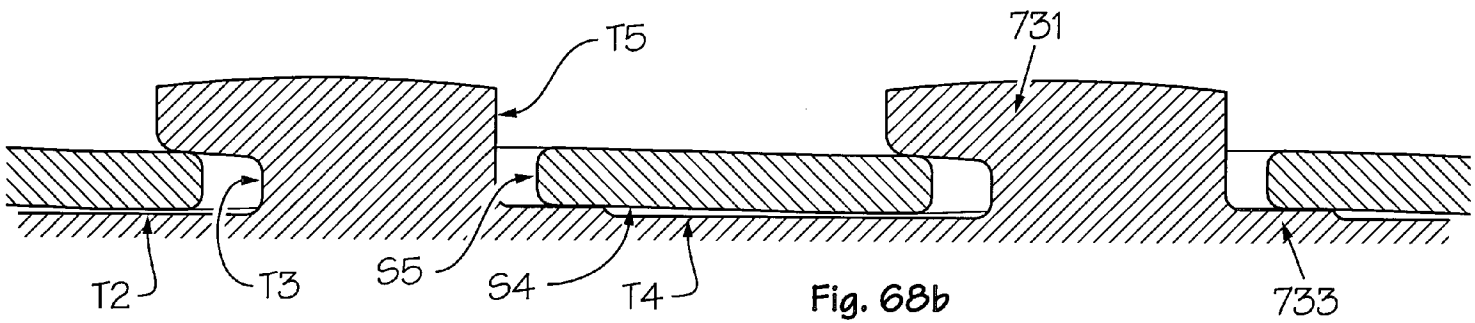
Figure 68C:
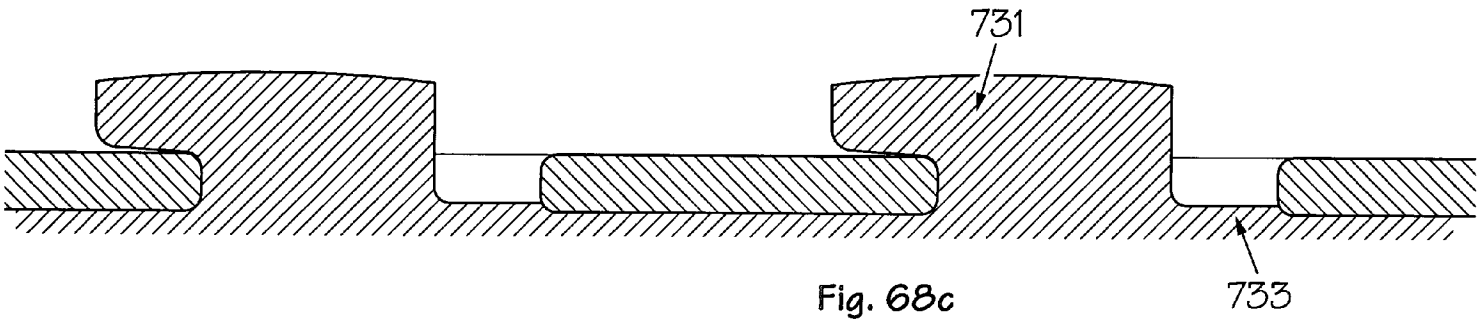

FIGS. 57*a* through 60*c* illustrate new and improved joint designs that utilize interference fits to yield a secure joint. The goal of the joints is to provide a secure fit without requiring excessive assembly force that might require tools or cause permanent damage to the parts. FIG. 61*a*-61*c* illustrate a new and improved joint design that utilizes tab flexure to secure the joint. FIG. 62 illustrates an existing (prior art for non-USA applications only) connection system which is loose tolerance fit. FIG. 63 illustrates a flexure curve coupling. FIGS. 64 and 65 depict a flexure bump coupling. FIGS. 66*a*-66*c* illustrate a machined area used for controlled interference. FIGS. 67*a*-67*c* depict a zero tolerance fit machined area version. FIGS. 68*a*-68*c* illustrate a locking joint coupling. FIGS. 69*a*-69*c* and FIGS. 70*a*-70*c* illustrate two alternative locking joint couplings.

Figure 57A:
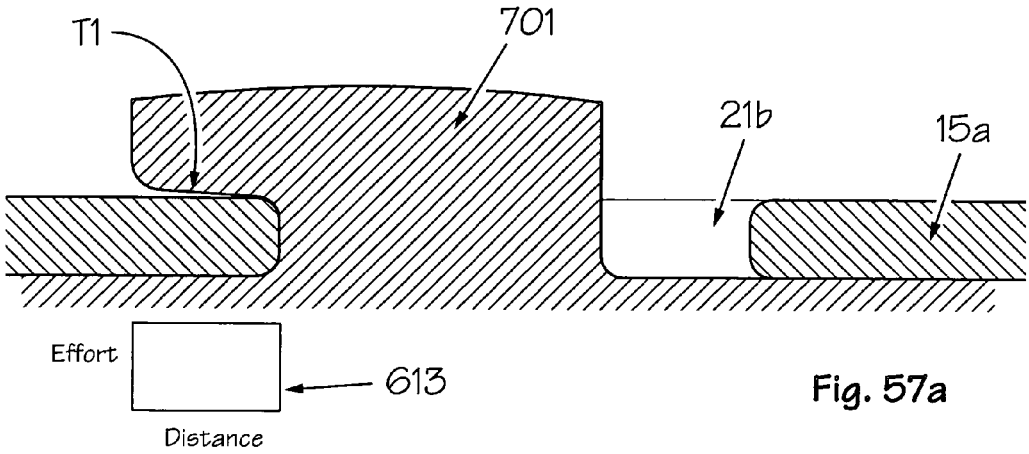
FIGS. 57*a*-57*c* are cross-sectional views of the assembly of an improved joint design with an angled undercut on the L-shaped tab, producing an interference fit.
Figure 57B:
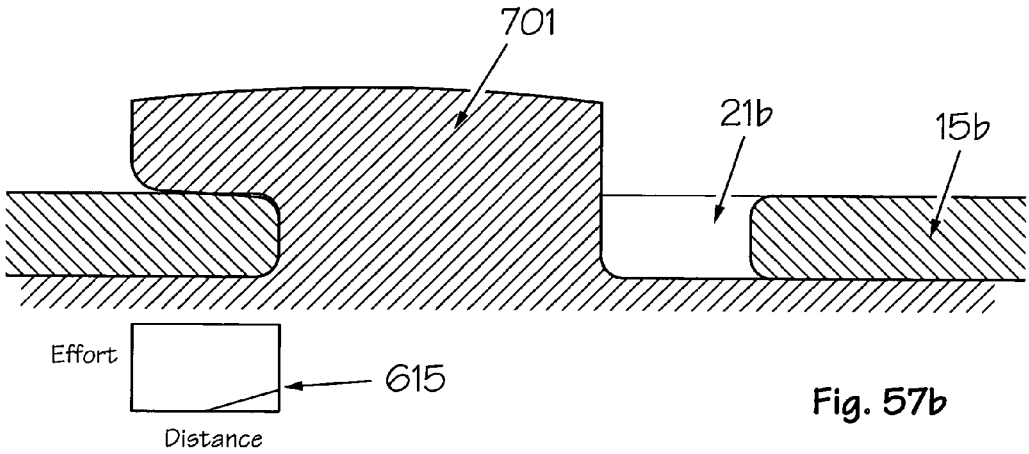
Figure 57C:
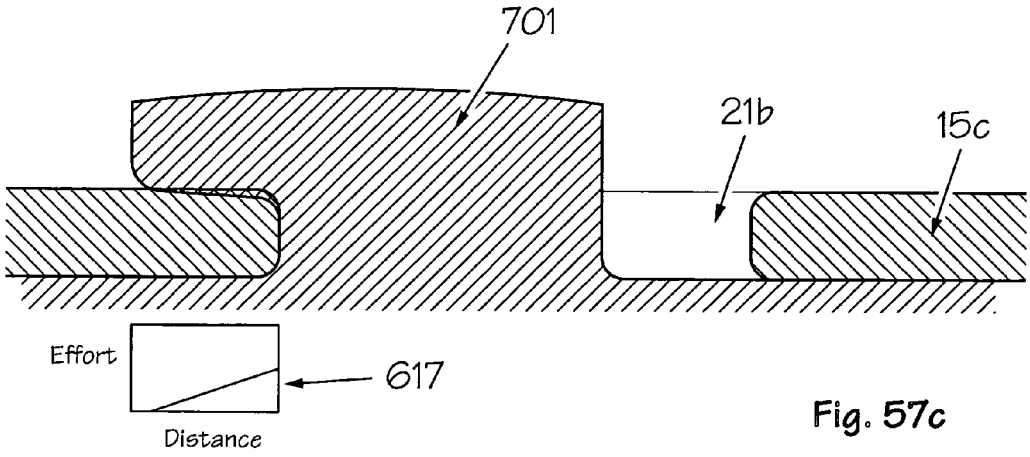

ANGLED SURFACE: FIGS. 57*a*-57*c* illustrate a new and improved joint design with an angled surface on the underside of the L-shaped tab. This angled surface provides a loose fit at the open end of the tab and a close fit at the crotch of the tab. For any material thickness in the range between the minimum and maximum thickness specified for a particular joint specification, this design provides for easy alignment of the tab and slot, and allows the undercut of the L-shaped tab to begin engaging the material around the slot before any significant assembly force is required, making part alignment during assembly easier for the user. Depending on the thickness of the material, assembly force will increase uniformly during joint assembly until the material around the slot fully engages the crotch of the tab, relying on the elasticity and compressibility of the material to allow the joint to fully engage. This joint design yields a securely assembled joint and is well suited to softer materials such as poplar plywood, because the material thickness tolerances dictated by manufacturing standards, and the elasticity and compressibility of the material, match well with the tolerances and interference characteristics of this particular joint design. FIGS. 57*a*-57*c* depict the use of an angled surface as part of the L-shaped tab 701. More particularly, surface T1 is shown as being angled. In alternative embodiments, surface T2 may be angled, or a combination of surfaces T1 and T2 may be angled. FIG. 57*a* illustrates a close fit, while FIGS. 57*b* and 57*c* depict an interference fit. Graphs 613, 615, and 617 generally illustrate the assembly force required. In FIGS. 57*a*, 57*b*, and 57*c*, the tab 701 is a single specification. The material that is utilized to form the slot 21*b* varies in thickness. FIG. 57*a* utilizes a material for the slot that has a thickness 15*a*. FIG. 57*b* utilizes a material for the slot that has a thickness of 15*b*. FIG. 57*c* utilizes a material for the slot that has a thickness of 15*c*.

Figure 58A:
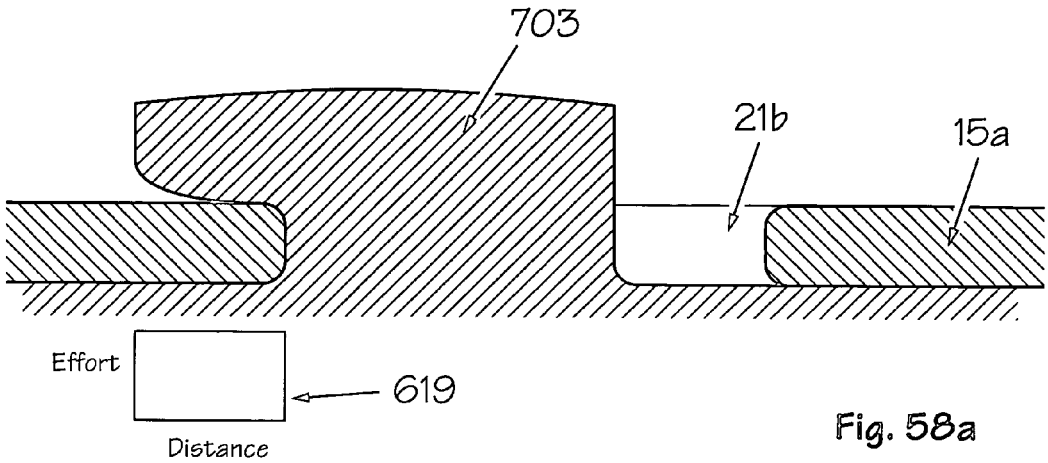
FIGS. 58*a*-58*c* are cross-sectional views of the assembly of an improved joint design with a curvature on the undercut of the L-shaped tab, producing an interference fit.
Figure 58B:
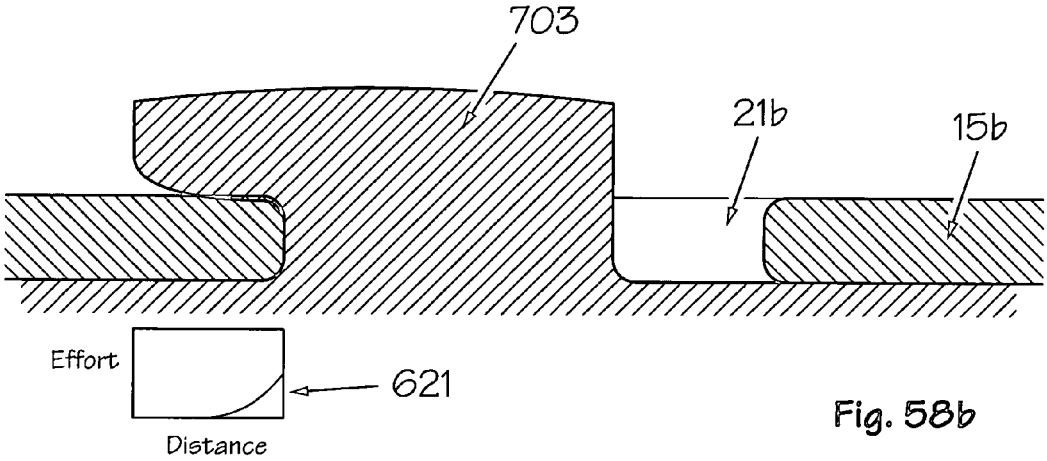
Figure 58C:
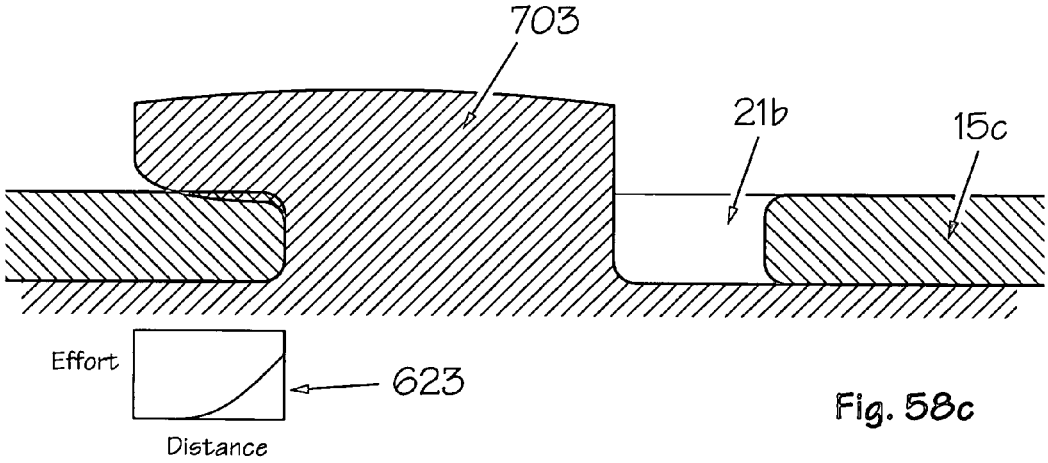

CURVED SURFACE: FIGS. 58*a*-58*c* illustrate a new and improved joint design with curvature on the underside of the L-shaped tab. This curved surface provides a loose fit at the open end of the tab and a close fit at the crotch of the tab. For any material thickness in the range between the minimum and maximum thickness specified for a particular joint specification, this design provides for easy alignment of the tab and slot, and allows the undercut of the L-shaped tab to begin engaging the material around the slot before any significant assembly force is required, making part alignment during assembly easier for the user. Depending on the thickness of the material, assembly force will continuously increase during joint assembly until the material around the slot fully engages the crotch of the tab, relying on the elasticity and compressibility of the material to allow the joint to fully engage. This joint design yields a securely assembled joint and is well suited to softer materials such as poplar plywood, because the material thickness tolerances dictated by manufacturing standards, and the elasticity and compressibility of the material match well with the tolerances and interference characteristics of this particular joint design. FIGS. 58*a*-58*c* depict the use of a curved surface as part of the L-shaped tab 703. More particularly, surface T1 is shown as being curved. In alternative embodiments, surface T2 may be curved, or a combination of surfaces T1 and T2 may be curved. FIG. 58*a* illustrates a close fit, while FIGS. 58*b* and 58*c* depict an interference fit. Graphs 619, 621, and 623 generally illustrate the assembly force required. In FIGS. 58*a*, 58*b*, and 58*c*, the tab 703 is a single specification. The material that is utilized to form the slot varies in thickness. FIG. 58*a* utilizes a material for the slot that has a thickness 15*a*. FIG. 58*b* utilizes a material for the slot that has a thickness of 15*b*. FIG. 58*c* utilizes a material for the slot that has a thickness of 15*c*.

BUMPED SURFACE: FIGS. 59*a*-59*c* illustrate a new and improved joint design with an interference bump on the undercut of the L-shaped tab. This bump produces a joint with a loose fit at the start of engagement, and an interference fit once the material around the slot has engaged the bump. In this joint design, the bump is positioned to provide an interference fit over the majority of the engagement length of the joint. For any material thickness in the range between the minimum and maximum thickness specified for a particular joint specification, this design provides for easy alignment of the tab and slot, and allows the undercut of the L-shaped tab to begin engaging the material around the slot before any significant assembly force is required, making part alignment during assembly easier for the user. Depending on the thickness, elasticity and compressibility of the material, assembly force will increase as the material around the slot engages the bump, but will remain uniform throughout the completion of joint assembly until the material around the slot fully engages the crotch of the tab. This joint design yields a securely assembled joint and is well suited to harder materials such as birch plywood, because the material thickness tolerances dictated by manufacturing standards such as GOST, and the elasticity and compressibility of the material match well with the tolerances and interference characteristics of this particular joint design. It should be understood that the bump does not have to be integral to the panel material, but could be produced by an insert made of wood, plastic, metal, or other material. Inserts made of soft materials such as wood or plastic may deform more in an interference fit situation than harder materials like metal, causing less permanent disfiguration to the mating panel. FIGS. 59*a*-59*c* depict the use of a bumped surface as part of the L-shaped tab 705. More particularly, surface T1 is shown as including a raised bump. In alternative embodiments, surface T2 may carry the bump, or a combination of surfaces T1 and T2 may carry bumps. FIG. 59*a* illustrates a close fit, while FIGS. 59*b* and 59*c* depict an interference fit. Graphs 625, 627, and 629 generally illustrate the assembly force required. In FIGS. 59*a*, 59*b*, and 59*c*, the tab 705 is a single specification. The material that is utilized to form the slot varies in thickness. FIG. 59*a* utilizes a material for the slot that has a thickness 15*a*. FIG. 59*b* utilizes a material for the slot that has a thickness of 15*b*. FIG. 59*c* utilizes a material for the slot that has a thickness of 15*c*.

ALTERNATIVE LOCATION OF BUMPED SURFACE: FIGS. 60*a*-60*c* illustrate a new and improved joint design with an interference bump on the undercut of the L-shaped tab. This bump produces a joint with a loose fit at the start of engagement and an interference fit once the material around the slot has engaged the bump. In this joint design, the bump is positioned to provide an interference fit over a fraction of the engagement length of the joint, hence minimizing the distance over which force must be exerted to fully assemble the joint. For any material thickness in the range between the minimum and maximum thickness specified for a particular joint specification, this design provides for easy alignment of the tab and slot, and allows the undercut of the L-shaped tab to begin engaging the material around the slot before any significant assembly force is required, making part alignment during assembly easier for the user. Depending on the thickness, elasticity and compressibility of the material, assembly force will increase as the material around the slot engages the bump, but will remain uniform throughout the completion of joint assembly until the material around the slot fully engages the crotch of the tab. This joint design yields a securely assembled joint and is well suited to harder materials such as birch plywood, because the material thickness tolerances dictated by manufacturing standards such as GOST, and the elasticity and compressibility of the material match well with the tolerances and interference characteristics of this particular joint design. FIGS. 60*a*-60*c* depict the use of a bumped surface as part of the L-shaped tab 707. More particularly, surface T1 is shown as carrying the bump. In alternative embodiments, surface T2 may carry the bump, or a combination of surfaces T1 and T2 may carry the bump. FIG. 60*a* illustrates a close fit, while FIGS. 60*b* and 60*c* depict an interference fit. Graphs 631, 633, and 635 generally illustrate the assembly force required. In FIGS. 60*a*, 60*b*, and 60*c*, the tab 707 is a single specification. The material that is utilized to form the slot varies in thickness. FIG. 60*a* utilizes a material for the slot that has a thickness 15*a*. FIG. 60*b* utilizes a material for the slot that has a thickness of 15*b*. FIG. 60*c* utilizes a material for the slot that has a thickness of 15*c*.

FLEXING TAB VERSION: FIGS. 61*a*-61*c* illustrate an L-shaped tab designed for flexure. This joint design relies on flexure of the L-shaped tab to maintain pressure between the underside of the tab and the surface of the material surrounding the slot. This flexure allows the joint design to adapt to varying material thicknesses without destructive effects due to material compression from an interference fit. A bump may be formed on the underside of the tab to precisely position a contact point between members. If the bump was not present and the surface of the underside of the L-shaped tab was allowed to contact the surface of the material around the slot, the contact point could move during assembly and the contact point area could change, depending on the thickness of the material. For example, if thick material were introduced into the joint, the material would push the tab upward because of the wedge action between the material and the underside of the tab. This wedge action would also act to push the joint back into an unassembled position. By forming a bump on the underside of the tab, the contact point is precisely positioned for a range of material thicknesses for a particular joint specification. FIGS. 61*a*-61*c* depict the use of a flexing L-shaped tab 709. More particularly, the material adjacent surface T1 is shown as flexing relative to the material that carries the slot. FIG. 61*a* illustrates a fit with little or no pressure exerted on the material that carries the slot, while FIGS. 61*b* and 61*c* depict fits with increasing pressure exerted on the material that carries the slot. Graphs 637, 639, and 641 generally illustrate the assembly force required. In FIGS. 61*a*, 61*b*, and 61*c*, the tab 709 is a single specification. The material that is utilized to form the slot varies in thickness. FIG. 61*a* utilizes a material for the slot that has a thickness 15*a*. FIG. 61*b* utilizes a material for the slot that has a thickness of 15*b*. FIG. 61*c* utilizes a material for the slot that has a thickness of 15*c*.

LOOSE TOLERANCE FIT COUPLING: FIG. 62 illustrates an existing (prior art) L-shaped tab and slot design that is produced with loose fit tolerances. The joint is capable of accommodating material of or below a specified maximum thickness without resisting assembly. The joint is shown with material that is below the maximum allowable thickness for the particular joint specification. As a result, the loose tolerance can be seen by the space between the edge of panel 17*a* and the surface of the panel forming tabs 23*a*. If material was used that was equal to the maximum allowable thickness for the particular joint specification, the space between the edge of panel 17*a* and the surface of the panel forming tabs 23*a*, would not be present. This space is inversely proportional to the thickness of the material used. When the space is present, the joint is not a secure joint. As is shown in FIG. 62, tabs 23*a* pass through slots 25*a*. The L-shaped portion of the tabs 23*a* loosely couple to the material which carries the slots.

FLEXURE CURVE COUPLING: FIG. 63 illustrates a new and improved joint design with an interference curve located adjacent to L-shaped tabs 715. This interference curve acts to take up the space that is present when thin material is utilized for panel 17*a*, and relies on the flexure of the panel when thicker material is utilized. The curve does not have to be between two tabs, but if located on either side of a single tab, the flexure in the panel can be more obvious to someone viewing the end of the panel because the end will be urged away from the edge of the mating panel, making the gap between these panels widen as the distance from the L-shaped tab increases. As is shown in FIG. 63, tabs 715 pass through slots 25*a*. The L-shaped portion of the tabs 715 tightly couple to the material 17*a* that carries the slots due to the curvature.

FLEXURE BUMP COUPLING: FIGS. 64 and 65 illustrate a new and improved joint design with an interference bump located adjacent to L-shaped tabs 717 and 719. FIG. 64 illustrates the joint design with thin material for this particular joint specification. The space between the mating panels is visible, due to the difference between the dimension of the opening of the L-shaped tab 717 and the thickness of the material 17*a*. FIG. 65 illustrates the joint design with thick material for this particular joint specification. The flexure in the panel 17*b* can be seen, due to the interference between the bump and the panel 17*b*.

MACHINED AREA INTERFERENCE COUPLING: FIGS. 66*a*-66*c* illustrate an improved joint design where the material is machined thinner in an area, leaving a raised area for interference with the L-shaped tab 19*b*. The panel can be machined by the same cutter that shapes the panel, to produce a relief that leaves a raised portion in surface S1 of material, positioned to produce an interference fit with the undercut of an L-shaped tab on a mating panel. Even though it is possible to machine both sides of the material, this design is not as well suited for asymmetric designs. FIG. 66*a* illustrates the use of material having a thickness of 721*a* for a relatively loose fit. In contrast, FIGS. 66*b* and 66*c* illustrate the use of thicker material 721*b* and 721*c* for a tighter interference-fit coupling. Graphs 643, 645, and 647 generally depict the assembly force required for each alternative version.

ZERO TOLERANCE FIT MACHINED AREA: FIGS. 67*a*-67*c* illustrate an improved joint design where the material is machined thinner in an area to produce a zero-tolerance fit. Because a CNC routing machine uses a pre-set depth as a reference, it is possible for machines of this type to machine a relief whose bottom is a constant distance from the opposite side of the material, producing a section of material that is an exact thickness in all cases. Positioning this exact thickness area provides a zero-tolerance fit with an L-shaped tab on the mating panel. This design is not as well suited for asymmetric designs. As is shown, the cavity is sized to correspond to the thickness of the material which varies (725*a*, 725*b*, and 725*c*). Graphs 649, 651, and 653 generally depict the assembly force required for each version.

LOCKING JOINT COUPLING: FIGS. 68*a*-68*c* illustrate a new and improved locking joint design. FIG. 68*a* depicts the tab 731 inserted into the slot with surfaces S5 and T5 in engagement. FIG. 68*b* depicts the tab 731 moved relative to the slot, with surface T1 of tab 731 making contact with surface S1, and surface S4 making contact with raised portion 733 of surface T4. The design comprises a tab with the raised portion 733 that causes the mating panel to flex during assembly, and then snap into the slot to provide a locking mechanism that resists disassembly of the joint in reverse order of assembly. FIG. 68*c* depicts the slot and tab fully engaged and locked into position by surface S5 engaging the shoulder of raised portion 733. The shape of the raised portion may be varied to change the resistance characteristics of the locking mechanism. By making the raised portion higher, the amount of force required to disassemble the joint can be increased. Utilizing a single slot for both the joint and the locking mechanism reduces machining requirements and improves aesthetics. In a design that utilizes multiple joints, each slot may optionally be configured as a locking joint, so that the effort required to disassemble the components can be controlled.

Figure 69A:
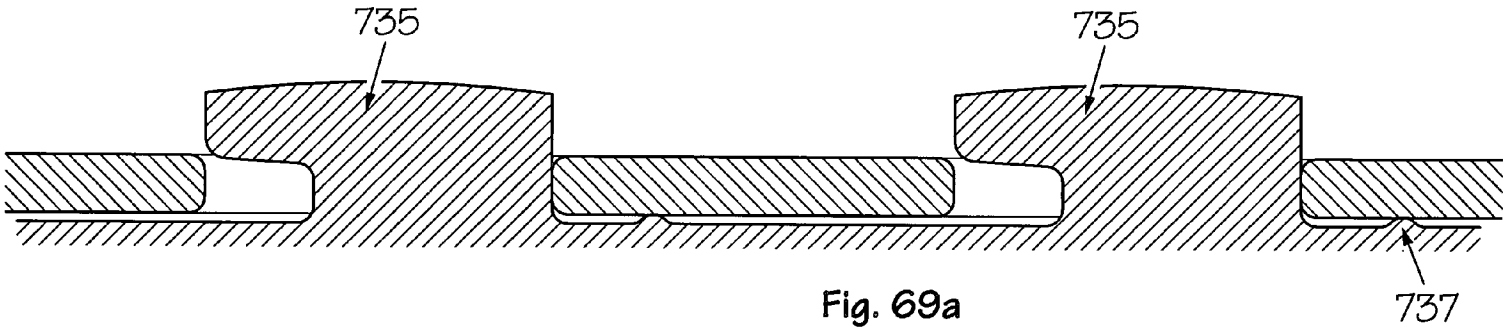
FIGS. 69*a*-69*c* are cross-sectional views of the assembly of an improved joint design that provides a locking mechanism to resist disassembly of the assembled joint.
Figure 69B:
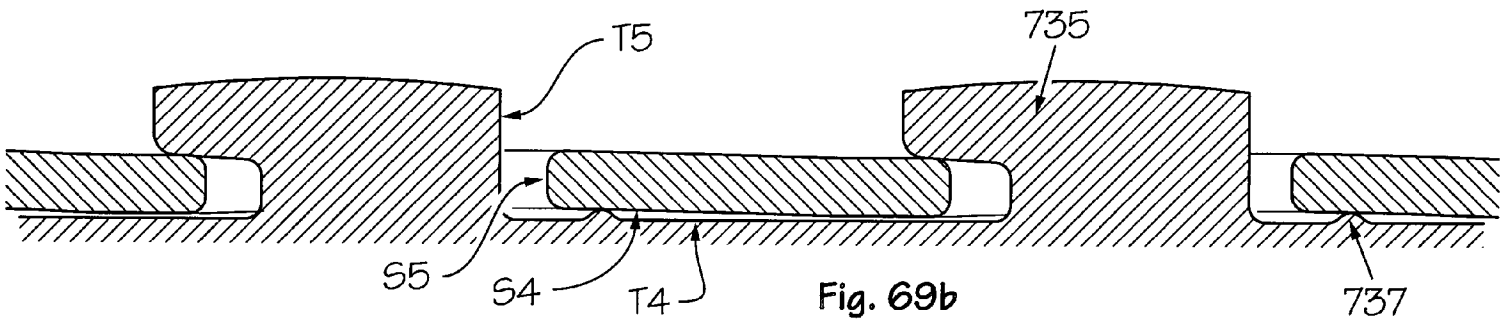
Figure 69C:
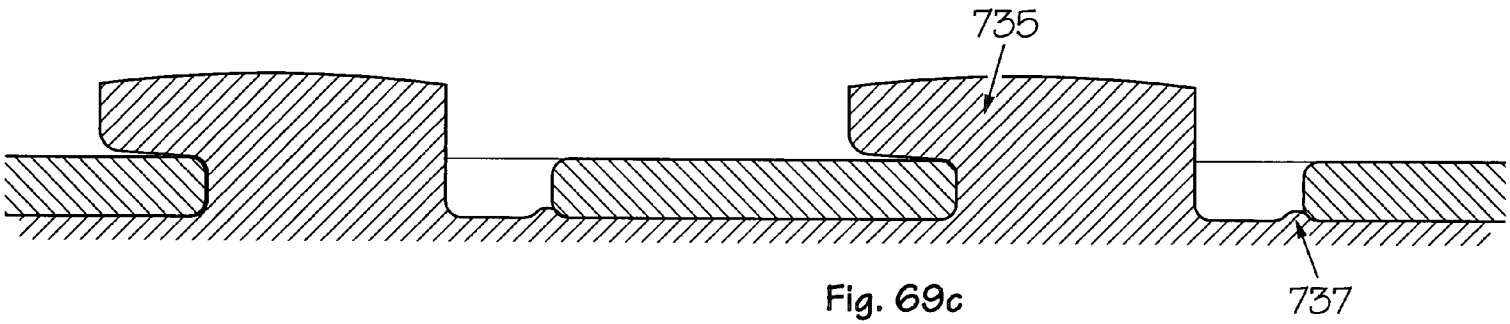

ALTERNATIVE LOCKING JOINT COUPLING: FIGS. 69*a*-69*c* illustrate a new and improved locking joint design. FIG. 69*a* depicts the tab 735 inserted into the slot with surfaces S5 and T5 in engagement. FIG. 69*b* depicts the tab 735 moved relative to the slot with surface T1 of tab 735 making contact with surface S1, and surface S4 making contact with raised bump 737 of surface T4. The design comprises a tab with the raised bump 737 that causes the mating panel to flex during assembly, and then snap into the slot to provide a locking mechanism that resists disassembly of the joint in reverse order of assembly. FIG. 69*c* depicts the slot and tab fully engaged and locked into position by surface S5 engaging the raised bump 737. The shape of the raised portion may be varied to change the resistance characteristics of the locking mechanism. By making the raised bump higher, the amount of force required to disassemble the joint can be increased. Utilizing a single slot for both the joint and the locking mechanism reduces machining requirements and improves aesthetics. Uses existing slot so no extra slots are needed. In a design that utilizes multiple joints, each slot may optionally be configured as a locking joint, so that the effort required to disassemble the components can be controlled.

Figure 70A:
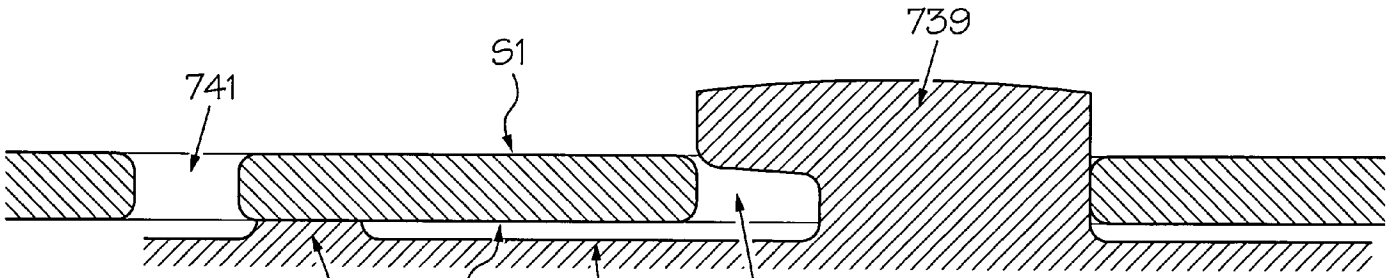
FIGS. 70*a*-70*c* are cross-sectional views of the assembly of an improved joint design that provides a locking mechanism to resist disassembly of the assembled joint.
Figure 70B:
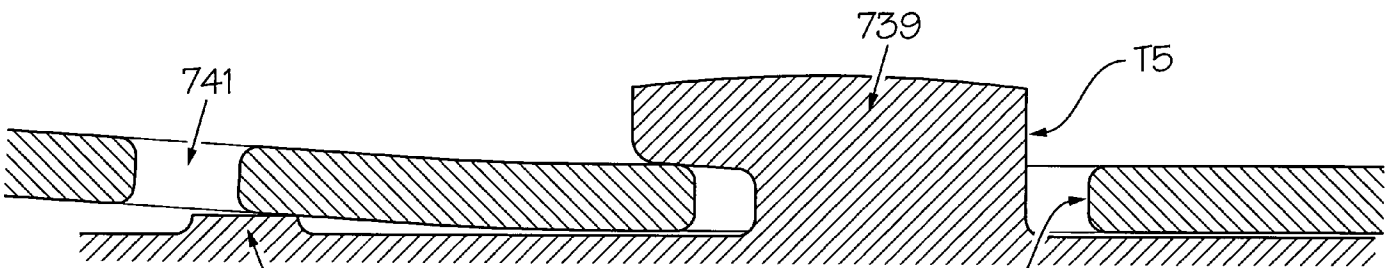
Figure 70C:
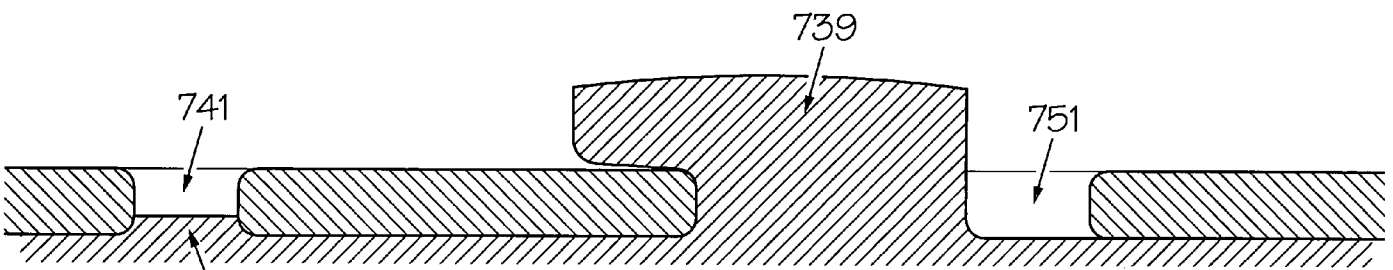

ALTERNATIVE LOCKING COUPLING: FIGS. 70*a*-70*c* illustrate a new and improved locking joint design. This alternative utilizes a separate slot 741 for locking. The separate slot 741 can be located anywhere on the panel and does not have to be near an existing tab or slot 751. FIG. 70*a* depicts the tab 739 inserted into the slot 751 with surfaces S5 and T5 in engagement. FIG. 70*b* depicts the tab 739 moved relative to the slot 751 with surface T1 of tab 731 making contact with surface S1, and surface S2 making contact with raised portion 743 of surface T2. The design causes the mating panel to flex during assembly, and then snap into the slot to provide a locking mechanism that resists disassembly of the joint in reverse order of assembly. FIG. 70*c* depicts the slot and tab fully engaged and locked into position by surface S5 of slot 741 engaging the shoulder of raised portion 743. The shape of the raised portion 743 may be varied to change the resistance characteristics of the locking mechanism. By making the raised portion 743 higher, the amount of force required to disassemble the joint can be increased.

Although the present invention is shown in a limited number of forms, it is not limited to just these forms, but is amenable to various changes and modifications without departing from the spirit thereof.

I claim:

1. A modular furniture unit, comprising:

at least one substantially vertical component having:

(1) at least one slot; and/or (2) at least one tab;

at least one substantially vertical support component having:

(1) at least one slot; and/or (2) at least one tab; and wherein said at least one substantially vertical component and said at least one substantially vertical support component are interconnected;

wherein at least one tab on a first component is slidingly inserted into a corresponding slot on a second flexible component along a first direction;

wherein the at least one tab forms a L-shaped configuration with an undercut having:

a first inner surface having a raised portion provided thereon;

a second inner surface extending relatively adjacent to the first inner surface; and a third inner surface extending from the first inner surface to the second inner surface;

wherein the second flexible component includes:

a first outer surface;

a second outer surface extending substantially parallel to the first surface;

a third outer surface extending from the first outer surface to the second outer surface;

a fourth outer surface extending from the first outer surface to the second outer surface and extending substantially parallel to the third outer surface;

wherein said first component and said second component are translated relative to one another in a second direction which is non-parallel to said first direction while said second flexible component undergoes a selected installation flexure due to the second outer surface contacting the second inner surface and the first outer surface contacting the raised portion; and a snap fit locking connection created between said first component and said second component due to:

the raised portion on said first component that resists disassembly by providing a locking shoulder which resists movement in said second direction, the raised portion being raised at a distance relative to the third inner surface, said distance being substantially the same as the length of the first outer surface; and locking contact between the first inner surface and the first outer surface, the second inner surface and the second outer surface, the third inner surface and the third outer surface, and the fourth outer surface and the locking shoulder in which the installation flexure is reduced.

* * * * *